US009353979B2

(12) United States Patent
Morimoto et al.

(10) Patent No.: US 9,353,979 B2
(45) Date of Patent: May 31, 2016

(54) AIR-CONDITIONING APPARATUS

(75) Inventors: Hiroyuki Morimoto, Tokyo (JP); Kouji Yamashita, Tokyo (JP); Takeshi Hatomura, Tokyo (JP); Shinichi Wakamoto, Tokyo (JP); Naofumi Takenaka, Tokyo (JP); Yusuke Shimazu, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 253 days.

(21) Appl. No.: 13/056,150

(22) PCT Filed: Oct. 29, 2008

(86) PCT No.: PCT/JP2008/069615
§ 371 (c)(1),
(2), (4) Date: Apr. 20, 2011

(87) PCT Pub. No.: WO2010/050007
PCT Pub. Date: May 6, 2010

(65) Prior Publication Data

US 2011/0192189 A1 Aug. 11, 2011

(51) Int. Cl.
*F25B 13/00* (2006.01)
*F25D 17/02* (2006.01)
(Continued)

(52) U.S. Cl.
CPC ..... *F25B 25/005* (2013.01); *F24F 3/06* (2013.01); *F25B 13/00* (2013.01); *F25B 49/005* (2013.01); *F25B 2313/0231* (2013.01); *F25B 2313/0272* (2013.01); *F25B 2313/02741* (2013.01)

(58) Field of Classification Search
CPC ..... F25D 21/04; F25D 21/14; F25D 21/08; F25D 2400/04; F25D 2400/30; F25B 47/022; F25B 25/005; F25B 7/00; F25B 1/10; F25B 40/00; F25B 2400/13; F25B 2309/061; F28D 15/0233; F28D 15/0266; F28D 15/0275; F28D 15/05
USPC ..... 62/513, 150, 333, 335, 277, 278; 165/63, 200, 104.14, 96
See application file for complete search history.

(56) References Cited

FOREIGN PATENT DOCUMENTS

EP 0 719 995 A2 7/1996
(Continued)

OTHER PUBLICATIONS

International Search Report (PCT/ISA/210) issued on Jan. 27, 2009.
(Continued)

*Primary Examiner* — Frantz Jules
*Assistant Examiner* — Meraj A Shaikh
(74) *Attorney, Agent, or Firm* — Buchanan Ingersoll & Rooney PC

(57) ABSTRACT

An air-conditioning apparatus in which entry of a refrigerant into a living space is suppressed and measures against refrigerant leakage are taken is provided.
An air-conditioning apparatus 100 is provided with a heat source device 1 having a compressor that pressurizes a primary refrigerant, a four-way valve 11 that switches a circulation direction of the primary refrigerant, and a heat-source side heat exchanger 12 connected to the four-way valve 11 and installed outside of a building 9 having a plurality of floors or in a space leading to the outside, a relay unit 3 having an intermediate heat exchanger that is disposed in a space not to be air-conditioned different from the space to be air-conditioned on the installed floor separated from the heat source device 1 by plural floors and exchanges heat between the primary refrigerant and a secondary refrigerant and a pump 21 that conveys the secondary refrigerant, an indoor unit 2 having a use-side heat exchanger 26 that exchanges heat between the secondary refrigerant and air in the space to be air-conditioned, a vertical pipeline that connects the heat source device 1 and the relay unit 3 across the plurality of floors, and a horizontal pipeline that connects the relay unit 3 and the indoor unit 2 to each other from outside a wall dividing the space to be air-conditioned to indoors and outdoors and in which the secondary refrigerant in a liquid phase flows through both of pipelines in sets of at least two pipelines.

23 Claims, 22 Drawing Sheets

(51) Int. Cl.

| | |
|---|---|
| ***F25B 25/00*** | (2006.01) |
| ***F24F 3/06*** | (2006.01) |
| ***F25B 49/00*** | (2006.01) |

(56) References Cited

FOREIGN PATENT DOCUMENTS

| | | | | |
|---|---|---|---|---|
| EP | 0 887 599 | A1 | | 12/1998 |
| JP | 2-118372 | A | | 5/1990 |
| JP | 5-280818 | A | | 10/1993 |
| JP | 05280818 | A | * | 10/1993 |
| JP | 11-211293 | A | | 8/1999 |
| JP | 11-344240 | A | | 12/1999 |
| JP | 2000234827 | A | * | 8/2000 |
| JP | 2003-343936 | A | | 12/2003 |
| JP | 2005-114313 | A | | 4/2005 |
| JP | 2005249258 | A | * | 9/2005 |
| JP | 2006-003079 | A | | 1/2006 |
| JP | 2006029744 | A | * | 2/2006 |
| JP | 2008-157481 | A | | 7/2008 |
| JP | 2008-196829 | A | | 8/2008 |
| JP | 2008196829 | A | * | 8/2008 |

OTHER PUBLICATIONS

Office Action (Notification of Reasons for Refusal) dated Aug. 14, 2012, issued by the Japanese Patent Office in the corresponding Japanese Patent Application No. 2010-535550 and an English translation thereof. (5 pages).

Notification of the First Office Action issued Feb. 16, 2013 in corresponding Chinese Patent Application No. 200880130499.0, and an English translation thereof.

Office Action issued on Oct. 21, 2013, by the Chinese Patent office in corresponding Chinese Application No. 200880130499.0, and an English Translation of the Office Action. (17 pages).

Extended European Search Report dated Jun. 10, 2014, issued by the European Patent Office in the corresponding European Application No. 08877719.8. (7 pages).

Office Action issued Apr. 23, 2014, by the Chinese Patent Office in corresponding Chinese Application No. 200880130499.0, and an English translation thereof.

* cited by examiner

AIR-CONDITIONING APPARATUS

TECHNICAL FIELD

The present invention relates to an air-conditioning apparatus applied to a multiple air conditioner for a building and the like.

BACKGROUND ART

Hitherto, a multiple air conditioner for a building to which an air-conditioning apparatus that performs a cooling operation or a heating operation by circulating a refrigerant between a heat source device (outdoor unit), which is a heat source machine arranged outside a room, and an indoor unit arranged inside the room so as to convey cooling energy or heating energy to a region to be air-conditioned such as an indoor space and the like is applied has existed (See Patent Literature 1, for example). As the refrigerant used in such an air-conditioning apparatus, HFC refrigerants, for example, are widely used. Also, a natural refrigerant such as carbon dioxide ($CO_2$) and the like has begun to be used.

Also, an air-conditioning apparatus of another configuration represented by a chiller system is present. In this air-conditioning apparatus, cooling energy or heating energy is generated in a heat source machine arranged outside the room, the cooling energy or heating energy is transferred to a heat medium such as water, an anti-freezing solution and the like by a heat exchanger arranged in the heat source device, and the heat medium is conveyed to a fan coil unit, a panel heater and the like, which is an indoor unit arranged in a region to be air-conditioned so as to perform the cooling operation or heating operation (See Patent Literature 2, for example). Moreover, there is known a waste heat recovery type chiller in which four water pipelines are connected to a heat source machine so as to supply cooling energy or heating energy.

[Patent Literature 1] Japanese Unexamined Patent Application Publication No. 2-118372 (page 3, FIG. 1)

[Patent Literature 2] Japanese Unexamined Patent Application Publication No. 2003-343936 (page 5, FIG. 1)

DISCLOSURE OF INVENTION

Problems to be Solved by the Invention

With a prior-art air-conditioning apparatus, since a high-pressure refrigerant is conveyed to an indoor unit, a refrigerant filled amount becomes extremely large, and if the refrigerant leaks from a refrigerant circuit, it might give a bad effect to the global environment such as deterioration of global warming. Particularly, R410A has as large global warming coefficient as 1970, and if such a refrigerant is to be used, reduction of the refrigerant filled amount becomes extremely important from the viewpoint of global environmental protection. Also, if the refrigerant leaks into a living space, there is a mental concern that chemical properties of the refrigerant might affect the human body.

Such a problem does not matter in the chiller system as described in Patent Literature 2. However, since heat exchange is performed between the refrigerant and water in the heat source device and the water is conveyed to the indoor unit, water conveying power becomes extremely large, which increases energy consumption.

The present invention was made in order to solve the above problems and has an object to provide an air-conditioning apparatus with improved safety and reliability by taking measures against refrigerant leakage while energy consumption is suppressed.

Means for Solving the Problems

An air-conditioning apparatus according to the present invention is provided with a heat source device having a compressor that pressurizes a primary refrigerant used by changing states between a gas phase and a liquid phase or between a supercritical state and a non-supercritical state, a switching device that switches the circulation direction of the primary refrigerant, and a first heat exchanger connected to the switching device and is installed outside of a building having a plurality of floors or in a space leading to the outside, a relay unit having a second heat exchanger that is located on an installed floor separated from the heat source device by plural floors and in a space not to be air-conditioned, which is different from the space to be air-conditioned, and exchanges heat between the primary refrigerant and a secondary refrigerant mainly composed of water or brine and a pump that conveys the secondary refrigerant, an indoor unit having a third heat exchanger that exchanges heat between the secondary refrigerant and air in the space to be air-conditioned, a vertical pipeline that connects the heat source device and the relay unit across the plurality of floors, and a horizontal pipeline that connects the relay unit and the indoor unit to each other from outside a wall dividing the space to be air-conditioned to indoors and outdoors and in which the secondary refrigerant in a liquid phase flows through both of pipelines in sets of at least two pipelines.

Advantages

According to the air-conditioning apparatus according to the present invention, intrusion of the heat-source side refrigerant into the living space is suppressed, leakage measures against the heat-source side refrigerant are taken, safety and reliability can be further improved, and an installation work can be made easy.

REFERENCE NUMERALS

Figure 1:
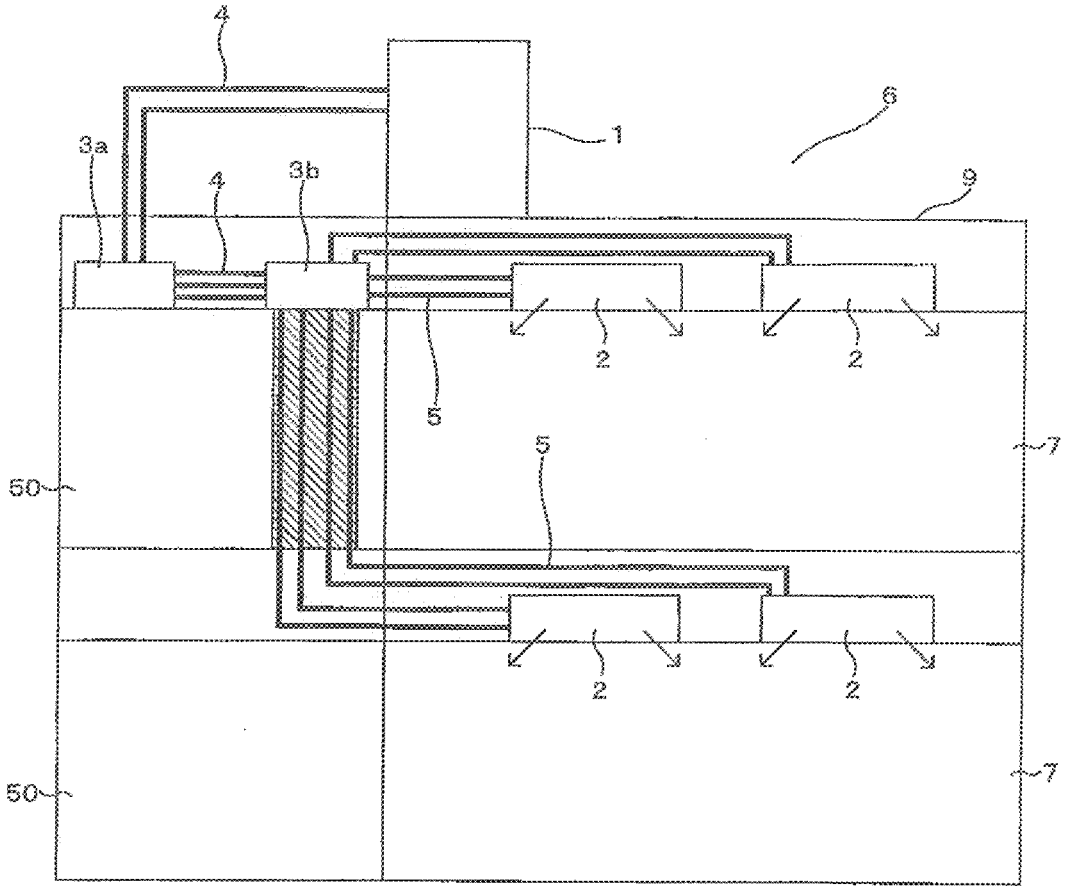
FIG. 1 is an outline diagram illustrating an example of an installed state of an air-conditioning apparatus according to Embodiment 1.

1 heat source device
2 indoor unit
2*a* indoor unit
2*b* indoor unit
2*c* indoor unit
2*d* indoor unit
3 relay unit
3*a* first relay unit
3*b* second relay unit
4 refrigerant pipeline
4*a* first connection pipeline
4*b* second connection pipeline
5 pipeline
5*a* pipeline
5*b* pipeline
6 outdoor space
7 living space
9 building
10 compressor
11 four-way valve
12 heat-source side heat exchanger
13*a* check valve
13*b* check valve
13*c* check valve
13*d* check valve
14 gas-liquid separator
15 intermediate heat exchanger
15*a* first intermediate heat exchanger
15*b* second intermediate heat exchanger
16 expansion valve
16*a* expansion valve
16*b* expansion valve
16*c* expansion valve
16*d* expansion valve
16*e* expansion valve
17 accumulator
21 pump
21*a* first pump
21*b* second pump
22 channel switching valve
22*a* channel switching valve
22*b* channel switching valve
22*c* channel switching valve
22*d* channel switching valve
22*e* channel switching valve
22*f* channel switching valve
23 channel switching valve
23*a* channel switching valve
23*b* channel switching valve
23*c* channel switching valve
23*d* channel switching valve
23*e* channel switching valve
23*f* channel switching valve
24 stop valve
24*a* stop valve
24*b* stop valve
24*c* stop valve
24*d* stop valve
24*e* stop valve
24*f* stop valve
25 flow regulating valve
25*a* flow regulating valve
25*b* flow regulating valve
25*c* flow regulating valve
25*d* flow regulating valve
25*e* flow regulating valve
25*f* flow regulating valve
26 use-side heat exchanger
26*a* use-side heat exchanger
26*b* use-side heat exchanger
26*c* use-side heat exchanger
26*d* use-side heat exchanger
26*e* use-side heat exchanger
26*f* use-side heat exchanger
27 bypass
27*a* bypass
27*b* bypass
27*c* bypass
27*d* bypass
27*e* bypass
27*f* bypass
31 first temperature sensor
31*a* first temperature sensor
31*b* first temperature sensor
32 second temperature sensor
32*a* second temperature sensor
32*b* second temperature sensor
33 third temperature sensor
33*a* third temperature sensor
33*b* third temperature sensor

33*c* third temperature sensor
34 fourth temperature sensor
34*a* fourth temperature sensor
34*b* fourth temperature sensor
34*c* fourth temperature sensor
35 fifth temperature sensor
36 first pressure sensor
37 sixth temperature sensor
38 seventh temperature sensor
39 eighth temperature sensor
40 second pressure sensor
50 non-living space
50*a* wall back
50*b* air inlet
50*c* air outlet
51 pipe shaft
52 vibration suppression plate
53 ventilating device
55 machine room
56 air chamber
60 partition plate
61*a* refrigerant concentration detection sensor
61*b* refrigerant concentration detection sensor
62*a* controller
62*b* controller
62*c* controller
65 connection pipeline
65*a* heating-side connection pipeline
65*b* cooling-side connection pipeline
66 bulkhead
100 air-conditioning apparatus
101 heat source device
102 indoor unit
102*a* indoor unit
102*b* indoor unit
102*c* indoor unit
102*d* indoor unit
102*e* indoor unit
102*f* indoor unit
103 relay unit
104 three-way valve
104' four-way valve
104*a* three-way valve
104*a'* four-way valve
104*b* three-way valve
104*b'* four-way valve
105 heat-source side heat exchanger
106 expansion valve
107 two-way valve
107*a* two-way valve
107*b* two-way valve
107*c* two-way valve
108 refrigerant pipeline
108*a* refrigerant pipeline
108*b* refrigerant pipeline
108*c* refrigerant pipeline
110 compressor
111 oil separator
113 check valve
200 air-conditioning apparatus
200' air-conditioning apparatus
203 expansion valve
203*a* expansion valve
203*b* expansion valve
204 two-way valve
204*a* two-way valve
204*b* two-way valve
205 two-way valve
205*a* two-way valve
205*b* two-way valve

BEST MODES FOR CARRYING OUT THE INVENTION

Embodiments of the present invention will be described below.

Embodiment 1

Since an HFC refrigerant such as R410A, R407C, R404A has a large global warming coefficient, if the refrigerant leaks, a load on the environment is hazardous. Thus, a natural refrigerant such as carbon dioxide, ammonia hydrocarbon or a refrigerant such as HFO (hydrofluoro-olefin) has been examined as a refrigerant replacing the HFC (hydrofluoro carbon) refrigerant. However, these refrigerants might be flammable (ammonia and carbon hydrocarbon, for example) or have small limit concentration of leakage. That is, though these refrigerants have small global warming coefficients, it is not preferable to have them in a living space in view of an influence and safety on the human body.

Table 1 illustrates an example of leakage limit concentration in a living space determined by the ISO standards.

TABLE 1

| Refrigerant | Limit concentration [kg/m$^3$] |
|---|---|
| R410A | 0.44 |
| Carbon dioxide | 0.07 |
| Ammonia | 0.0004 |
| Propane | 0.008 |

From Table 1, it is known that R410A, which is one of the HFC refrigerant, widely used in a direct expansion air-conditioning apparatus at present has a larger leakage limit concentration than the other refrigerants, and an influence in the case of leakage does not matter so much. On the other hand, the natural refrigerants such as ammonia, propane, which is one of hydrocarbon, carbon dioxide and the like has extremely small leakage limit concentrations, and in order to apply these refrigerants to an air-conditioning apparatus, there is a problem that measures against refrigerant leakage should be taken. Thus, in an air conditioner according to Embodiment 1 has a major purpose to solve this problem.

Supposing that carbon dioxide is used as a refrigerant, an allowable refrigerant filled amount that satisfies the leakage limit concentration of 0.07 [kg/m$^3$] shown in Table 1 is estimated. A capacity of the smallest indoor unit for a multiple air conditioner for building is approximately 1.5 [kW]. Supposing that one indoor unit is installed in a small meeting room (size of the room: floor area 15 [m$^2$] and height 3 [m]), the refrigerant filled amount needs to be 3.15 [kg] or less. That is, by filling the refrigerant of 3.15 [kg] or less as a system, the leakage limit concentration can be cleared, and reliability can be ensured. Similarly, if the allowable refrigerant filled amount of ammonia is estimated, it needs to be 0.018 [kg], and the allowable refrigerant filled amount of propane needs to be 0.36 [kg] or less.

The allowable refrigerant filled amount can be acquired from the following equation (1) from the leakage limit concentration of the refrigerant. That is, it is only necessary that the allowable refrigerant filled amount is determined so that the equation (1) is satisfied:

$$W\text{ref}=Lm\times Rv \qquad \text{Equation (1)}$$

where Wref indicates the allowable refrigerant filled amount [kg], Lm for the leakage limit concentration [kg/m$^3$], and Rv for the capacity [m$^3$] of the smallest room (a place with the smallest capacity in the places where an indoor unit 2 is arranged), respectively. The above-described allowable refrigerant filled amount of carbon dioxide results in 0.07×15×3=3.15 from the equation (1).

However, in order to realize the above refrigerant filled amount in a large-sized air-conditioning apparatus represented by a multiple air conditioner for building, a technical breakthrough is needed. Thus, the air-conditioning apparatus according to Embodiment 1 solves the refrigerant leakage problem and realizes installation work saving, individual discrete control, and energy saving such as a prior-art direct expansion air conditioner by cutting off a refrigerant system as described below. The air-conditioning apparatus according to Embodiment 1 will be described below referring to the attached drawings.

Figure 1A:
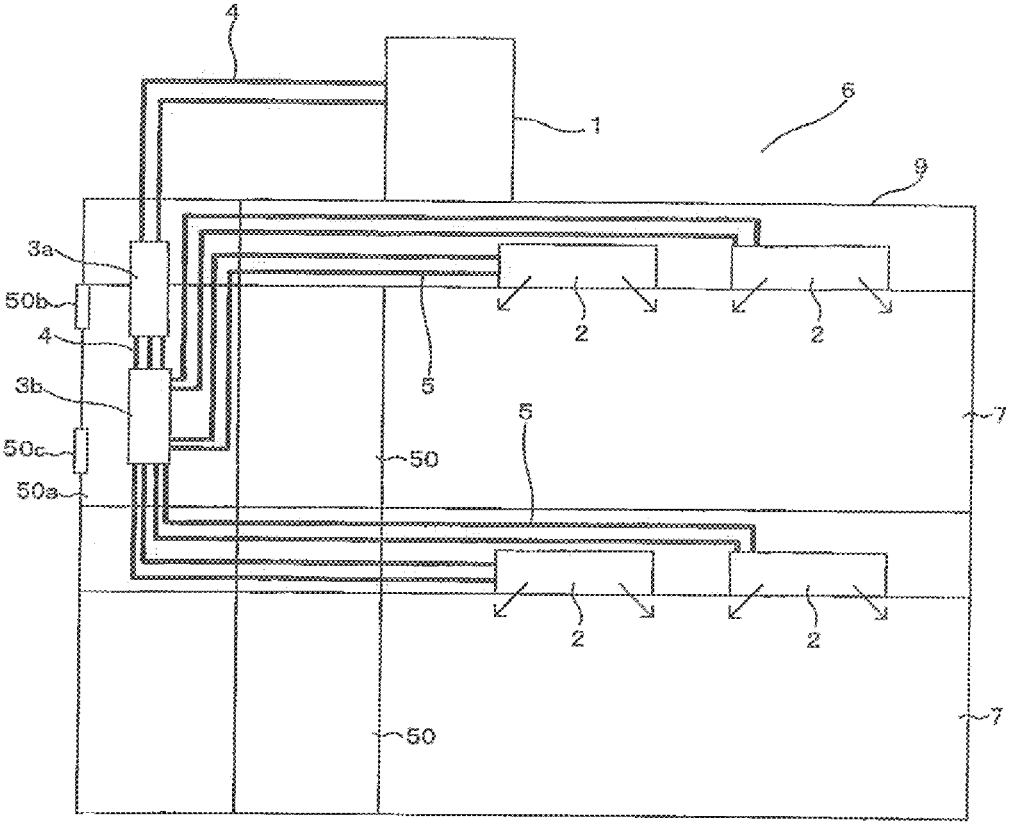
FIG. 1*a* is an outline diagram illustrating another example of the installed state of the air-conditioning apparatus according to Embodiment 1.

FIG. 1 is an outline diagram illustrating an example of an installed state of the air-conditioning apparatus according to Embodiment 1 of the present invention. FIG. 1*a* is an outline diagram illustrating another example of the installed state of the air-conditioning apparatus according to the Embodiment 1 of the present invention. On the basis of FIGS. 1 and 1*a*, an outline configuration of the air-conditioning apparatus will be described. This air-conditioning apparatus performs a cooling operation or a heating operation using a refrigeration cycle (a refrigeration cycle and a heat medium circulation circuit) through which a refrigerant (a heat-source side refrigerant to become a primary refrigerant and a heat medium (water, anti-freezing solution and the like) to become a secondary refrigerant) are circulated. In the following figures including FIG. 1, a size relationship among each constituent member might be different from actual ones.

As shown in FIG. 1, this air-conditioning apparatus has one heat source device 1, which is an outdoor unit, a plurality of indoor units 2, and a relay unit 3 interposed between the heat source device 1 and the indoor units 2. The relay unit 3 exchanges heat between the heat-source side refrigerant and the heat medium and has a first relay unit 3*a* and a second relay unit 3*b*. The heat source device 1 and the relay unit 3 are connected to each other by a refrigerant pipeline (vertical pipeline) 4 that conducts the heat-source side refrigerant across one or plural floors of a building 9. Also, the relay unit 3 and the indoor unit 2 are connected to each other by a pipeline (horizontal pipeline) 5 that conducts the heat medium across the boundary between a space to be air-conditioned of the air-conditioning apparatus and the other non-air-conditioned space so that cooling energy or heating energy generated by the heat source device 1 is delivered to the indoor units 2. The numbers of connected heat source device 1, indoor units 2 and the relay units 3 are not limited to those illustrated. Also, there may be a pipeline extending horizontally in a part of the vertical pipeline, or a part of the horizontal pipeline may include a pipeline in the vertical direction that connects some difference in the height (height that is contained in a difference between adjacent floors, for example).

Through the refrigerant pipeline 4, a fluorocarbon refrigerant such as HFC and HFO that can propagate relatively large energy in a change between a gas phase and a liquid phase in a use state or a natural refrigerant such as ammonia flows as the primary refrigerant. On the other hand, through the pipeline 5, a heat medium containing water or brine as a main component flows as the secondary refrigerant. As the second refrigerant, simple water can be used and also, additives having an antiseptic effect or an anti-freezing effect might be added to water, and a medium that can convey heat in a larger heat capacity without a phase change than a heat pump effect by the phase change unlike the primary refrigerant is used. In view of prevention of the global warming, it may also be a useful selection to use carbon dioxide as the primary refrigerant and to make the refrigeration cycle of the primary refrigerant a supercritical cycle.

The heat source device 1 is arranged in an outdoor space 6, which is a space outside the building 9 such as building and supplies cooling energy or heating energy to the indoor unit 2 through the relay unit 3. The indoor unit 2 is arranged in a living space 7 such as a living room inside the building 9 to which air for cooling or air for heating can be conveyed and supplies the air for cooling or the air for heating to the living space 7 to become a region to be air-conditioned. The relay unit 3 is constituted as a separate body from the heat source device 1 and the indoor unit 2 and is arranged at a position different from the outdoor space 6 and the living space 7 (hereinafter referred to as a non-living space 50) in order to connect the heat source device 1 and the indoor units 2 to each other and to transfer cooling energy or heating energy supplied from the heat source device 1 to the indoor units 2.

As the outdoor space 6, a place located outside the building 9 such as a rooftop shown in FIG. 1, for example, is supposed. The non-living space 50 is one of non-targeted spaces such as over corridors, which are places where people are not always present, and a place in the ceiling of a common zone, a common place where an elevator or the like is installed, a machine room, a computer room (a server room), a warehouse or the like is supposed. Also, the living space 7 is a place where people are always present or a place where a large or a small number of people are present even temporarily, and an office, a classroom, a meeting room, a dining room or the like is supposed. A shaded portion shown in FIG. 1 indicates a pipe shaft 51 through which the pipeline 5 is made to pass downstairs.

The heat source device 1 and the first relay unit 3*a* are connected using two refrigerant pipelines 4. Also, the first relay unit 3*a* and a second relay unit 3*b* are connected by three refrigerant pipelines 4. Moreover, the second relay unit 3*b* and each indoor unit 2 are connected by two pipelines 5, respectively. By connecting the heat source device 1 to the relay unit 3 by the two refrigerant pipelines 4 and by connecting the indoor units 2 to the relay unit 3 by the two pipelines 5 as above, construction of the air-conditioning apparatus is made easy.

Figure 2:
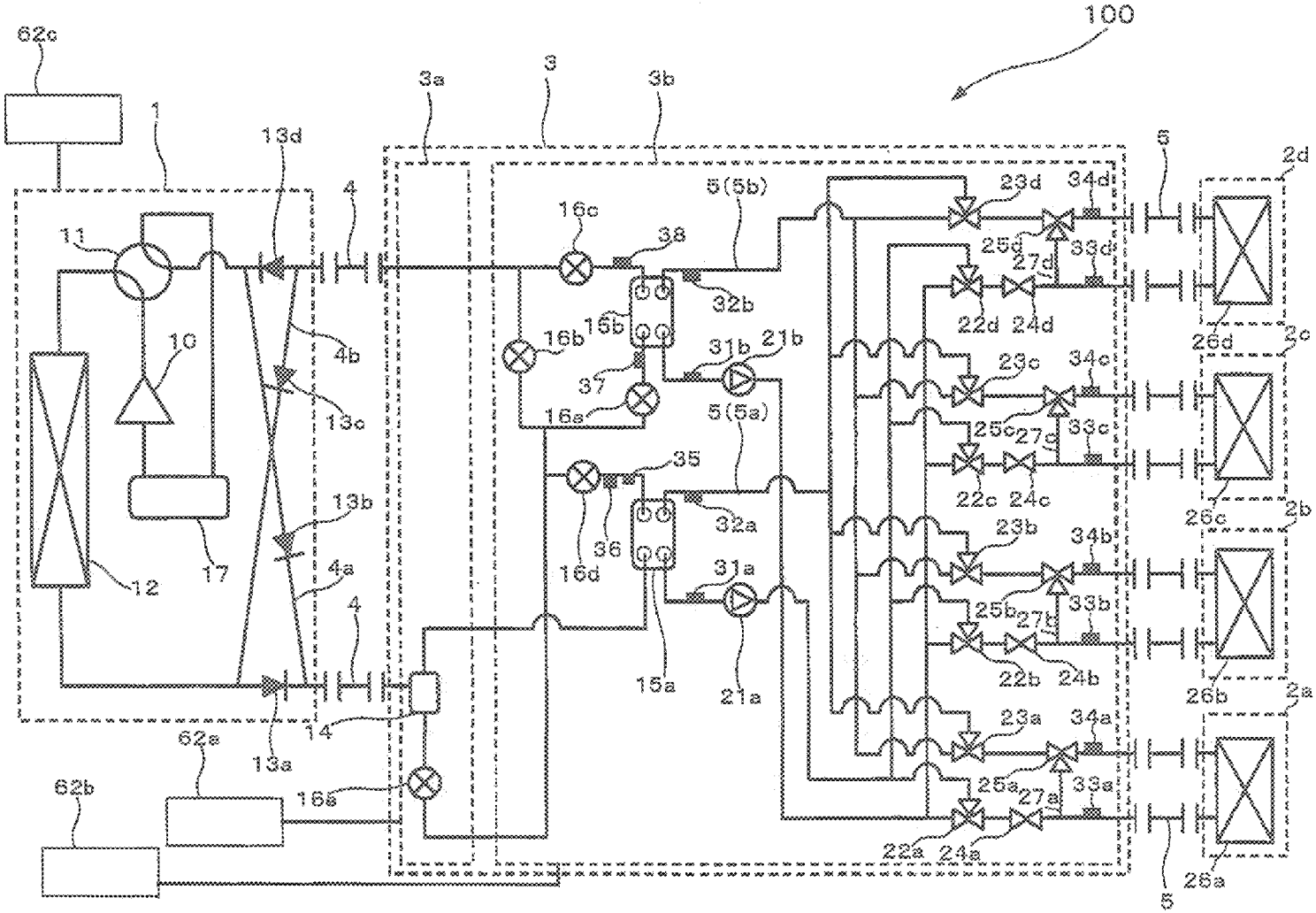
FIG. 2 is an outline circuit diagram illustrating a configuration of the air-conditioning apparatus.

As mentioned above, by dividing the relay unit 3 into two, that is, the first relay unit 3*a* and the second relay unit 3*b*, a plurality of the second relay units 3*b* can be connected to one first relay unit 3*a* (See FIG. 2). In FIG. 1, the indoor unit 2 is shown as a ceiling cassette type as an example, but not limited thereto, and may be any type as long as it can blow out cooling energy or heating energy directly or using a duct or the like to the living space 7, for example a ceiling-concealed type or a ceiling-suspended type. Also, in FIG. 1, a case in which the relay unit 3 is installed under the roof is shown as an example, but not limited thereto, and the unit may be installed behind the wall on the side face.

Also, in FIG. 1, the case in which the heat source device 1 is installed in the outdoor space 6 is shown as an example, but not limited to that. For example, the heat source device 1 may be installed in a surrounded space such as a machine room with a ventilation port, may be installed inside the building 9 only if waste energy can be discharged to the outside of the building 9 by an air discharge duct or may be installed inside the building 9 if the heat source device 1 of a water-cooling type is used. Even if the heat source device 1 is installed in such a place, no particular problem will occur.

Moreover, in the non-living space 50 under the roof where the relay unit 3 is installed, a partition plate 60 is disposed so that the space is divided by this partition plate 60 into a space for containing the relay unit 3 and a space for containing the indoor unit 2. That is, since the indoor unit 2 is disposed so as to communicate with the living space 7, the partition plate 60 is disposed so that the heat-source side refrigerant that leaked in the relay unit 3 does not flow into the space under the roof on the living space 7 side. A material, a thickness and a shape of the partition plate 60 are not particularly limited. Also, as long as a dispersion speed of the refrigerant can be suppressed if the refrigerant should leak, a slight clearance can be present between the partition plate 60 and the ceiling plate or the structural body of the building or between the pipelines.

As shown in FIG. 1*a*, the first relay unit 3*a* and the second relay unit 3*b* may be stored in a wall back 50*a*. By installing and storing the first relay unit 3*a* and the second relay unit 3*b* in the wall back 50*a* as above, even if the heat-source side refrigerant leaks, inflow of the heat-source side refrigerant into the living space 7 can be suppressed, and a bad influence caused by the refrigerant leakage can be suppressed as described above. Particularly, since people in the States and the European countries have a custom that the air-conditioning apparatus is stored in the wall back 50*a* so that the air-conditioning apparatus is not seen from the outside, it is a good idea to use such a space.

Also, if abnormality occurs in the first relay unit 3*a* and/or in the second relay unit 3*b* and maintenance, inspection or the like is to be made, it is easier if the first relay unit 3*a* and the second relay unit 3*b* are installed in the wall back 50*a* rather than under the roof. That is, maintenance performance can be more improved if the first relay unit 3*a* and/or the second relay unit 3*b* are installed in the wall back 50*a*. Moreover, by disposing an air inlet 50*b* and an air outlet 50*c* in the wall back 50*a*, even if the heat-source side refrigerant leaks, the heat-source side refrigerant can be discharged to the outdoor space 6 together with the air in the wall back 50*a*, whereby safety can be more improved. Since the heat-source side refrigerant is heavier than the air in general, by disposing the air outlet 50*c* below the air inlet 50*b*, efficient air suction/discharge can be performed.

Figure 3:
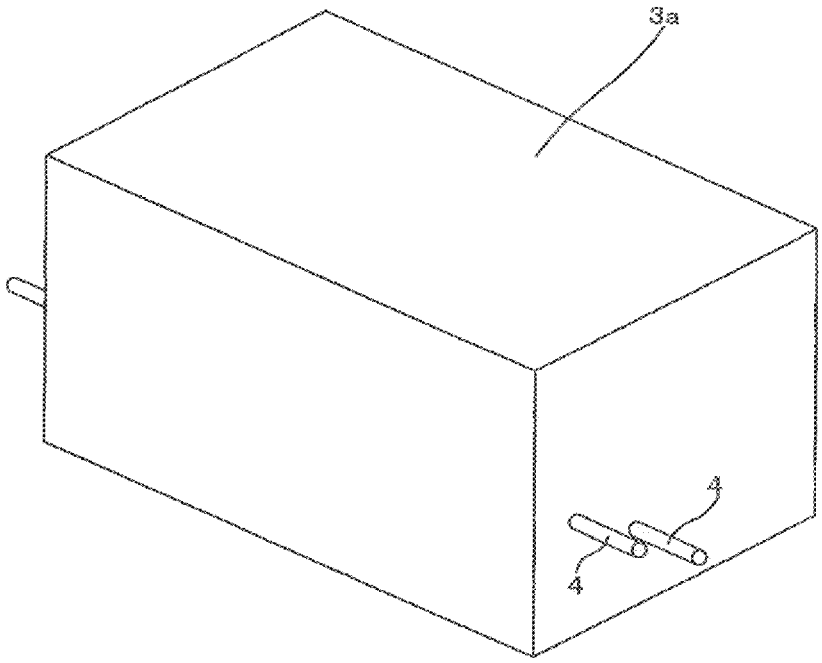
FIG. 3 is a perspective view illustrating an appearance configuration of a relay unit.

FIG. 2 is an outline circuit diagram illustrating a configuration of the air-conditioning apparatus 100. FIG. 3 is a perspective view illustrating an appearance configuration of the relay unit 3. On the basis of FIGS. 2 and 3, the detailed configuration of the air-conditioning apparatus 100 will be described. As shown in FIG. 2, the heat source device 1 and the relay unit 3 are connected through a first intermediate heat exchanger 15*a* and a second intermediate heat exchanger 15*b* disposed in the second relay unit 3*b*, and the relay unit 3 and the indoor unit 2 are also connected through the first intermediate heat exchanger 15*a* and the second intermediate heat exchanger 15*b* disposed in the second relay unit 3. The configuration and functions of each component disposed in the air-conditioning apparatus 100 will be described below.

[Heat Source Device 1]

In the heat source device 1, a compressor 10, a four-way valve 11, which is a switching device that switches a channel of the refrigerant, a heat-source side heat exchanger 12, which is a first heat exchanger, and an accumulator 17 are connected and contained in series by the refrigerant pipeline 4. Also, in the heat source device 1, a first connection pipeline 4*a*, a second connection pipeline 4*b*, a check valve 13*a*, a check valve 13*b*, a check valve 13*c*, and a check valve 13*d* are disposed. By disposing the first connection pipeline 4*a*, the second connection pipeline 4*b*, the check valve 13*a*, the check valve 13*b*, the check valve 13*c*, and the check valve 13*d*, the flow direction of the heat-source side refrigerant made to flow into the relay unit 3 can be made constant regardless of an operation required by the indoor unit 2.

The compressor 10 sucks in the heat-source side refrigerant and compresses the heat-source side refrigerant to turn it into a high-temperature and high-pressure state and may be composed of an inverter compressor or the like capable of capacity control, for example. The four-way valve 11 performs switching between the flow of the heat-source side refrigerant during a heating operation and the flow of the heat-source side refrigerant during the cooling operation. The heat-source side heat exchanger 12 functions as an evaporator during the heating operation, while it functions as a condenser during the cooling operation so as to exchange heat between the air supplied from a blower such as a fan, not shown, and the heat-source side refrigerant and to evaporate and gasify the heat-source side refrigerant or to condense and liquefy the same. The accumulator 17 is disposed on the suction side of the compressor 10 and stores an excess refrigerant.

The check valve 13*d* is disposed in the refrigerant pipeline 4 between the relay unit 3 and the four-way valve 11 so as to allow the flow of the heat-source side refrigerant only in a predetermined direction (direction from the relay unit 3 to the heat source device 1). The check valve 13*a* is disposed in the refrigerant pipeline 4 between the heat-source side heat exchanger 12 and the relay unit 3 so as to allow the flow of the heat-source side refrigerant only in a predetermined direction (direction from the heat source device 1 to the relay unit 3). The check valve 13*b* is disposed in the first connection pipeline 4*a* so as to allow the flow of the heat-source side refrigerant only in the direction of the downstream side of the check valve 13*d* to the downstream side of the check valve 13*a*. The check valve 13*c* is disposed in the second connection pipeline 4*b* so as to allow the flow of the heat-source side refrigerant only in the direction of the upstream side of the check valve 13*d* to the upstream side of the check valve 13*a*.

The first connection pipeline 4*a* connects the refrigerant pipeline 4 on the downstream side of the check valve 13*d* and the refrigerant pipeline 4 on the downstream side of the check valve 13*a* to each other in the heat source device 1. The second connection pipeline 4*b* connects the refrigerant pipeline 4 on the upstream side of the check valve 13*d* and the refrigerant pipeline 4 on the upstream side of the check valve 13*a* to each other in the heat source device 1. In FIG. 2, the case in which the first connection pipeline 4*a*, the second connection pipeline 4*b*, the check valve 13*a*, the check valve 13*b*, the check valve 13*c*, and the check valve 13*d* are disposed is shown as an example, but not limited to that, and they do not necessarily have to be disposed.

[Indoor Unit 2]

On the indoor units 2, use-side heat exchangers 26, which are the third heat exchangers, are mounted, respectively. This use-side heat exchanger 26 is connected to a stop valve 24 and a flow regulating valve 25 of the second relay unit 3*b* through the pipeline 5. This use-side heat exchanger 26 exchanges heat between the air supplied from the blower such as a fan, not shown, and a heat medium and generates heated air or cooled air to be supplied to a region to be air-conditioned.

In FIG. 2, the case in which four indoor units 2 are connected to the relay unit 3 is shown, in which an indoor unit 2*a*, an indoor unit 2*b*, an indoor unit 2*c*, and an indoor unit 2*d* from the lower side in the figure are shown. Also, in accordance with the indoor units 2*a* to 2*d*, the use-side heat exchanger 26 is also shown from the lower side in the figure as a use-side heat exchanger 26, a use-side heat exchanger

26*b*, a use-side heat exchanger 26*c*, and a use-side heat exchanger 26*d*. Similarly to FIG. 1, the number of connected indoor units 2 is not limited to four units shown in FIG. 2.

[Relay Unit 3]

The relay unit 3 is composed of the first relay unit 3*a* and the second relay unit 3*b* with separate housings. By configuring as above, a plurality of the second relay units 3*b* can be connected to one first relay unit 3*a*. In the first relay unit 3*a*, a gas-liquid separator 14 and an expansion valve 16*e* are disposed. In the second relay unit 3*b*, two intermediate heat exchangers 15, which are second heat exchangers, four expansion valves 16, two pumps 21, four channel switching valves 22, four channel switching valves 23, four stop valves 24, and four flow regulating valves 25 are disposed.

The gas-liquid separator 14 is connected to the single refrigerant pipeline 4 connected to the heat source device 1 and the two refrigerant pipelines 4 connected to the first intermediate heat exchanger 15*a* and the second intermediate heat exchanger 15*b* of the second relay unit 3*b* so as to separate the heat-source side refrigerant supplied from the heat source device 1 to a vapor-state refrigerant and a liquid refrigerant. The expansion valve 16*e* is disposed between the refrigerant pipeline 4 that connects the expansion valve 16*a* and the expansion valve 16*b* to each other and the gas-liquid separator 14 and functions as a reducing valve or a throttle device so as to decompress and expand the heat-source side refrigerant. The expansion valve 16*e* is preferably composed of a valve with variably controllable opening degree such as an electronic expansion valve, for example.

Also, in the first relay unit 3*a*, a refrigerant concentration detection sensor 61*a*, which is refrigerant concentration detecting means that detects refrigerant concentration of the heat-source side refrigerant, is provided. This refrigerant concentration detection sensor 61*a* is to detect concentration of the heat-source side refrigerant having leaked in the first relay unit 3*a*. Refrigerant concentration information detected by this refrigerant concentration detection sensor 61*a* is sent to a controller 62*a* as a signal. The controller 62*a* calculates the signals from the refrigerant concentration detection sensor 61*a* and controls driving of each actuator (such as the compressor 10, the four-way valve 11, the expansion valve 16*e* and the like).

For example, it is preferable to configure such that, if the refrigerant concentration detected by the refrigerant concentration detection sensor 61*a* exceeds the predetermined threshold value determined in advance, the controller 62*a* can stop the entire system (such as driving of the compressor 10) and make an alarm on occurrence of abnormality of refrigerant leakage to a user. Then, the occurrence of abnormality caused by leakage of the heat-source side refrigerant in the first relay unit 3*a* can be rapidly made recognized by the user, and quick response can be taken. Alternatively, it is preferable to configured such that, if the refrigerant concentration detected by the refrigerant concentration detection sensor 61*a* becomes not less than the predetermined threshold value determined in advance, the controller 62*a* closes the above-described valve devices and the expansion valve and can make an alarm. Then, the leakage amount of the heat-source side refrigerant in the first relay unit 3*a* can be kept at the smallest, and damage can be minimized.

The above-described threshold value is preferably set at the leakage limit concentration in Table 1. Also, considering an error or the like of the value detected by the refrigerant concentration detection sensor 61*a*, the threshold value may be set approximately at 1/10 of the leakage limit concentration. FIG. 2 illustrates the case in which the controller 62*a* is disposed outside the first relay unit 3*a* as an example, but not limited to that, and the controller may be disposed in the first relay unit 3*a*, for example. Also, an alarm to the user may be made in display, sound or both of them.

The two intermediate heat exchangers 15 (the first intermediate heat exchanger 15*a* and the second intermediate heat exchanger 15*b*) function as condensers or evaporators, exchange heat between the heat-source side refrigerant and the heat medium and supply cooling energy or heating energy generated in the heat-source device 1 to the indoor units 2. In the flow of the heat-source side refrigerant, the first intermediate heat exchanger 15*a* is disposed between the gas-liquid separator 14 and the expansion valve 16*d* and is used for heating the heat medium. In the flow of the heat-source side refrigerant, the second intermediate heat exchanger 15*b* is disposed between the expansion valve 16*a* and the expansion valve 16*c* and used for cooling the heat medium.

The four expansion valves 16 (the expansion valves 16*a* to 16*d*) function as reducing valves or throttle devices and decompress and expand the heat-source-side refrigerant. The expansion valve 16*a* is disposed between the expansion valve 16*e* and the second intermediate heat exchanger 15*b*. The expansion valve 16*b* is disposed so as to be in parallel with the expansion valve 16*a*. The expansion valve 16*c* is disposed between the second intermediate heat exchanger 15*b* and the first relay unit 3*a*. The expansion valve 16*d* is disposed between the first intermediate heat exchanger 15*a* and the expansion valve 16*a* as well as the expansion valve 16*b*. The four expansion valves 16 are preferably composed of valves with variably controllable opening degree such as electronic expansion valves, for example.

The two pumps 21 (the first pump 21*a* and the second pump 21*b*) circulate the heat medium conducted through the pipeline 5. The first pump 21*a* is disposed in the pipeline 5 between the first intermediate heat exchanger 15*a* and the channel switching valve 22. The second pump 21*b* is disposed in the pipeline 5 between the second intermediate heat exchanger 15*b* and the channel switching valve 22. The type of the first pump 21*a* and the second pump 21*b* is not particularly limited but may be configured by a capacity-controllable pump or the like.

The four channel switching valves 22 (the channel switching valves 22*a* to 22*d*) are composed of three-way valves and switch the channels of the heat medium. The channel switching valves 22 are disposed in the number (four, here) according to the number of the installed indoor units 2. As for the channel switching valves 22, one of the three ways is connected to the first intermediate heat exchanger 15*a*, another one of the three ways to the second intermediate heat exchanger 15*b*, and the rest of the three ways to the stop valve 24, respectively, and they are disposed on the inlet side of a heat medium channel of the use-side heat exchanger 26. In accordance with the indoor units 2, they are shown as the channel switching valve 22*a*, the channel switching valve 22*b*, the channel switching valve 22*c*, and the channel switching valve 22*d* from the lower side in the figure.

The four channel switching valves 23 (the channel switching valves 23*a* to 23*d*) are composed of three-way valves and switch the channels of the heat medium. The channel switching valves 23 are disposed in the number (four, here) according to the number of the installed indoor units 2. As for the channel switching valves 23, one of the three ways is connected to the first intermediate heat exchanger 15*a*, another one of the three ways to the second intermediate heat exchanger 15*b*, and the rest of the three ways to the flow regulating valve 25, respectively, and they are disposed on the outlet side of a heat medium channel of the use-side heat exchanger 26. In accordance with the indoor units 2, they are shown as the channel switching valve 23*a*, the channel switching valve 23*b*, the channel switching valve 23*c*, and the channel switching valve 23*d* from the lower side in the figure.

The four stop valves 24 (the stop valves 24*a* to 24*d*) are composed of two-way valves and open/close the pipeline 5. The stop valves 24 are disposed in the number (four, here) according to the number of the installed indoor units 2. As for the stop valves 24, one sides are connected to the use-side heat exchanger 26, while the other sides are connected to the channel switching valve 22, respectively, and they are disposed on the inlet side of the heat medium channel of the use-side heat exchanger 26. In accordance with the indoor units 2, they are shown as the stop valve 24*a*, the stop valve 24*b*, the stop valve 24*c*, and the stop valve 24*d* from the lower side in the figure.

The four flow regulating valves 25 (the flow regulating valves 25*a* to 25*d*) are composed of three-way valves and switch the channels of the heat medium. The flow regulating valves 25 are disposed with the number (it is four, here) according to the number of the installed indoor units 2. As for the flow regulating valves 25, one of the three ways is connected to the use-side heat 26, another one of the three ways to a bypass 27, and the rest of the three ways to the channel switching valve 23, respectively, and they are disposed on the outlet side of a heat medium channel of the use-side heat exchanger 26. In accordance with the indoor units 2, they are shown as the flow regulating valve 25*a*, the flow regulating valve 25*b*, the flow regulating valve 25*c*, and the flow regulating valve 25*d* from the lower side of the paper.

The bypass 27 is disposed so as to connect the pipeline 5 to the flow regulating valve 25 between the stop valve 24 and the use-side heat exchanger 26. The bypasses 27 are disposed in the number according to the installed number of the indoor units 2 (four, here, that is, a bypass 27*a*, a bypass 27*b*, a bypass 27*c*, and a bypass 27*d*). In accordance with the indoor units 2, they are shown as the bypass 27*a*, the bypass 27*b*, the bypass 27*c*, and the bypass 27*d* from the lower side in the figure.

Also, in the second relay unit 3*b*, a refrigerant concentration detection sensor 61*b*, which is refrigerant concentration detecting means that detects refrigerant concentration of the heat-source side refrigerant, is disposed. This refrigerant concentration detection sensor 61*b* detects the concentration of the heat-source side refrigerant that leaked in the second relay unit 3*b*. Refrigerant concentration information detected by this refrigerant concentration detection sensor 61*b* is sent to a controller 62*b* as a signal. The controller 62*b* calculates the signal from the refrigerant concentration detection sensor 61*b* and controls driving of each actuator.

For example, it is preferable to configure such that, if the refrigerant concentration detected by the refrigerant concentration detection sensor 61*b* becomes not less than a predetermined threshold value determined in advance, the controller 62*b* can stop the entire system and make an alarm on occurrence of abnormality of refrigerant leakage to a user. Then, the occurrence of abnormality caused by leakage of the heat-source side refrigerant in the second relay unit 3*b* can be rapidly made recognized by the user, and quick response can be taken. Alternatively, it is preferable to configure such that, if the refrigerant concentration detected by the refrigerant concentration detection sensor 61*b* becomes not less than the predetermined threshold value determined in advance, the controller 62*b* closes the above-described valve devices and the expansion valve and can make an alarm. Then the leakage amount of the heat-source side refrigerant in the second relay unit 3*b* can be kept at the smallest, and damage can be minimized.

The above-described threshold value is preferably set at the leakage limit concentration in Table 1. Also, considering an error or the like of the value detected by the refrigerant concentration detection sensor 61*b*, the threshold value may be set approximately at 1/10 of the leakage limit concentration. FIG. 2 illustrates the case in which the controller 62*b* is disposed outside the second relay unit 3*b* as an example, but not limited thereto. The controller may be disposed in the second relay unit 3*b*, for example. Also, as shown in FIG. 2, the controller 62*b* and the controller 62*a* may be disposed separately or may be disposed integrally.

Also, in the second relay unit 3*b*, two first temperature sensors 31, two second temperature sensors 32, four third temperature sensors 33, four fourth temperature sensors 34, a fifth temperature sensor 35, a first pressure sensor 36, a sixth temperature sensor 37, and a seventh temperature sensor 38 are disposed. The information detected by these detecting means is sent to the controller that controls the operation of the air-conditioning apparatus 100 (the controller 62*a*, the controller 62*b* or a controller 62*c*, hereinafter the same applies in this embodiment) and used for control of driving frequencies of the compressor 10 and the pump 21, switching of the channel for the heat medium flowing through the pipeline 5 and the like.

The two first temperature sensors 31 (a first temperature sensor 31*a* and a first temperature sensor 31*b*) detect the temperature of the heat medium flowing out of the intermediate heat exchanger 15, that is, the heat medium temperature at the outlet of the intermediate heat exchanger 15 and is preferably composed of a thermistor or the like. The first temperature sensor 31*a* is disposed in the pipeline 5 on the inlet side of the first pump 21*a*. The first temperature sensor 31*b* is disposed in the pipeline 5 on the inlet side of the second pump 21*b*.

The two second temperature sensors 32 (a second temperature sensor 32*a* and a second temperature sensor 32*b*) detect the temperature of the heat medium flowing into the intermediate heat exchanger 15, that is, the heat medium temperature at the inlet of the intermediate heat exchanger 15 and is preferably composed of a thermistor or the like. The second temperature sensor 32*a* is disposed in the pipeline 5 on the inlet side of the first intermediate heat exchanger 15*a*. The second temperature sensor 32*b* is disposed in the pipeline 5 on the inlet side of the second intermediate heat exchanger 15*b*.

The four third temperature sensors 33 (third temperature sensors 33*a* to 33*d*) are disposed on the inlet side of the heat medium channel of the use-side heat exchanger 26 and detect the temperature of the heat medium flowing into the use-side heat exchanger 26, and preferably composed of a thermistor or the like. The third temperature sensors 33 are disposed with the number (here, it is four) according to the installed number of the indoor units 2. In accordance with the indoor units 2, they are shown as the third temperature sensor 33*a*, the third temperature sensor 33*b*, the third temperature sensor 33*c*, and the third temperature sensor 33*d* from the lower side of the paper.

The four fourth second temperature sensors 34 (fourth temperature sensors 34*a* to 34*d*) are disposed on the outlet side of the heat medium channel of the use-side heat exchanger 26 and detect the temperature of the heat medium flowing out of the use-side heat exchanger 26, and the sensor is preferably composed of a thermistor or the like. The fourth temperature sensors 34 are disposed in number (here, four) according to the installed number of the indoor units 2. In accordance with the indoor units 2, they are shown as the fourth temperature sensor 34*a*, the fourth temperature sensor 34*b*, the fourth temperature sensor 34*c*, and the fourth temperature sensor 34*d* from the lower side in the figure.

The fifth temperature sensor 35 is disposed on the outlet side of the heat-source side refrigerant channel of the first intermediate heat exchanger 15*a* and detects the temperature of the heat-source side refrigerant flowing out of the first intermediate heat exchanger 15*a*, and the sensor is preferably composed of a thermistor or the like. The first pressure sensor 36 is disposed on the outlet side of the heat-source side refrigerant channel of the first intermediate heat exchanger 15*a* and detects a pressure of the heat-source side refrigerant flowing out of the first intermediate heat exchanger 15*a*.

The sixth temperature sensor 37 is disposed on the inlet side of the heat-source side refrigerant channel of the second intermediate heat exchanger 15*b* and detects the temperature of the heat-source side refrigerant flowing into the second intermediate heat exchanger 15*b*, and the sensor is preferably composed of a thermistor or the like. The seventh temperature sensor 38 is disposed on the outlet side of the heat-source side refrigerant channel of the second intermediate heat exchanger 15*b* and detects a temperature of the heat-source side refrigerant flowing out of the second intermediate heat exchanger 15*b*, and the sensor is preferably composed of a thermistor or the like.

The pipeline 5 through which the heat medium is conducted is composed of a pipeline connected to the first intermediate heat exchanger 15*a* (hereinafter referred to as a pipeline 5*a*) and a pipeline connected to the first intermediate heat exchanger 15*b* (hereinafter referred to as a pipeline 5*b*). The pipeline 5*a* and the pipeline 5*b* are branched in accordance with the number (here, branched to four each) of the indoor units 2 connected to the relay unit 3. And the pipeline 5*a* and the pipeline 5*b* are connected by the channel switching valve 22, the channel switching valve 23, and the flow regulating valve 25. By controlling the channel switching valve 22 and the channel switching valve 23, it is determined whether the heat medium conducted through the pipeline 5*a* is made to flow into the use-side heat exchanger 26 or the heat medium conducted through the pipeline 5*b* is made to flow into the use-side heat exchanger 26.

As shown in FIG. 3, the first relay unit 3*a* and the second relay unit 3*b* are covered by sheet metal. As a result, the heat-source side refrigerant is prevented from leaking to the outside from the first relay unit 3*a* and the second relay unit 3*b*. Housings of the first relay unit 3*a* and the second relay unit 3*b* may be formed by sheet metal, or the housings of the first relay unit 3*a* and the second relay unit 3*b* may be covered by sheet metal. Also, the type, the thickness, the shape and the like of the sheet metal are not particularly limited.

In this air-conditioning apparatus 100, the compressor 10, the four-way valve 11, the heat-source side heat exchanger 12, the first intermediate heat exchanger 15*a*, and the second intermediate heat exchanger 15*b* are connected by the refrigerant pipeline 4 in series in the order so as to constitute a refrigeration cycle. Also, the first intermediate heat exchanger 15*a*, the first pump 21*a*, and the use-side heat exchanger 26 are connected by the pipeline 5*a* in series in the order so as to constitute a heat medium circulation circuit. Similarly, the second intermediate heat exchanger 15*b*, the second pump 21*b*, and the use-side heat exchanger 26 are connected by the pipeline 5*b* in series in the order so as to constitute a heat medium circulation circuit. That is, a plurality of use-side heat exchangers 26 are connected in parallel to each of the intermediate heat exchangers 15 so as to form plural systems of the heat medium circulation circuits.

That is, in the air-conditioning apparatus 100, the heat source device 1 and the relay unit 3 are connected to each other through the first intermediate heat exchanger 15*a* and the second intermediate heat exchanger 15*b* disposed in the relay unit 3. And the relay unit 3 and the indoor units 2 are connected by the first intermediate heat exchanger 15*a* and the second intermediate heat exchanger 15*b* so that the heat-source side refrigerant, which is the priory-side refrigerant circulating through the refrigeration cycle in the first intermediate heat exchanger 15*a* and the second intermediate heat exchanger 15*b*, and the heat medium, which is the secondary-side refrigerant circulating through the heat medium circulation circuit exchange heat with each other.

Here, the type of the refrigerant used in the refrigeration cycle and the heat medium circulation circuit will be described. For the refrigeration cycle, a natural refrigerant such as carbon dioxide, hydrocarbon and the like or a refrigerant of a smaller global warming coefficient than the fluorocarbon refrigerant is used. The refrigerant of a smaller global warming coefficient than the fluorocarbon refrigerant includes a nonazeotropic refrigerant mixture such as R407C, a pseudo azeotropic refrigerant such as R410A, a single refrigerant such as R22 and the like. By using the natural refrigerant as the heat-source side refrigerant, such an effect can be obtained that a global warming effect caused by leakage of the refrigerant can be suppressed. Particularly, since carbon dioxide exchanges heat without being condensed in a supercritical state on the high pressure side, by setting the heat-source side refrigerant and the heat medium in a counter flow in the first intermediate heat exchanger 15*a* and the second intermediate heat exchanger 15*b* as shown in FIG. 2, heat exchange performance when the heat medium is heated can be improved.

The heat medium circulation circuit is connected to the use-side heat exchanger 26 of the indoor unit 2 as described above. This, in the air-conditioning apparatus 100, considering the case of leakage of the heat medium into a room where the indoor unit 2 is installed or the like, use of the heat medium with high safety is premised. Therefore, for the heat medium, water, an anti-freezing solution, a mixed liquid of water and the anti-freezing solution and the like can be used, for example. According to this configuration, refrigerant leakage caused by freezing or corrosion can be suppressed even at a low outside temperature, and high reliability can be obtained. Also, if the indoor unit 2 is installed in a place where water is disliked such as a computer room, a fluorine inactive liquid with high insulation can be used as the heat medium.

Here, each operation mode executed by the air-conditioning apparatus 100 will be described.

The air-conditioning apparatus 100 is, on the basis of an instruction from each indoor unit 2, capable of performing the cooling operation or the heating operation with the indoor unit 2. That is, the air-conditioning apparatus 100 can perform the same operation with all the indoor units 2 or can perform different operations with each of the indoor units 2. Four operation modes executed by the air-conditioning apparatus 100, that is, cooling only operation mode in which all the driving indoor units 2 perform the cooling operation, heating only operation mode in which all the driving indoor units 2 perform the heating operation, a cooling-main operation mode in which a cooling load is larger, and a heating-main operation mode in which a heating load is larger will be described below with the flow of the refrigerant.

[Cooling Only Operation Mode]

Figure 4:
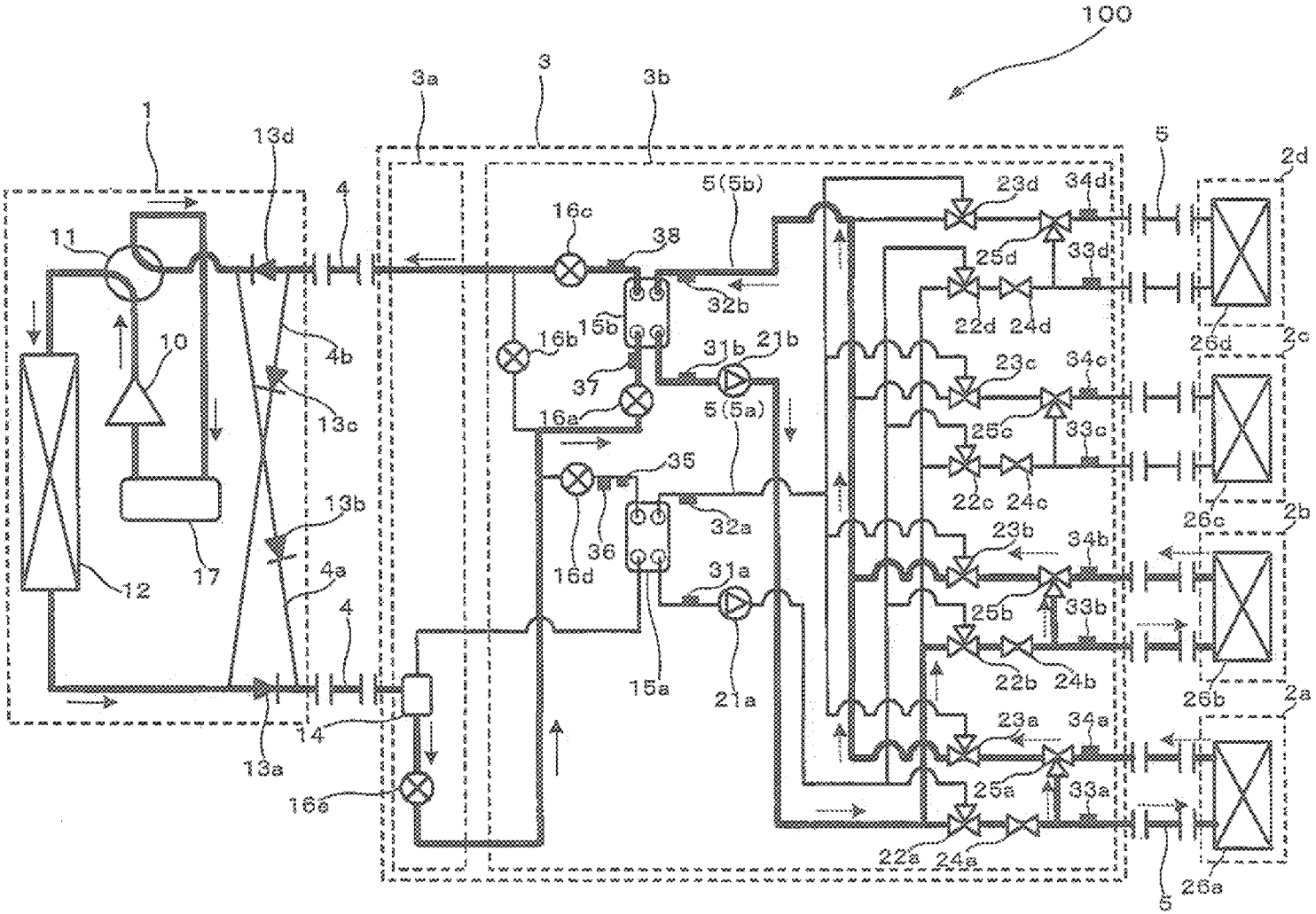
FIG. 4 is a refrigerant circuit diagram illustrating the flow of a refrigerant in a cooling only operation mode of the air-conditioning apparatus.

FIG. 4 is a refrigerant circuit diagram illustrating the flow of the refrigerant in the cooling only operation mode of the air-conditioning apparatus 100. In FIG. 4, the cooling only operation mode will be described using the case in which a cooling load is generated only in the use-side heat exchanger

26*a* and the use-side heat exchanger 26*b* as an example. That is, in FIG. 4, the case in which the cooling load is not generated in the use-side heat exchanger 26*c* and the use-side heat exchanger 26*d* is shown. In FIG. 4, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the cooling only operation mode shown in FIG. 4, in the heat source device 1, the four-way valve 11 is switched so that the heat-source side refrigerant discharged from the compressor 10 flows into the heat-source side heat exchanger 12. In the relay unit 3, the first pump 21*a* is stopped, the second pump 21*b* is driven, the stop valve 24*a* and the stop valve 24*b* are opened, and the stop valve 24*c* and the stop valve 24*d* are closed so that the heat medium circulates between the second intermediate heat exchanger 15*b* and each use-side heat exchanger 26 (the use-side heat exchanger 26*a* and the use-side heat exchanger 26*b*). In this state, the operation of the compressor 10 is started.

First, the flow of the heat-source side refrigerant in the refrigeration cycle will be described. A low-temperature and low-pressure refrigerant is compressed by the compressor 10, becomes a high-temperature and high-pressure gas refrigerant and is discharged. The high-temperature and high-pressure gas refrigerant discharged from the compressor 10 passes through the four-way valve 11 and flows into the heat-source side heat exchanger 12. Then, the refrigerant is condensed and liquefied while radiating heat to the outdoor air in the heat-source side heat exchanger 12 and becomes a high-pressure liquid refrigerant. The high-pressure liquid refrigerant having flowed out of the heat-source side heat exchanger 12 passes through the check valve 13*a* and flows out of the heat source device 1 and flows into the first relay unit 3*a* through the refrigerant pipeline 4. The high-pressure liquid refrigerant having flowed into the first relay unit 3*a* flows into the gas-liquid separator 14 and then, passes through the expansion valve 16*e* and flows into the second relay unit 3*b*.

The refrigerant having flowed into the second relay unit 3*b* is throttled by the expansion valve 16*a* and expanded and becomes a low-temperature and low-pressure gas-liquid two-phase refrigerant. This gas-liquid two-phase refrigerant flows into the second intermediate heat exchanger 15*b* working as an evaporator, and while absorbing heat from the heat medium circulating in the heat medium circulation circuit so as to cool the heat medium, it becomes the low-temperature and low-pressure gas refrigerant. The gas refrigerant having flowed out of the second intermediate heat exchanger 15*b* passes through the expansion valve 16*c*, flows out of the second relay unit 3*b* and the first relay unit 3*a* and flows into the heat source device 1 through the refrigerant pipeline 4. The refrigerant having flowed into the heat source device 1 passes through the check valve 13*d* and is sucked into the compressor 10 again through the four-way valve 11 and the accumulator 17. The expansion valve 16*b* and the expansion valve 16*d* have small opening degrees so that the refrigerant does not flow therethrough, while the expansion valve 16*c* is in the fully open state so that a pressure loss does not occur.

Subsequently, the flow of the heat medium in the heat medium circulation circuit will be described.

In the cooling only operation mode, since the first pump 21*a* is stopped, the heat medium circulates through the pipeline 5*b*. The heat medium having been cooled by the heat-source side refrigerant in the second intermediate heat exchanger 15*b* is fluidized in the pipeline 5*b* by the second pump 21*b*. The heat medium having been pressurized and flowed out by the second pump 21*b* passes through the stop valve 24 (the stop valve 24*a* and the stop valve 24*b*) through the channel switching valve 22 (the channel switching valve 22*a* and the channel switching valve 22*b*) and flows into each use-side heat exchanger 26 (the use-side heat exchanger 26*a* and the use-side heat exchanger 26*b*). Then, the refrigerant absorbs heat from the indoor air in the use-side heat exchanger 26 and cools the region to be air-conditioned such as the inside of the room where the indoor unit 2 is installed.

After that, the heat medium having flowed out of use-side heat exchanger 26 flows into the flow regulating valve 25 (the flow regulating valve 25*a* and the flow regulating valve 25*b*). At this time, by means of the action of the flow regulating valve 25, the heat medium only in a flow amount required to cover an air-conditioning load required in the region to be air-conditioned such as the inside of the room flows into the use-side heat exchanger 26, while the remaining heat medium flows so as to bypass the use-side heat exchanger 26 through the bypass 27 (the bypass 27*a* and the bypass 27*b*).

The heat medium passing through the bypass 27 does not contribute to the heat exchange but merges with the heat medium having passed through the use-side heat exchanger 26, passes through the channel switching valve 23 (the channel switching valve 23*a* and the channel switching valve 23*b*), flows into the second intermediate heat exchanger 15*b* and is sucked into the second pump 21*b* again. The air-conditioning load required in the region to be air-conditioned such as the inside of the room can be covered by means of control such that a temperature difference between the third temperature sensor 33 and the fourth temperature sensor 34 is kept at a target value.

At this time, since there is no need to make the heat medium flow into the use-side heat exchanger 26 (including thermo off) not having a air-conditioning load, the channel is closed by the stop valve 24 so that the heat medium does not flow into the use-side heat exchanger 26. In FIG. 4, since there is a air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding stop valve 24*c* and the stop valve 24*d* are in the closed state. In the case of occurrence of a cooling load from the use-side heat exchanger 26*c* or the use-side heat exchanger 26*d*, it is only necessary to open the stop valve 24*c* or the stop valve 24*d* so that the heat medium is circulated.

[Heating Only Operation Mode]

Figure 5:
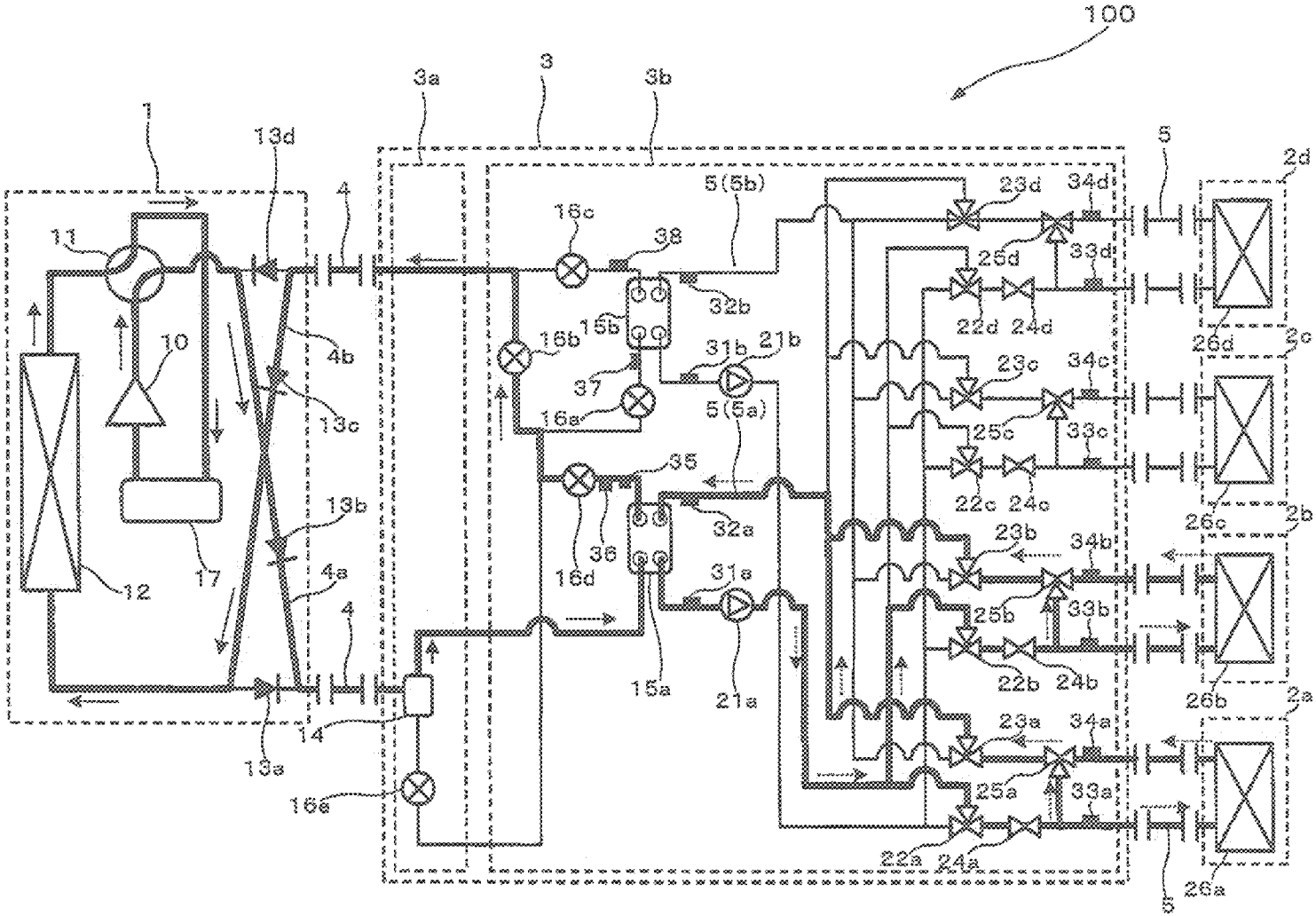
FIG. 5 is the refrigerant circuit diagram illustrating the flow of the refrigerant in heating only operation mode of the air-conditioning apparatus.

FIG. 5 is a refrigerant circuit diagram illustrating the flow of the refrigerant in the heating only operation mode of the air-conditioning apparatus 100. In FIG. 5, the heating only operation mode will be described using the case in which a heating load is generated only in the use-side heat exchanger 26*a* and the use-side heat exchanger 26*b* as an example. That is, in FIG. 5, the case in which the heating load is not generated in the use-side heat exchanger 26*c* and the use-side heat exchanger 26*d* is shown. In FIG. 5, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the heating only operation mode shown in FIG. 5, in the heat source device 1, the four-way valve 11 is switched so that the heat-source side refrigerant discharged from the compressor 10 flows into the relay unit 3 without going through the heat-source side heat exchanger 12. In the relay unit 3, the first pump 21*a* is driven, the second pump 21*b* is stopped, the stop valve 24*a* and the stop valve 24*b* are opened, and the stop valve 24*c* and the stop valve 24*d* are closed so that the heat medium circulates between the first intermediate heat exchanger 15*a* and each use-side heat exchanger 26 (the use-side heat exchanger 26*a* and the use-side heat exchanger 26*b*). In this state, the operation of the compressor 10 is started.

First, the flow of the heat-source side refrigerant in the refrigeration cycle will be described.

A low-temperature and low-pressure refrigerant is compressed by the compressor 10, becomes a high-temperature and high-pressure gas refrigerant and is discharged. The high-temperature and high-pressure gas refrigerant discharged from the compressor 10 passes through the four-way valve 11, is conducted through the first connection pipeline 4*a*, passes through the check valve 13*b* and flows out of the heat source device 1. The high-temperature and high-pressure gas refrigerant having flowed out of the heat source device 1 flows into the first relay unit 3*a* through the refrigerant pipeline 4. The high-temperature and high-pressure gas refrigerant having flowed into the first relay unit 3*a* flows into the gas-liquid separator 14 and then, flows into the first intermediate heat exchanger 15*a*. The high-temperature and high-pressure gas refrigerant having flowed into the first intermediate heat exchanger 15*a* is condensed and liquefied while radiating heat to the heat medium circulating through the heat medium circulation circuit and becomes a high-pressure liquid refrigerant.

The high-pressure liquid refrigerant having flowed out of the first intermediate heat exchanger 15*a* is throttled by the expansion valve 16*d* and expanded and brought into a low-temperature and low-pressure gas-liquid two-phase state. The refrigerant in the gas-liquid two-phase state having been throttled by the expansion valve 16*d* passes through the expansion valve 16*b*, is conducted through the refrigerant pipeline 4 and flows into the heat source device 1 again. The refrigerant having flowed into the heat source device 1 passes through the second connection pipeline 4*b* through the check valve 13*c* and flows into the heat-source side heat exchanger 12 working as an evaporator. Then, the refrigerant having flowed into the heat-source side heat exchanger 12 absorbs heat from the outdoor air in the heat-source side heat exchanger 12 so as to become a low-temperature and low-pressure gas refrigerant. The low-temperature and low-pressure gas refrigerant having flowed out of the heat-source side heat exchanger 12 returns to the compressor 10 through the four-way valve 11 and the accumulator 17. The expansion valve 16*a*, the expansion valve 16*c*, and the expansion valve 16*e* have small opening degrees so that the refrigerant does not flow therethrough.

Subsequently, the flow of the heat medium in the heat medium circulation circuit will be described.

In the heating only operation mode, since the second pump 21*b* is stopped, the heat medium circulates through the pipeline 5*a*. The heat medium having been heated by the heat-source side refrigerant in the first intermediate heat exchanger 15*a* is fluidized in the pipeline 5*a* by the first pump 21*a*. The heat medium having been pressurized and flowed out by the first pump 21*a* passes through the stop valve 24 (the stop valve 24*a* and the stop valve 24*b*) through the channel switching valve 22 (the channel switching valve 22*a* and the channel switching valve 22*b*) and flows into the use-side heat exchanger 26 (the use-side heat exchanger 26*a* and the use-side heat exchanger 26*b*). Then, the heat medium gives heat to the indoor air in the use-side heat exchanger 26 and heats the region to be air-conditioned such as the inside of the room where the indoor unit 2 is installed.

After that, the heat medium having flowed out of the use-side heat exchanger 26 flows into the flow regulating valve 25 (the flow regulating valve 25*a* and the flow regulating valve 25*b*). At this time, by means of the action of the flow regulating valve 25, the heat medium only in a flow rate required to cover an air-conditioning load required in the region to be air-conditioned such as the inside of the room flows into the use-side heat exchanger 26, while the remaining heat medium flows so as to bypass the use-side heat exchanger 26 through the bypass 27 (the bypass 27*a* and the bypass 27*b*).

The heat medium passing through the bypass 27 does not contribute to the heat exchange but merges with the heat medium having passed through the use-side heat exchanger 26, passes through the channel switching valve 23 (the channel switching valve 23*a* and the channel switching valve 23*b*), flows into the first intermediate heat exchanger 15*a* and is sucked into the first pump 21*a* again. The air-conditioning load required in the region to be air-conditioned such as the inside of the room can be covered by means of control such that a temperature difference between the third temperature sensor 33 and the fourth temperature sensor 34 is kept at a target value.

At this time, since there is no need to make the heat medium flow into the use-side heat exchanger 26 (including thermo off) not having a air-conditioning load, the channel is closed by the stop valve 24 so that the heat medium does not flow into the use-side heat exchanger 26. In FIG. 5, since there is a air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding stop valve 24*c* and the stop valve 24*d* are in the closed state. In the case of occurrence of a heating load from the use-side heat exchanger 26*c* or the use-side heat exchanger 26*d*, it is only necessary to open the stop valve 24*c* or the stop valve 24*d* so that the heat medium is circulated.

[Cooling-Main Operation Mode]

Figure 6:
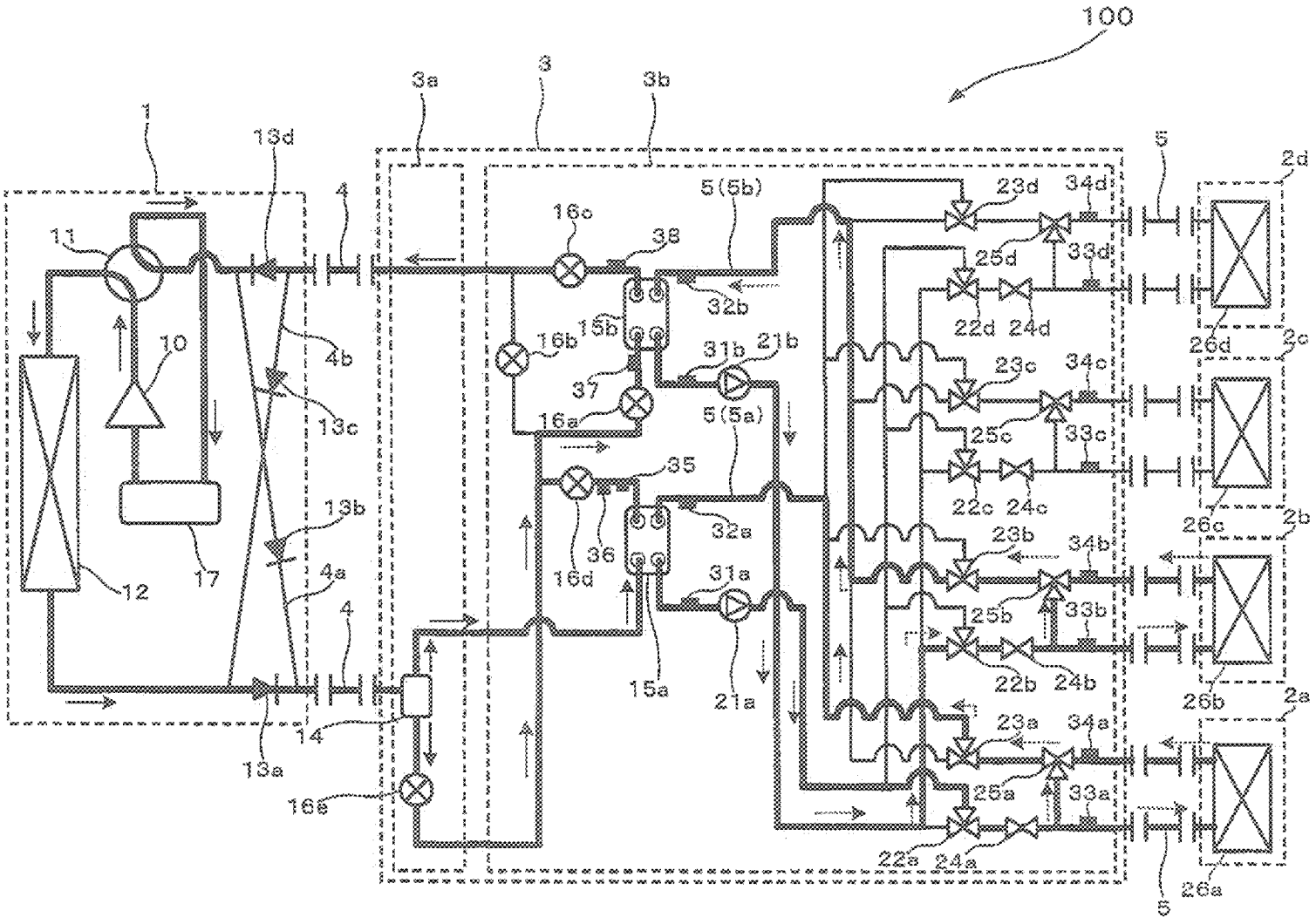
FIG. 6 is the refrigerant circuit diagram illustrating the flow of the refrigerant in a cooling main operation mode of the air-conditioning apparatus.

FIG. 6 is a refrigerant circuit diagram illustrating the flow of the refrigerant during the cooling-main operation mode of the air-conditioning apparatus 100. In FIG. 6, using a case in which a heating load is generated in the use-side heat exchanger 26*a* and a cooling load is generated in the use-side heat exchanger 26*b* as an example, the cooling-main operation mode will be described. That is, in FIG. 6, the case in which neither of the heating load nor the cooling load is generated in the use-side heat exchanger 26*c* and the use-side heat exchanger 26*d* is shown. In FIG. 6, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the cooling-main operation mode shown in FIG. 6, in the heat source device 1, the four-way valve 11 is switched so that the heat-source side refrigerant discharged from the compressor 10 flows into the heat-source side heat exchanger 12. In the relay unit 3, the first pump 21*a* and the second pump 21*b* are driven, the stop valve 24*a* and the stop valve 24*b* are opened, the stop valve 24*c* and the stop valve 24*d* are closed, and the heat medium is made to circulate between the first intermediate heat exchanger 15*a* and the use-side heat exchanger 26*a* as well as the second intermediate heat exchanger 15*b* and the use-side heat exchanger 26*b*. In this state, the operation of the compressor 10 is started.

First, the flow of the heat-source side refrigerant in the refrigeration cycle will be described.

The low-temperature and low-pressure refrigerant is compressed by the compressor 10 and discharged as the high-temperature and high-pressure gas refrigerant. The high-temperature and high-pressure gas refrigerant discharged from the compressor 10 passes through the four-way valve 11 and flows into the heat-source side heat exchanger 12. Then, the refrigerant is condensed while radiating heat to the outdoor air in the heat-source side heat exchanger 12 and becomes a gas-liquid two-phase refrigerant. The gas-liquid two-phase refrigerant having flowed out of the heat-source side heat exchanger 12 flows out of the heat source device 1 through the check valve 13*a* and flows into the first relay unit 3*a* through the refrigerant pipeline 4. The gas-liquid two-phase refrigerant having flowed into the first relay unit 3*a* flows into the gas-liquid separator 14 and is separated to a gas refrigerant and a liquid refrigerant, which flow into the second relay unit 3*b*.

The gas refrigerant having been separated in the gas-liquid separator 14 flows into the first intermediate heat exchanger 15*a*. The gas refrigerant having flowed into the first intermediate heat exchanger 15*a* is condensed and liquefied while radiating heat to the heat medium circulating through the heat medium circulation circuit and becomes a liquid refrigerant. The liquid refrigerant having flowed out of the first intermediate heat exchanger 15*a* passes through the expansion valve 16*d*. On the other hand, the liquid refrigerant separated in the gas-liquid separator 14 passes through the expansion valve 16*e*, merges with the liquid refrigerant condensed and liquefied in the first intermediate heat exchanger 15*a* and passed through the expansion valve 16*d*, is throttled by the expansion valve 16*a* and expanded and flows into the second intermediate heat exchanger 15*b* as the low-temperature and low-pressure gas-liquid two-phase refrigerant.

This gas-liquid two-phase refrigerant absorbs heat from the heat medium circulating through the heat medium circulation circuit in the second intermediate heat exchanger 15*b* working as an evaporator so as to cool the heat medium and becomes a low-temperature and low-pressure gas refrigerant. The gas refrigerant having flowed out of the second intermediate heat exchanger 15*b* passes through the expansion valve 16*c* and then, flows out of the second relay unit 3*b* and the first relay unit 3*a* and flows into the heat source device 1 through the refrigerant pipeline 4. The refrigerant having flowed into the heat source device 1 passes through the check valve 13*d* and is sucked into the compressor 10 again through the four-way valve 11 and the accumulator 17. The expansion valve 16*b* has a small opening degree so that the refrigerant does not flow therethrough, and the expansion valve 16*c* is in the full open state so that a pressure loss does not occur.

Subsequently, the flow of the heat medium in the heat medium circulation circuit will be described.

In the cooling-main operation mode, since the first pump 21*a* and the second pump 21*b* are both driven, the heat medium is circulated through both the pipeline 5*a* and the pipeline 5*b*. The heat medium heated by the heat-source side refrigerant in the first intermediate heat exchanger 15*a* is fluidized in the pipeline 5*a* by the first pump 21*a*. Also, the heat medium cooled by the heat-source side refrigerant in the second intermediate heat exchanger 15*b* is fluidized in the pipeline 5*b* by the second pump 21*b*.

The heat medium having been pressurized and flowed out by the first pump 21*a* passes through the stop valve 24*a* through the channel switching valve 22*a* and flows into the use-side heat exchanger 26*a*. Then, in the use-side heat exchanger 26*a*, the heat medium gives heat to the indoor air and heats the region to be air-conditioned such as the inside of the room where the indoor unit 2 is installed. Also, the heat medium having been pressurized and flowed out by the second pump 21*b* passes through the stop valve 24*b* through the channel switching valve 22*b* and flows into the use-side heat exchanger 26*b*. Then, in the use-side heat exchanger 26*b*, the heat medium absorbs heat from the indoor air and cools the region to be air-conditioned such as the inside of the room where the indoor unit 2 is installed.

The heat medium having performed heating flows into the flow regulating valve 25*a*. At this time, by means of the action of the flow regulating valve 25*a*, the heat medium only in a flow rate required to cover an air-conditioning load required in the region to be air-conditioned flows into the use-side heat exchanger 26*a*, while the remaining heat medium flows so as to bypass the use-side heat exchanger 26*a* through the bypass 27*a*. The heat medium passing through the bypass 27*a* does not contribute to heat exchange but merges with the heat medium having passed through the use-side heat exchanger 26*a*, flows into the first intermediate heat exchanger 15*a* through the channel switching valve 23*a* and is sucked into the first pump 21*a* again.

Similarly, the heat medium having performed cooling flows into the flow regulating valve 25*b*. At this time, by means of the action of the flow regulating valve 25*b*, the heat medium only in a flow rate required to cover an air-conditioning load required in the region to be air-conditioned flows into the use-side heat exchanger 26*b*, while the remaining heat medium flows so as to bypass the use-side heat exchanger 26*b* through the bypass 27*b*. The heat medium passing through the bypass 27*b* does not contribute to heat exchange but merges with the heat medium having passed through the use-side heat exchanger 26*b*, flaws into the second intermediate heat exchanger 15*b* through the channel switching valve 23*b* and is sucked into the second pump 21*b* again.

During that period, the heated heat medium (the heat medium used for the heating load) and the cooled heat medium (the heat medium used for the cooling load) flow into the use-side heat exchanger 26*a* having the heating load or the use-side heat exchanger 26*b* having the cooling load without mixing by means of the actions of the channel switching valve 22 (the channel switching valve 22*a* and the channel switching valve 22*b*) and the channel switching valve 23 (the channel switching valve 23*a* and the channel switching valve 23*b*). The air-conditioning load required in the region to be air-conditioned such as the inside of the room can be covered by executing control such that a difference in temperatures between the third temperature sensor 33 and the fourth temperature sensor 34 is kept at a target value.

At this time, since there is no need to make the heat medium flow into the use-side heat exchanger 26 (including thermo off) not having a air-conditioning load, the channel is closed by the stop valve 24 so that the heat medium does not flow into the use-side heat exchanger 26. In FIG. 6, since there is a air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding stop valve 24*c* and the stop valve 24*d* are in the closed state. In the case of occurrence of a heating load or occurrence of a cooling load from the use-side heat exchanger 26*c* or the use-side heat exchanger 26*d*, it is only necessary to open the stop valve 24*c* or the stop valve 24*d* so that the heat medium is circulated.

[Heating-Main Operation Mode]

Figure 7:
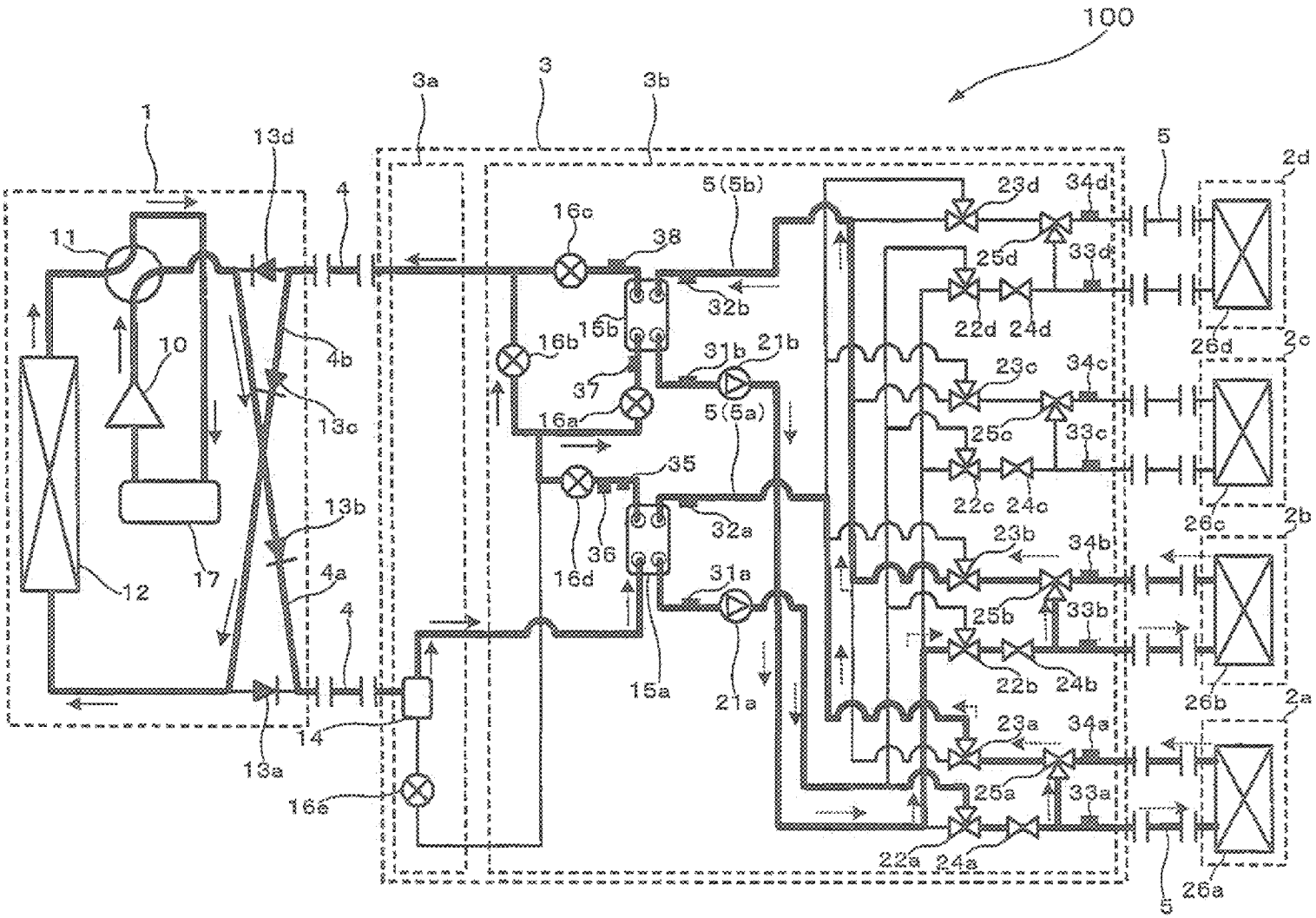
FIG. 7 is the refrigerant circuit diagram illustrating the flow of the refrigerant in a heating main operation mode of the air-conditioning apparatus.

FIG. 7 is a refrigerant circuit diagram illustrating the flow of the refrigerant during the heating-main operation mode of the air-conditioning apparatus 100. In FIG. 7, using a case in which a heating load is generated in the use-side heat exchanger 26*a* and a cooling load is generated in the use-side heat exchanger 26*b* as an example, the heating-main operation mode will be described. That is, in FIG. 7, the case in which neither of the heating load nor the cooling load is generated in the use-side heat exchanger 26*c* and the use-side heat exchanger 26*d* is shown. In FIG. 7, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the heating-main operation mode shown in FIG. 7, in the heat source device 1, the four-way valve 11 is switched so that the heat-source side refrigerant discharged from the compressor 10 flows into the relay unit 3 without passing through the heat-source side heat exchanger 12. In the relay unit 3, the first pump 21*a* and the second pump 21*b* are driven, the stop valve 24*a* and the stop valve 24*b* are opened, the stop valve 24*c* and the stop valve 24*d* are closed, and the heat medium is made to circulate between the first intermediate heat exchanger 15*a* and the use-side heat exchanger 26*a* as well as the second intermediate heat exchanger 15*b* and the use-side heat exchanger 26*b*. In this state, the operation of the compressor 10 is started.

First, the flow of the heat-source side refrigerant in the refrigeration cycle will be described.

The low-temperature and low-pressure refrigerant is compressed by the compressor 10 and becomes a high-temperature and high-pressure gas refrigerant and is discharged. The high-temperature and high-pressure gas refrigerant discharged from the compressor 10 passes through the four-way valve 11, is conducted through the first connection pipeline 4*a*, passes through the check valve 13*b* and flows out of the heat source device 1. The high-temperature and high-pressure gas refrigerant having flowed out of the heat source device 1 flows into the gas-liquid separator 14 and then, flows into the first intermediate heat exchanger 15*a*. The high-temperature and high-pressure gas refrigerant having flowed into the first intermediate heat exchanger 15*a* is condensed and liquefied while radiating heat to the heat medium circulating through the heat medium circulation circuit and becomes a high-pressure liquid refrigerant.

The high-pressure liquid refrigerant having flowed out of the first intermediate heat exchanger 15*a* is throttled by the expansion valve 16*d* and expanded and brought into a low-temperature and low-pressure gas-liquid two-phase state. The refrigerant in the gas-liquid two-phase state having been throttled by the expansion valve 16*d* is divided to a channel through the expansion valve 16*a* and a channel through the expansion valve 16*b*. The refrigerant having passed through the expansion valve 16*a* is further expanded by this expansion valve 16*a* and becomes a low-temperature and low-pressure gas-liquid two-phase refrigerant and flows into the second intermediate heat exchanger 15*b* working as an evaporator. The refrigerant having flowed into the second intermediate heat exchanger 15*b* absorbs heat from the heat medium in the second intermediate heat exchanger 15*b* and becomes a low-temperature and low-pressure gas refrigerant. The low-temperature and low-pressure gas refrigerant having flowed out of the second intermediate heat exchanger 15*b* passes through the expansion valve 16*c*.

On the other hand, the refrigerant having been throttled by the expansion valve 16*d* and flowed to the expansion valve 16*b* merges with the refrigerant having passed through the second intermediate heat exchanger 15*b* and the expansion valve 16*c* and becomes a low-temperature and low-pressure refrigerant with larger quality. Then, the merged refrigerant flows out of the second relay unit 3*b* and the first relay unit 3*a* and flows into the heat source device 1 through the refrigerant pipeline 4. The refrigerant having flowed into the heat source device 1 passes through the second connection pipeline 4*b* through the check valve 13*c* and flows into the heat-source side heat exchanger 12 working as an evaporator. The refrigerant having flowed into the heat-source side heat exchanger 12 absorbs heat from the outdoor air in the heat-source side heat exchanger 12 and becomes a low-temperature and low-pressure gas refrigerant. The low-temperature and low-pressure gas refrigerant having flowed out of the heat-source side heat exchanger 12 returns to the compressor 10 through the four-way valve 11 and the accumulator 17. The expansion valve 16*e* has a small opening degree so that the refrigerant does not flow therethrough.

Subsequently, the flow of the heat medium in the heat medium circulation circuit will be described.

In the heating-main operation mode, since the first pump 21*a* and the second pump 21*b* are both driven, the heat medium is circulated through both the pipeline 5*a* and the pipeline 5*b*. The heat medium heated by the heat-source side refrigerant in the first intermediate heat exchanger 15*a* is fluidized in the pipeline 5*a* by the first pump 21*a*. Also, the heat medium cooled by the heat-source side refrigerant in the second intermediate heat exchanger 15*b* is fluidized in the pipeline 5*b* by the second pump 21*b*.

The heat medium having been pressurized and flowed out by the first pump 21*a* passes through the stop valve 24*a* through the channel switching valve 22*a* and flows into the use-side heat exchanger 26*a*. Then, in the use-side heat exchanger 26*a*, the heat medium gives heat to the indoor air and heats the region to be air-conditioned such as the inside of the room where the indoor unit 2 is installed. Also, the heat medium having been pressurized and flowed out by the second pump 21*b* passes through the stop valve 24*b* through the channel switching valve 22*b* and flows into the use-side heat exchanger 26*b*. Then, in the use-side heat exchanger 26*b*, the heat medium absorbs heat from the indoor air and cools the region to be air-conditioned such as the inside of the room where the indoor unit 2 is installed.

The heat medium having flowed out of the use-side heat exchanger 26*a* flows into the flow regulating valve 25*a*. At this time, by means of the action of the flow regulating valve 25*a*, the heat medium only in a flow rate required to cover an air-conditioning load required in the region to be air-conditioned such as the inside of a room flows into the use-side heat exchanger 26*a*, while the remaining heat medium flows so as to bypass the use-side heat exchanger 26*a* through the bypass 27*a*. The heat medium passing through the bypass 27*a* does not contribute to heat exchange but merges with the heat medium having passed through the use-side heat exchanger 26*a*, flows into the first intermediate heat exchanger 15*a* through the channel switching valve 23*a* and is sucked into the first pump 21*a* again.

Similarly, the heat medium having flowed out of the use-side heat exchanger 26*b* flows into the flow regulating valve 25*b*. At this time, by means of the action of the flow regulating valve 25*b*, the heat medium only in a flow rate required to cover an air-conditioning load required in the region to be air-conditioned such as the inside of a room flows into the use-side heat exchanger 26*b*, while the remaining heat medium flows so as to bypass the use-side heat exchanger 26*b* through the bypass 27*b*. The heat medium passing through the bypass 27*b* does not contribute to heat exchange but merges with the heat medium having passed through the use-side heat exchanger 26*b*, flows into the second intermediate heat exchanger 15*b* through the channel switching valve 23*b* and is sucked into the second pump 21*b* again.

During that period, the heated heat medium and the cooled heat medium flow into the use-side heat exchanger 26*a* having the heating load or the use-side heat exchanger 26*b* having the cooling load without mixing by means of the actions of the channel switching valve 22 (the channel switching valve 22*a* and the channel switching valve 22*b*) and the channel switching valve 23 (the channel switching valve 23*a* and the channel switching valve 23*b*). The air-conditioning load required in the region to be air-conditioned such as the inside of the room can be covered by executing control such that a difference in temperatures between the third temperature sensor 33 and the fourth temperature sensor 34 is kept at a target value.

At this time, since there is no need to make the heat medium flow into the use-side heat exchanger 26 (including thermo off) not having a air-conditioning load, the channel is closed by the stop valve 24 so that the heat medium does not flow into the use-side heat exchanger 26. In FIG. 7, since there is a air-conditioning load in the use-side heat exchanger 26*a* and the use-side heat exchanger 26*b*, the heat medium is made to flow, but there is no air-conditioning load in the use-side heat exchanger 26*c* and the use-side heat exchanger 26*d*, and the corresponding stop valve 24*c* and the stop valve 24*d* are in the closed state. In the case of occurrence of a heating load or occurrence of a cooling load from the use-side heat exchanger 26*c* or the use-side heat exchanger 26*d*, it is only necessary to open the stop valve 24*c* or the stop valve 24*d* so that the heat medium is circulated.

As described above, since it is configured that the gas-liquid separator 14 is installed in the first relay unit 3*a* so that the gas refrigerant and the liquid refrigerant are separated, the cooling operation and the heating operation can be performed at the same time by connecting the heat source device 1 and the first relay unit 3*a* to each other by the two refrigerant pipelines 4. Also, since cooling energy or heating energy generated in the heat source device 1 can be supplied to the load side through the heat medium by switching and controlling the channel switching valve 22, the channel switching valve 23, the stop valve 24, and the flow regulating valve 25 on the heat medium side, cooling energy or heating energy can be freely supplied to the respective use-side heat exchangers 26 by the two pipelines 5 also on the load side.

Moreover, since the relay units 3 (the first relay unit 3*a* and the second relay unit 3*b*) have housings different from those of the heat source device 1 and the indoor unit 2, they can be installed at different positions, and by installing the first relay unit 3*a* and the second relay unit 3*b* in the non-living space 50 as shown in FIG. 1, the heat-source side refrigerant and the heat medium can be shut off, and inflow of the heat-source side refrigerant into the living space 7 can be suppressed, whereby safety and reliability of the air-conditioning apparatus 100 are improved.

In the first intermediate heat exchanger 15*a* on the heating side, the heat medium temperature at the outlet of the first intermediate heat exchanger 15*a* detected by the first temperature sensor 31*a* does not become higher than the heat medium temperature at the inlet of the first intermediate heat exchanger 15*a* detected by the second temperature sensor 32*a*, and a heating amount in an superheat gas region of the heat-source side refrigerant is small. Thus, the heat medium temperature at the outlet of the first intermediate heat exchanger 15*a* is restricted by a condensing temperature substantially acquired from a saturation temperature of the first pressure sensor 36. Also, in the second intermediate heat exchanger 15*b* on the cooling side, the heat medium temperature at the outlet of the second intermediate heat exchanger 15*b* detected by the first temperature sensor 31*b* does not become lower than the heat medium temperature at the inlet of the second intermediate heat exchanger 15*b* detected by the second temperature sensor 32*b*.

Therefore, in the air-conditioning apparatus 100, it is effective to handle an increase or decrease of a air-conditioning load on the secondary side (use side) by changing a condensing temperature or an evaporating temperature on the refrigeration cycle side. Thus, it is preferable that a control target value of the condensing temperature and/or evaporating temperature of the refrigeration cycle stored in the controller is changed in accordance with the size of the air-conditioning load on the use side. As a result, the change in the size of the air-conditioning load on the use side can be easily followed.

Grasping of the change in the air-conditioning load on the use side is made by a controller 62*b* connected to the second relay unit 3*b*. On the other hand, the control target values of the condensing temperature and the evaporating temperature are stored in the controller 62*c* connected to the heat source device 1 incorporating the compressor 10 and the heat-source side heat exchanger 12. Thus, a signal line is connected between the controller 62*b* connected to the second relay unit 3*b* and the controller 62*c* connected to the heat source device 1, and the target control value of the condensing temperature and/or evaporating temperature is transmitted via communication so as to change the control target value of the condensing temperature and/or evaporating temperature stored in the controller 62*c* connected to the heat source device 1. Alternatively, the control target value may be changed by communicating a deviation value of the control target value.

By executing the above control, the change in the air-conditioning load on the use side can be handled appropriately. That is, if the controller grasps that the air-conditioning load on the use side is lowered, the controller can control the driving frequency of the compressor 10 so as to lower a work load of the compressor 10. Therefore, the air-conditioning apparatus 100 becomes capable of a more energy-saving operation. The controller 62*b* connected to the second relay unit 3*b* and the controller 62*c* connected to the heat source device 1 may be handled by one controller.

In Embodiment 1, explanation was made using the case in which a pseudo azeotropic refrigerant mixture such as R410A, R404A and the like, a nonazeotropic refrigerant mixture such as R407C and the like, a refrigerant whose global warming coefficient value is relatively small such as CF3CF═CH2 containing a double bond in its chemical formula or its mixture or a natural refrigerant such as carbon dioxide, propane and the like can be used as an example, but the refrigerant is not limited to them. Also, in the Embodiment 1, the case in which the accumulator 17 is disposed in the heat source device 1 was described as an example, but the similar operation and the similar effects can be obtained without disposing the accumulator 17.

Also, in general, a blowing device such as a fan is installed in the heat-source side heat exchanger 12 and the use-side heat exchanger 26 so that condensation or evaporation is promoted by blowing in many cases, but not limited thereto. For example, a heat exchanger such as a panel heater using radiation can be used as the use-side heat exchanger 26, while a water-cooling heat exchanger in which heat is moved by water or an anti-freezing solution can be used as the heat-source side heat exchanger 12, and any type of heat exchanger can be used as long as it has a structure capable of heating or cooling.

The case in which the channel switching valve 22, the channel switching valve 23, the stop valve 24, and the flow regulating valve 25 are disposed in accordance with each of the use-side heat exchangers 26 was described as an example, but not limited to that. For example, each of them may be connected in plural to one unit of the use-side heat exchanger 26, and in that case, it is only necessary that the channel switching valve 22, the channel switching valve 23, the stop valve 24, and the flow regulating valve 25 connected to the same use-side heat exchanger 26 are operated in the same way. Also, the case in which the two intermediate heat exchangers 15 are disposed was described as an example, but it is natural that the number of the units is not limited, but three or more may be disposed as long as they are configured so that the heat medium can be cooled and/or heated.

Moreover, the case in which the flow regulating valve 25, the third temperature sensor 33, and the fourth temperature sensor 34 are arranged inside the second relay unit 3*b* was shown, but a part of or all of them may be arranged inside the indoor unit 2. If they are arranged inside the second relay unit 3*b*, the valves, the pumps and the like on the heat medium side can be collected in the same housing, which gives an advantage that maintenance is easy. On the other hand, if they are arranged inside the indoor unit 2, they can be handled similarly to the expansion valve in the prior-art direct expansion indoor unit, which is easy to be handled, and since they are arranged in the vicinity of the use-side heat exchanger 26, it gives an advantage that they are not affected by a heat loss of an extended pipeline and controllability of the air-conditioning load in the indoor unit 2 is better.

As described above, since the air-conditioning apparatus 100 according to the Embodiment 1 is configured such that the heating energy and/or cooling energy in the refrigeration cycle is transferred to the use-side heat exchanger 26 through the plurality of intermediate heat exchangers 15, the outdoor-side housing (heat source device 1) can be installed in the outdoor space 6 on the outdoor side, the indoor-side housing (indoor unit 2) in the living space 7 on the indoor side, and the heat medium conversion housing (relay unit 3) in the non-living space 50, respectively, entry of the heat-source side refrigerant into the living space 7 can be suppressed, and safety and reliability of the system can be improved.

Particularly, with the prior-art chiller system, if both cooling energy and heating energy are to be supplied by water or the like, the number of connected pipelines needs to be increased, which takes labor, time and costs required for an installation work. That is, with the prior-art technology, improvement of safety and reliability at refrigerant leakage and reduction of labor, time and costs required for the installation work cannot be realized at the same time. On the other hand, with this air-conditioning apparatus 100, since the indoor unit 2 is connected to the relay unit 3 with the two pipelines 5 through which water flows, the above defects can be overcome.

Also, since the air-conditioning apparatus 100 is configured such that the heat medium such as water, brine and the like flows through the heat medium circulation circuit, the heat-source side refrigerant volume can be drastically reduced, and an influence on the environment at refrigerant leakage can be drastically lowered. Moreover, in the air-conditioning apparatus 100, by connecting the relay unit 3 to each of the plurality of indoor units 2 by the two heat medium pipelines (pipeline 5), conveyance power of water can be reduced, which can save energy and facilitate the installation work. Still further, in the air-conditioning apparatus 100, by restricting a relation between the relay unit 3 and the indoor unit 2 or a feed-water pressure of water facilities, an expansion tank, not shown, can be made compact, and the size of the relay unit 3 can be reduced in the end, which improves handling.

Embodiment 2

Figure 8:
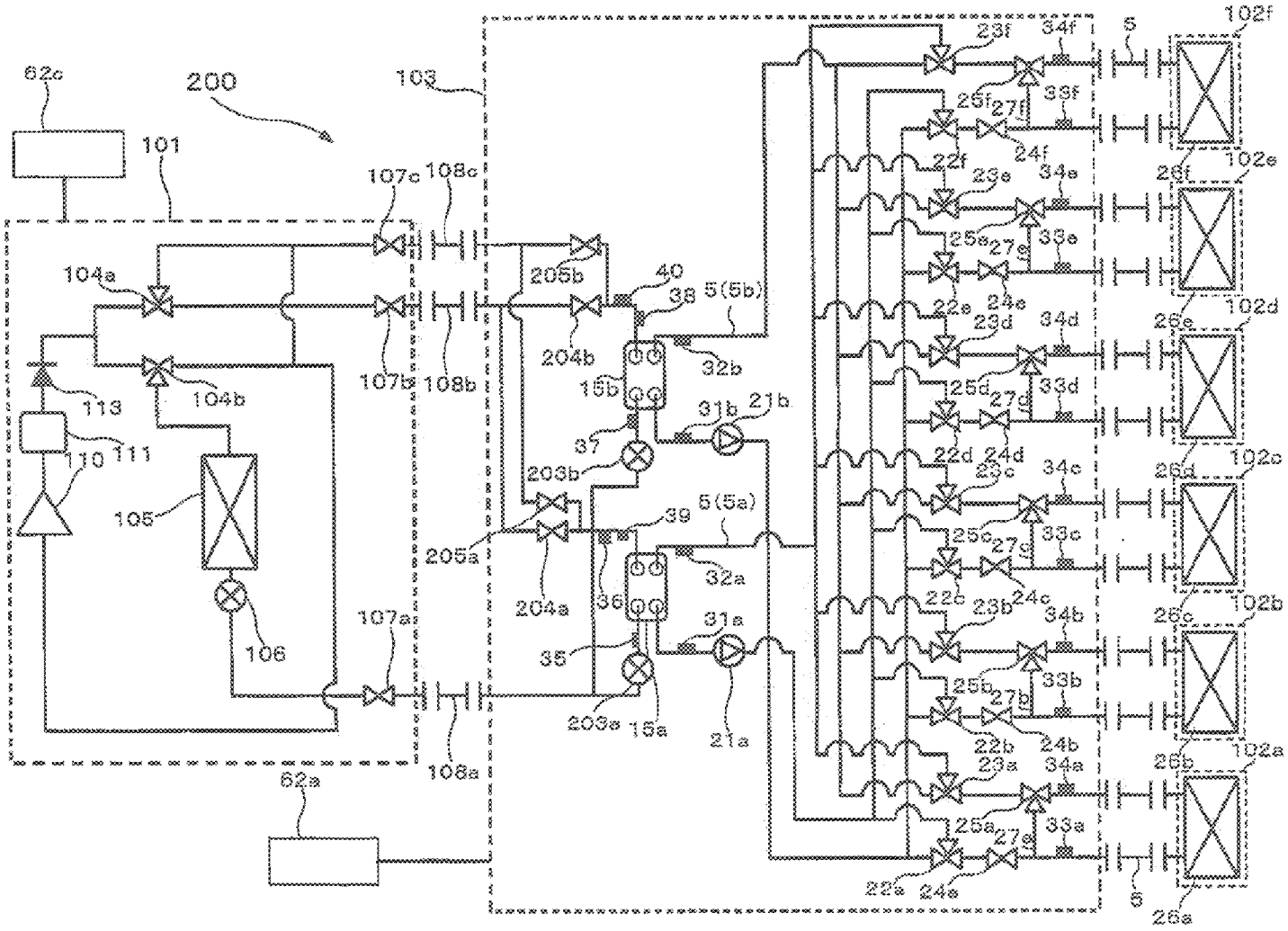
FIG. 8 is a circuit diagram illustrating a circuit configuration of an air-conditioning apparatus according to Embodiment 2.

FIG. 8 is a circuit diagram illustrating a circuit configuration of an air-conditioning apparatus 200 according to Embodiment 2 of the present invention. On the basis of FIG. 8, the circuit configuration of the air-conditioning apparatus 200 will be described. This air-conditioning apparatus 200 performs a cooling operation or a heating operation using a refrigeration cycle (refrigeration cycle and a heat medium circulation circuit) through which a refrigerant (heat-source side refrigerant and a heat medium (water, anti-freezing solution and the like)) is circulated similarly to the air-conditioning apparatus 100. This air-conditioning apparatus 200 is different from the air-conditioning apparatus 100 according to Embodiment 1 in the point that a refrigerant pipeline of the air-conditioning apparatus 200 is a three-pipe type. The difference from Embodiment 1 will be mainly described in Embodiment 2, the same portions as those in Embodiment 1 are given the same reference numerals, and the description will be omitted.

As shown in FIG. 8, the air-conditioning apparatus 200 has one heat source device 101, which is a heat source machine, a plurality of indoor units 102, and relay units 103 interposed between the heat source device 101 and the indoor units 102. The relay units 103 exchange heat between the heat-source side refrigerant and the heat medium. The heat source device 101 and the relay unit 103 are connected by a refrigerant pipeline 108 through which a heat-source side refrigerant is conducted, and the relay unit 103 and the indoor unit 102 are connected by the pipeline 5 through which the heat medium is conducted 80 that cooling energy or heating energy generated in the heat source device 101 is delivered to the indoor units 102. The numbers of the connected heat source devices 101, the indoor units 102, and the relay units 103 are not limited to the numbers shown in the figure.

The heat source device 101 is arranged in the outdoor space 6 as shown in FIG. 1 so as to supply cooling energy or heating energy to the indoor unit 102 through the relay unit 103. The indoor unit 102 is arranged in the living space 7 as shown in FIG. 1 so as to supply cooling air or heating air to the living space 7 to become a region to be air-conditioned. The relay unit 103 is configured separately from the heat source device 101 and the indoor unit 102, arranged in the nonliving space 50, connects the heat source device 101 to the indoor unit 102 and transfers cooling energy or heating energy supplied from the heat source device 101 to the indoor unit 102.

The heat source device 101 and the relay unit 103 are connected to each other using three refrigerant pipelines 108 (refrigerant pipelines 108*a* to 108*c*). Also, the relay unit 103 and each of the indoor units 102 are connected to each other by the two pipelines 5, respectively. As a result, construction of the air-conditioning apparatus 200 is facilitated. That is, the heat source device 101 and the relay unit 103 are connected through the first intermediate heat exchanger 15*a* and the second intermediate heat exchanger 15*b* disposed in the relay unit 103, and the relay unit 103 and the indoor unit 102 are also connected through the first intermediate heat exchanger 15*a* and the second intermediate heat exchanger 15*b*. The configuration and functions of each component disposed in the air-conditioning apparatus 200 will be described below.

[Heat Source Device 101]

In the heat source device 101, a compressor 110, an oil separator 111, a check valve 113, a three-way valve 104, which is a refrigerant channel switching device (a three-way valve 104*a* and a three-way valve 104*b*), a heat-source side heat exchanger 105, and an expansion valve 106 are connected by a refrigerant pipeline 108 and stored. Also, in the heat source device 101, a two-way valve 107 (a two way valve 107*a*, a two-way valve 107*b*, and a two-way vale 107*c*) are disposed. In this heat source device 101, the flow direction of the heat-source side refrigerant is determined by controlling the three-way valve 104*a* and the three-way valve 104*b*.

The compressor 110 sucks the heat-source side refrigerant and compresses the heat-source side refrigerant into a high-temperature and high-pressure state and is preferably composed of an inverter compressor and the like capable of capacity control, for example. The oil separator 111 is disposed on the discharge side of the compressor 110 and separates oil contained in the refrigerant discharged from the compressor 110. The check valve 113 is disposed on the downstream side of the oil separator 111 and allows the flow of the heat-source side refrigerant having passed through the oil separator 111 only to a predetermined direction (direction from the oil separator 111 to the three-way valve 104).

The three-way valve 104 makes switching between the flow of the heat-source side refrigerant during the heating operation and the flow of the heat-source side refrigerant during the cooling operation. The three-way valve 104*a* is disposed on one of the refrigerant pipelines 108 branching on the downstream side of the check valve 113, and one of the three ways is connected to the check valve 113, another of the three ways to the intermediate heat exchanger 15 through the two-way valve 107*b*, and the rest of the three ways to the intermediate heat exchanger 15 through the two-way valve 107*c*, respectively. The three-way valve 104*b* is disposed on the other of the refrigerant pipeline 108 branching on the downstream side of the check valve 113, and one of the three ways is connected to the check valve 113, another of the three ways to the heat-source side heat exchanger 105, and the rest of the three ways to the compressor 110 and the refrigerant pipeline 108 between the three-way valve 104*a* and the two-way valve 107*c*, respectively.

The heat-source side heat exchanger 105 functions as an evaporator during the heating operation and functions as a condenser during the cooling operation, exchanges heat between the air supplied from a blower such as a fan, not shown, and the heat-source side refrigerant and evaporates and gasifies or condenses and liquefies the heat-source-side refrigerant. The expansion valve 106 is disposed in the refrigerant pipeline 108 connecting the heat-source side heat exchanger 105 and the intermediate heat exchanger 15 to each other, functions as a reducing valve or a throttling device and decompresses and expands the heat-source side refrigerant. The expansion valve 106 is preferably composed of a valve with variably controllable opening degree such as an electronic expansion valve, for example.

The two-way valve 107 opens/closes the refrigerant pipeline 108. The two-way valve 107*a* is disposed on the refrigerant pipeline 108*a* between the expansion valve 106 and an expansion valve 203, which will be described later. The two-way valve 107*b* is disposed on the refrigerant pipeline 108*b* between the three-way valve 104*a* and a two-way valve 204*a*, which will be described later. The two-way valve 107*c* is disposed on the refrigerant pipeline 108*c* between the three-way valve 104*a* and a two-way valve 205*b*, which will be described later. The refrigerant pipeline 108*a* is a high-pressure liquid pipeline, the refrigerant pipeline 108*b* is a high-pressure gas pipeline, and the refrigerant pipeline 108*c* is a low-pressure gas pipeline.

[Indoor Unit 102]

On the indoor units 102, the use-side heat exchanger 26 is mounted, respectively. This use-side heat exchanger 26 is connected to the stop valve 24 and the flow regulating valve 25 in the relay unit 103 through the pipeline 5. In FIG. 8, a case in which six indoor units 102 are connected to the relay unit 103 is shown, and an indoor unit 102*a*, an indoor unit 102*b*, an indoor unit 102*c*, an indoor unit 102*d*, an indoor unit 102*e*, and an indoor unit 102*f* are shown from the lower side in the figure.

Also, in accordance with the indoor units 102*a* to 102*f*, the use-side heat exchanger 26 is also shown as the use-side heat exchanger 26*a*, the use-side heat exchanger 26*b*, the use-side heat exchanger 26*c*, the use-side heat exchanger 26*d*, the use-side heat exchanger 26*e*, and the use-side heat exchanger 26*f* from the lower side in the figure. Similarly to Embodiment 1, the number of connected indoor units 102 is not limited to six as shown in FIG. 8. Also, the use-side heat exchanger 26 is the same as the one contained in the indoor unit 2 of the air-conditioning apparatus 100 according to Embodiment 1.

[Relay Unit 103]

In the relay unit 103, the two expansion valves 203, the two intermediate heat exchangers 15, the two two-way valves 204, the two two-way valves 205, the two pumps 21, the six channel switching valves 22, the six channel switching valves 23, the six stop valves 24, and the six flow regulating valves 25 are disposed. The intermediate heat exchangers 15, the pumps 21, the channel switching valves 22, the channel switching valves 23, the stop valves 24, and the flow regulating valves 25 are the same as those contained in the second relay unit 3*b* of the air-conditioning apparatus 100 according to Embodiment 1.

The two expansion valves 203 (an expansion valve 203*a* and an expansion valve 203*b*) functions as a reducing valve or a throttling device and reducing and expands the heat-source side refrigerant. The expansion valve 203*a* is disposed between the two-way valve 107*a* and the first intermediate heat exchanger 15*a*. The expansion valve 203*b* is disposed between the two-way valve 107*a* and the second intermediate heat exchanger 15*b* so as to be parallel with the expansion valve 203*a*. Each of the two expansion valves 203 is preferably composed of a valve with variably controllable opening degree such as an electronic expansion valve, for example.

The two two-way valves 204 (a two-way valve 204*a* and a two-way valve 204*b*) open/close the refrigerant pipeline 108. The two-way valve 204*a* is disposed in the refrigerant pipeline 108*b* between the two-way valve 107*b* and the first intermediate heat exchanger 15*a*. The two-way valve 204*b* is disposed in the refrigerant pipeline 108*b* between the two-way valve 107*b* and the second intermediate heat exchanger 15*b* so as to be parallel with the two-way valve 204*a*. The two-way valve 204*a* is disposed in the refrigerant pipeline 108*b* branching from the refrigerant pipeline 108*b* between the two-way valve 107*b* and the two-way valve 204*b*.

The two two-way valves 205 (the two-way valve 205*a* and the two-way valve 205*b*) open/close the refrigerant pipeline 108. The two-way valve 205*a* is disposed in the refrigerant pipeline 108*c* between the two-way valve 107*c* and the first intermediate heat exchanger 15*a*. The two-way valve 205*b* is disposed in the refrigerant pipeline 108*c* between the two-way valve 107*c* and the second intermediate heat exchanger 15*b* so as to be in parallel with the two-way valve 205*a*. The two-way valve 205*a* is disposed in the refrigerant pipeline 108*c* branching from the refrigerant pipeline 108*c* between the two-way valve 107*c* and the two-way valve 205*b*.

Also, in the relay unit 103, the two first temperature sensors 31, the two second temperature sensors 32, the six third temperature sensors 33, the six fourth temperature sensors 34, the fifth temperature sensor 35, the first pressure sensor 36, the sixth temperature sensor 37, and the seventh temperature sensor 38 are disposed as in the second relay unit 3*b* of the air-conditioning apparatus 100 according to Embodiment 1. In addition, in the relay unit 103, an eighth temperature sensor 39 and a second pressure sensor 40 are disposed. Information detected by these detecting means is sent to a controller (the controller 62*a*, here) that controls the operation of the air-conditioning apparatus 200 and used for control of the driving frequencies of the compressor 110 and the pump 21, switching of the channel for the heat medium flowing through the pipeline 5 and the like.

The eighth temperature sensor 390 is disposed on the inlet side of the heat-source side refrigerant channel of the first heat exchanger 15*a* and detects the temperature of the heat-source side refrigerant flowing into the first intermediate heat exchanger 15*a* and may be composed of a thermistor or the like. The second pressure sensor 40 is disposed on the outlet side of the heat-source side refrigerant channel of the second intermediate heat exchanger 15*b* and detects the pressure of the heat-source side refrigerant flowing out of the second intermediate heat exchanger 15*b*. The first pressure sensor 36 functions as heating refrigerant pressure detecting means and the second pressure sensor 40 as the cooling pressure detecting means, respectively.

In this air-conditioning apparatus 200, the compressor 110, the oil separator 111, the heat-source side heat exchanger 105, the expansion valve 106, the first intermediate heat exchanger 15*a*, and the second intermediate heat exchanger 15*b* are connected in series by the refrigerant pipeline 108 and form a refrigeration cycle. Also, the first intermediate heat exchanger 15*a*, the first pump 21*a*, and the use-side heat exchanger 26 are connected in series in the order by the pipeline 5*a* and form a heat medium circulation circuit. Similarly, the second intermediate heat exchanger 15*b*, the second pump 21*b*, and the use-side heat exchanger 26 are connected in series in the order by the pipeline 5*b* and form the heat medium circulation circuit.

That is, in the air-conditioning apparatus 200, the heat source device 101 and the relay unit 103 are connected to each other through the first intermediate heat exchanger 15*a* and the second intermediate heat exchanger 15*b* disposed in the relay unit 103, and the relay unit 103 and the indoor unit 102 are connected to each other through the first intermediate heat exchanger 15*a* and the second intermediate heat exchanger 15*b* so that the heat-source side refrigerant, which is the primary side refrigerant circulating through the refrigeration cycle and the heat medium, which is the secondary side refrigerant circulating through the heat medium circulation circuit, exchange heat in the first intermediate heat exchanger 15*a* and the second intermediate heat exchanger 15*b*.

Here, each operation mode executed by the air-conditioning apparatus 200 will be described.

This air-conditioning apparatus 200 is capable of the cooling operation or the heating operation with the indoor units 102 thereof on the basis of an instruction from each indoor unit 102. That is, the air-conditioning apparatus 200 can perform the same operation with all the indoor units 102 or can perform different operations with each of the indoor, units 102. The four operation modes executed by the air-conditioning apparatus 200, that is, the cooling only operation mode, the heating only operation mode, the cooling-main operation mode, and the heating-main operation mode will be described below with the flow of the refrigerant.

[Cooling Only Operation Mode]

Figure 9:
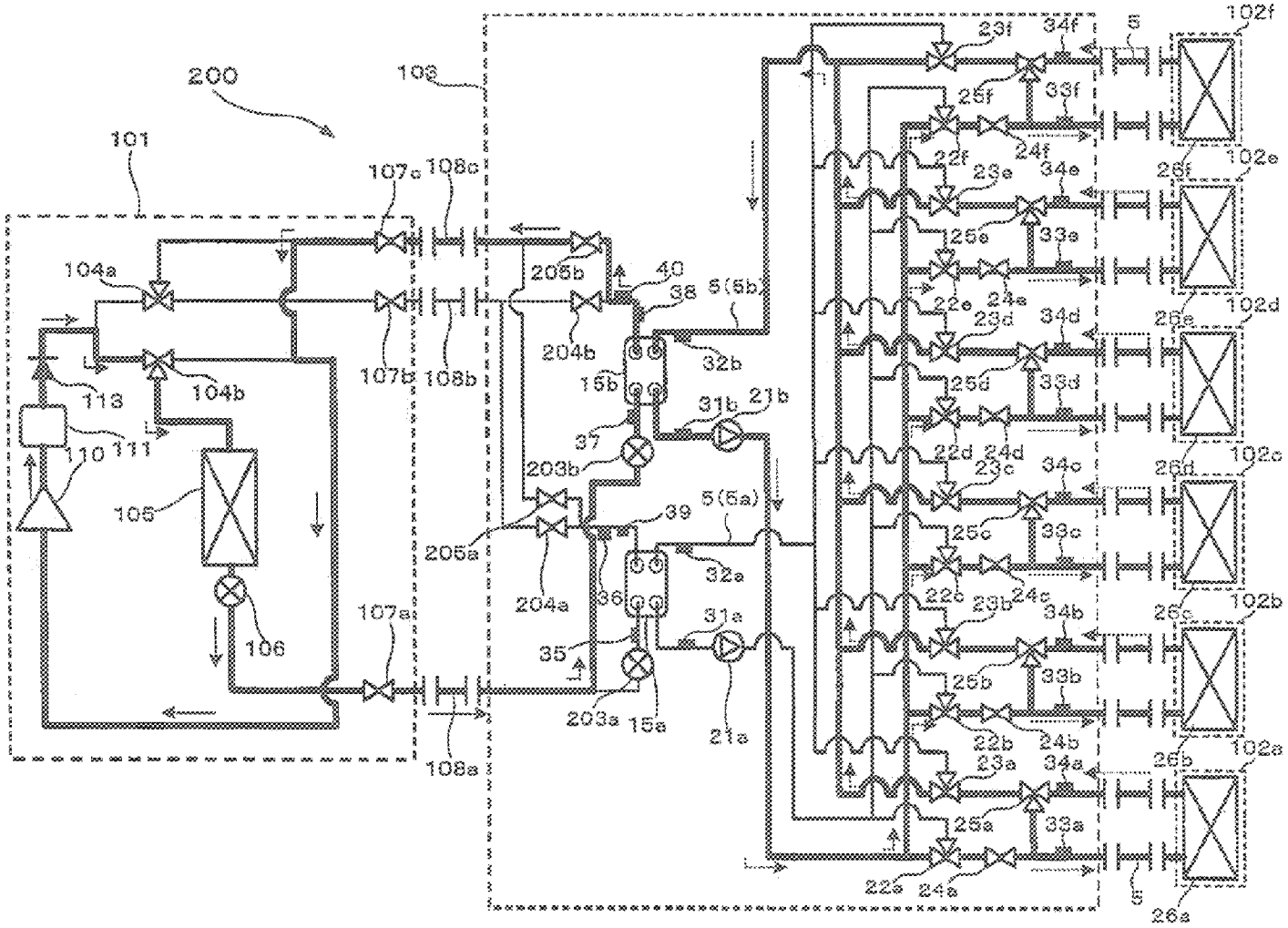
FIG. 9 is a refrigerant circuit diagram illustrating the flow of the refrigerant in cooling only operation mode of the air-conditioning apparatus.

FIG. 9 is a refrigerant circuit diagram illustrating the flow of the refrigerant during the cooling only operation mode of the air-conditioning apparatus 200. In FIG. 9, the cooling only operation mode will be described using a case in which a cooling load is generated in all the use-side heat exchangers 26*a* to 26*f* as an example. In FIG. 9, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the cooling only operation mode shown in FIG. 9, in the heat source device 101, the three-way valve 104*b* is switched so that the heat-source side refrigerant discharged from the compressor 110 flows into the heat-source side heat exchanger 105, the three-way valve 104*a* is switched so that the heat-source side refrigerant having passed through the second intermediate heat exchanger 15*b* is sucked into the compressor 110, the two-way valve 107*a* and the two-way valve 107*c* are opened, and the two-way valve 107*b* is closed. In the relay unit 103, the first pump 21*a* is stopped, the second pump 21*b* is driven, and the stop valve 24 is opened so that the heat medium circulates between the second intermediate heat exchanger 15*b* and each use-side heat exchanger 26. In this state, the operation of the compressor 110 is started.

First, the flow of the heat-source side refrigerant in the refrigeration cycle will be described.

A low-temperature and low-pressure refrigerant is compressed by the compressor 110 and is discharged as a high-temperature and high-pressure gas refrigerant. The high-temperature and high-pressure gas refrigerant discharged from the compressor 110 flows into the heat-source side heat exchanger 105 through the three-way valve 104*b*. Then, the refrigerant is condensed and liquefied while radiating heat to the outdoor air in the heat-source side heat exchanger 105 and becomes a high-pressure liquid refrigerant. The high-pressure liquid refrigerant having flowed out of the heat-source side heat exchanger 105 flows out of the heat source device 101 through the two-way valve 107*a* and flows into the relay unit 103 through the refrigerant pipeline 108*a*. The high-pressure liquid refrigerant having flowed into the relay unit 103 is throttled and expanded by expansion valve 203*b* and becomes a low-temperature and low-pressure gas-liquid two-phase refrigerant.

This gas-liquid two-phase refrigerant flows into the second intermediate heat exchanger 15*b* working as an evaporator and absorbs heat from the heat medium circulating through the heat medium circulation circuit while cooling the heat medium and becomes a low-temperature and low-pressure gas refrigerant. The gas refrigerant having flowed out of the second intermediate heat exchanger 15*b* passes through the two-way valve 205*b*, flows out of the relay unit 103 and flows into the heat source device 101 through the refrigerant pipeline 108*c*. The refrigerant having flowed into the heat source device 101 passes through the two-way valve 107*c* and is sucked into the compressor 10 again.

Subsequently, the flow of the heat medium in the heat medium circulation circuit will be described.

In the cooling only operation mode, since the first pump 21*a* is stopped, the heat medium circulates through the pipeline 5*b*. The heat medium having been cooled by the heat-source side refrigerant in the second intermediate heat exchanger 15*b* is fluidized in the pipeline 5*b* by the second pump 21*b*. The heat medium having been pressurized and having flowed out by the second pump 21*b* passes through the stop valve 24 through the channel switching valve 22 and flows into each use-side heat exchanger 26. Then, the heat medium absorbs heat from the indoor air in the use-side heat exchanger 26 and cools the region to be air-conditioned such as the inside of the room where the indoor unit 102 is installed.

After that, the heat medium having flowed out of each use-side heat exchanger 26 flows into the flow regulating valve 25. At this time, by means of the action of the flow regulating valve 25, the heat medium only in a flow rate required to cover an air-conditioning load required in the region to be air-conditioned such as the inside of the room flows into the use-side heat exchanger 26, while the remaining heat medium flows so as to bypass the use-side heat exchanger 26 through the bypass 27. The heat medium passing through the bypass 27 does not contribute to the heat exchange but merges with the heat medium having passed through the use-side heat exchanger 26, passes through the channel switching valve 23, flows into the second intermediate heat exchanger 15*b* and is sucked into the second pump 21*b* again. The air-conditioning load required in the region to be air-conditioned such as the inside of the room can be covered by means of control such that a temperature difference between the third temperature sensor 33 and the fourth temperature sensor 34 is kept at a target value.

[Heating Only Operation Mode]

Figure 10:
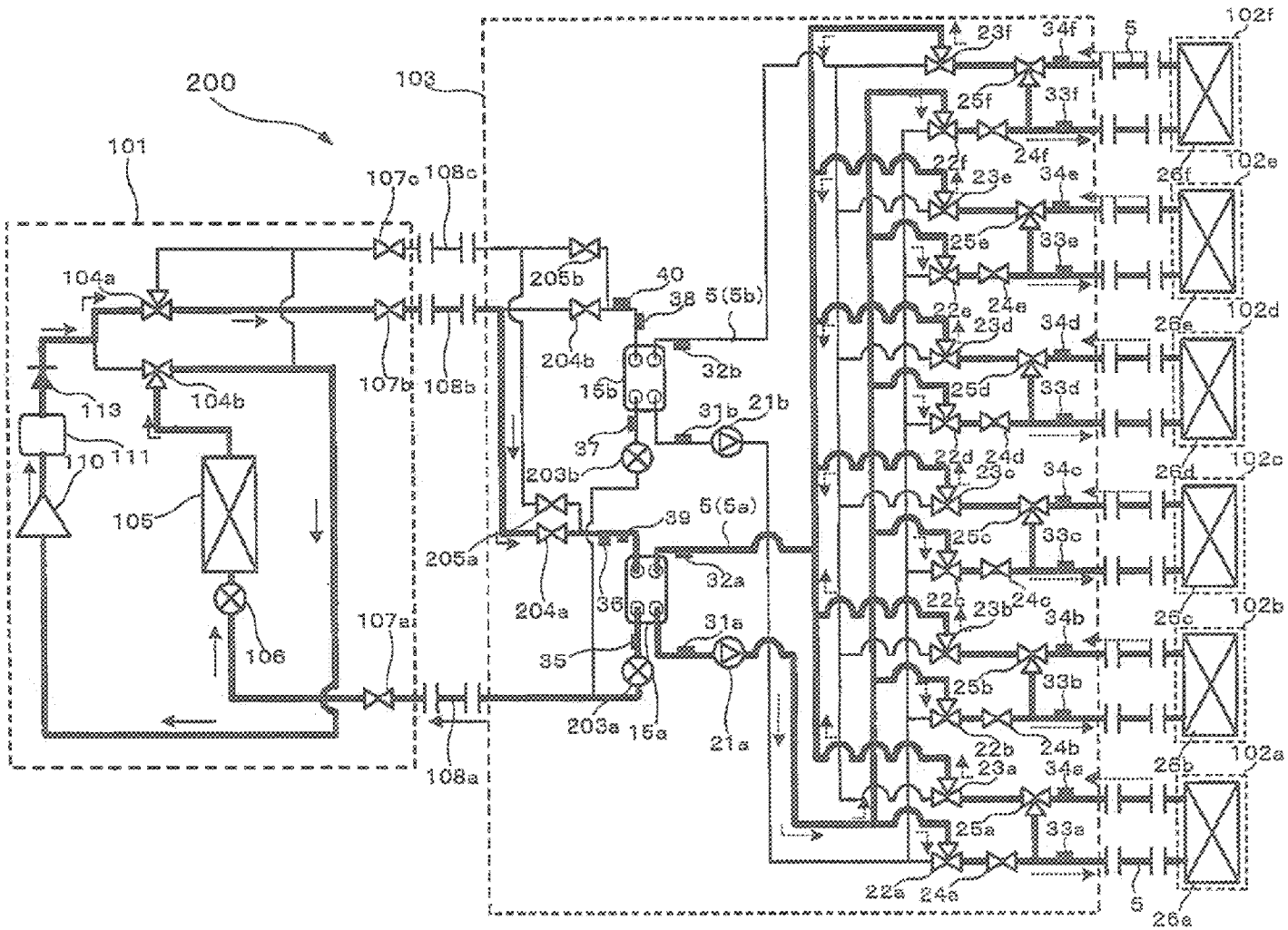
FIG. 10 is the refrigerant circuit diagram illustrating the flow of the refrigerant in heating only operation mode of the air-conditioning apparatus.

FIG. 10 is a refrigerant circuit diagram illustrating the flow of the refrigerant during the heating only operation mode of the air-conditioning apparatus 200. In FIG. 10, the heating only operation mode will be described using a case in which a heating load is generated in all the use-side heat exchangers 26*a* to 26*f* as an example. In FIG. 10, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the case of the heating only operation mode shown in FIG. 10, in the heat source device 101, the three-way valve 104*a* is switched so that the heat-source side refrigerant discharged from the compressor 110 flows into the first intermediate heat exchanger 15*a*, the three-way valve 104*b* is switched so that the heat-source side refrigerant having passed through the heat-source side heat exchanger 105 is sucked into the compressor 110, the two-way valve 107*a* and the two-way valve 107*b* are opened, and the two-way valve 107*c* is closed. In the relay unit 103, the first pump 21*a* is driven, the second pump 21*b* is stopped, and the stop valve 24 is opened so that the heat medium circulates between the second intermediate heat exchanger 15*b* and each use-side heat exchanger 26. In this state, the operation of the compressor 110 is started.

First, the flow of the heat-source side refrigerant in the refrigeration cycle will be described.

A low-temperature and low-pressure refrigerant is compressed by the compressor 110 and is discharged as a high-temperature and high-pressure gas refrigerant. The high-temperature and high-pressure gas refrigerant discharged from the compressor 110 flows out of the heat source device 101 through the three-way valve 104*a* and the two-way valve 107*b* and flows into the relay unit 103 through the refrigerant pipeline 108*b*. The refrigerant having flowed into the relay unit 103 passes through the two-way valve 204*a* and flows into the first intermediate heat exchanger 15*a*. The high-temperature and high-pressure gas refrigerant having flowed into the first intermediate heat exchanger 15*a* is condensed and liquefied while radiating heat to the heat medium circulating through the heat medium circulation circuit and becomes a high-pressure liquid refrigerant.

The high-pressure liquid refrigerant having flown out of the first intermediate heat exchanger 15*a* passes through the expansion valve 203*a* and flows out of the relay unit 103 and flows into the heat source device 101 through the refrigerant pipeline 108*a*. The refrigerant having flowed into the heat source device 101 passes through the two-way valve 107*a* and flows into the expansion valve 106, is throttled and expanded by the expansion valve 106 and becomes a low-temperature and low-pressure gas-liquid two-phase state. The gas-liquid two-phase state refrigerant having been throttled by the expansion valve 106 flows into the heat-source side heat exchanger 105 working as an evaporator. Then, the refrigerant having flowed into the heat-source side heat exchanger 105 absorbs heat from the outdoor air in the heat-source side heat exchanger 105 and becomes a low-temperature and low-pressure gas refrigerant. The low-temperature and low-pressure gas refrigerant having flowed out of the heat-source side heat exchanger 105 returns to the compressor 10 through the three-way valve 104*b*.

Subsequently, the flow of the heat medium in the heat medium circulation circuit will be described.

In the heating only operation mode, since the second pump 21*b* is stopped, the heat medium circulates through the pipeline 5*a*. The heat medium having been heated by the heat-source side refrigerant in the first intermediate heat exchanger 15*a* is fluidized in the pipeline 5*a* by the first pump 21*a*. The heat medium having been pressurized and flowed out by the first pump 21*a* passes through the stop valve 24 through the channel switching valve 22 and flows into each use-side heat exchanger 26. Then, the heat medium gives heat to the indoor air in the use-side heat exchanger 26 and heats region to be air-conditioned such as the inside of the room where the indoor unit 2 is installed.

After that, the heat medium having flowed out of the use-side heat exchanger 26 flows into the flow regulating valve 25. At this time, by means of the action of the flow regulating valve 25, the heat medium only in a flow rate required to cover an air-conditioning load required in the region to be air-conditioned such as the inside of the room flows into the use-side heat exchanger 26, while the remaining heat medium flows so as to bypass the use-side heat exchanger 26 through the bypass 27. The heat medium passing through the bypass 27 does not contribute to the heat exchange but merges with the heat medium having passed through the use-side heat exchanger 26, passes through the channel switching valve 23, flows into the first intermediate heat exchanger 15*a* and is sucked into the first pump 21*a* again. The air-conditioning load required in the region to be air-conditioned such as the inside of the room can be covered by means of control such that a temperature difference between the third temperature sensor 33 and the fourth temperature sensor 34 is kept at a target value.

[Cooling-Main Operation Mode]

Figure 11:
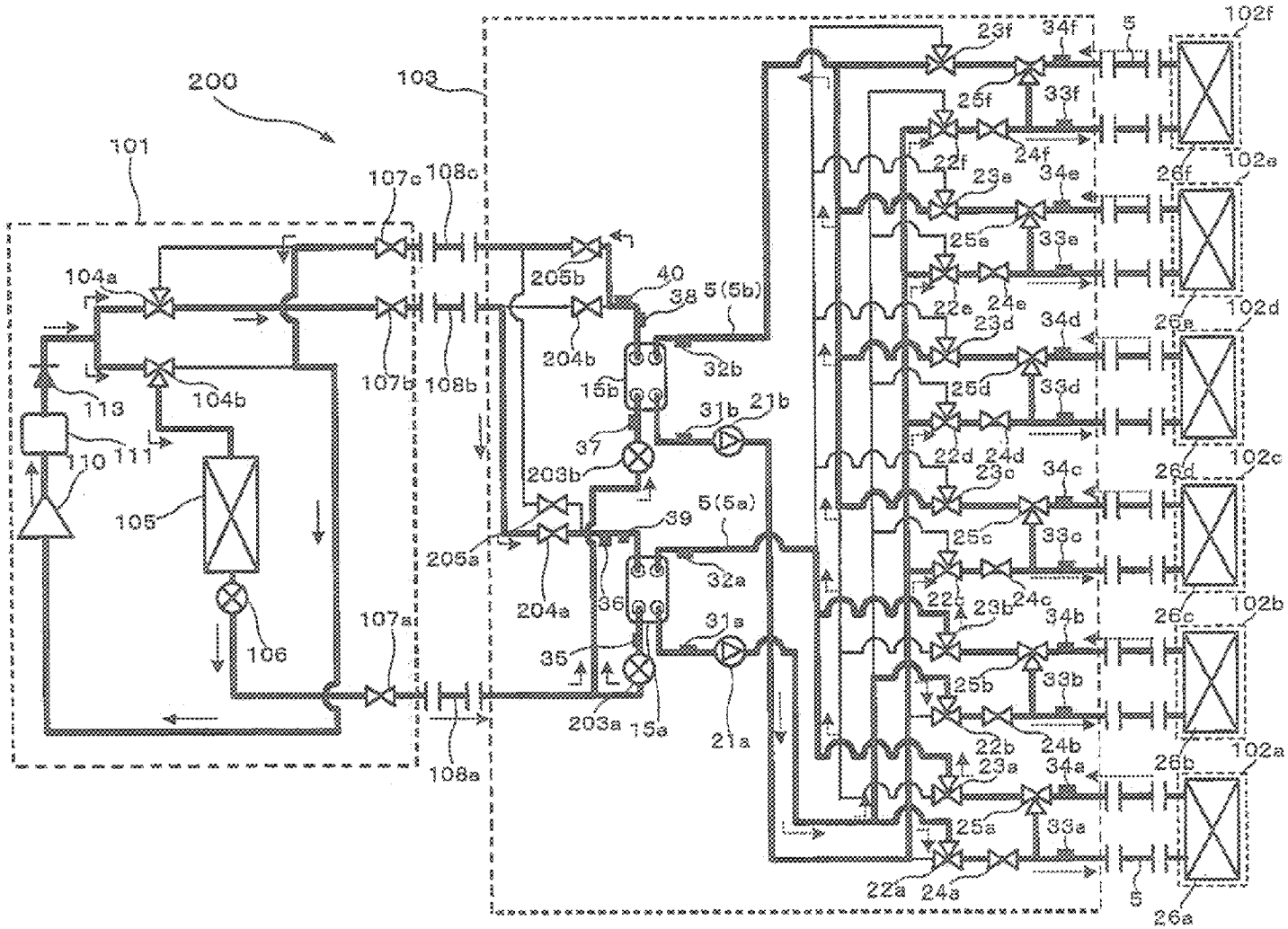
FIG. 11 is the refrigerant circuit diagram illustrating the flow of the refrigerant in a cooling main operation mode of the air-conditioning apparatus.

FIG. 11 is a refrigerant circuit diagram illustrating the flow of the refrigerant during the cooling-main operation mode of the air-conditioning apparatus 200. In FIG. 11, using a case in which a heating load is generated in the use-side heat exchanger 26*a* and the use-side heat exchanger 26*b*, and a cooling load is generated in the use-side heat exchangers 26*c* to 26*f* as an example, the cooling-main operation mode will be described. In FIG. 11, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the cooling-main operation mode shown in FIG. 11, in the heat source device 101, the three-way valve 104*a* is switched so that the heat-source side refrigerant discharged from the compressor 110 flows into the first intermediate heat exchanger 15*a*, the three-way valve 104*b* is switched so that the heat-source side refrigerant discharged from the compressor 110 flows into the heat-source side heat exchanger 105, and the two-way valves 107*a* to 107*c* are opened. In the relay unit 103, the first pump 21*a* and the second pump 21*b* are driven, the stop valves 24*a* to 24*f* are opened, and the heat medium is made to circulate between the first intermediate heat exchanger 15*a* and the use-side heat exchanger 26*a* and the use-side heat exchanger 26*b* as well as the second intermediate heat exchanger 15*b* and the use-side heat exchangers 26*c* to 26*f*. In this state, the operation of the compressor 110 is started.

First, the flow of the heat-source side refrigerant in the refrigeration cycle will be described.

The low-temperature and low-pressure refrigerant is compressed by the compressor 110 and becomes a high-temperature and high-pressure gas refrigerant and is discharged. The high-temperature and high-pressure gas refrigerant discharged from the compressor 110 is divided on the downstream side of the check valve 113. One of the divided refrigerants flows into the heat-source side heat exchanger 105 through the three-way valve 104*b*. Then, the refrigerant is condensed and liquefied while radiating heat to the outdoor air in the heat-source side heat exchanger 105 and becomes a high-pressure liquid refrigerant. The high-pressure liquid refrigerant having flowed out of the heat-source side heat exchanger 105 flows out of the heat source device 101 through the two-way valve 107*a* and flows into the relay unit 103 through the refrigerant pipeline 108*a*.

The other of the divided refrigerants flows through the refrigerant pipeline 108*b* through the three-way valve 104*a* and the two-way valve 107*b* and flows into the relay unit 103. The gas refrigerant having flowed into the relay unit 103 passes through the two-way valve 204*a* and flows into the first intermediate heat exchanger 15*a*. The high-temperature and high-pressure gas refrigerant having flowed into the first intermediate heat exchanger 15*a* is condensed and liquefied while radiating heat to the heat medium circulating through the heat medium circulation circuit and becomes a high-pressure liquid refrigerant. This liquid refrigerant merges with the refrigerant having flowed into the relay unit 103 through the refrigerant pipeline 108*a*.

The merged liquid refrigerant is throttled and expanded by the expansion valve 203*b* and becomes a low-temperature and low-pressure gas-liquid two-phase refrigerant and then, flows into the second intermediate heat exchanger 15*b* working as an evaporator and absorbs heat from the heat medium circulating through the heat medium circulation circuit in the second intermediate heat exchanger 15*b* while cooling the heat medium so as to become a low-temperature and low-pressure gas refrigerant. The gas refrigerant having flowed out of the second intermediate heat exchanger 15*b* flows out of the relay unit 103 through the two-way valve 205*b* and flows into the heat source device 101 through the refrigerant pipeline 108*c*. The refrigerant having flowed into the heat source device 101 is sucked into the compressor 10 again through the two-way valve 107*c*.

Subsequently, the flow of the heat medium in the heat medium circulation circuit will be described.

In the cooling-main operation mode, since the first pump 21*a* and the second pump 21*b* are both driven, the heat medium is circulated through both the pipeline 5*a* and the pipeline 5*b*. The heat medium heated by the heat-source side refrigerant in the first intermediate heat exchanger 15*a* is fluidized in the pipeline 5*a* by the first pump 21*a*. Also, the heat medium cooled by the heat-source side refrigerant in the second intermediate heat exchanger 15*b* is fluidized in the pipeline 5*b* by the second pump 21*b*.

The heat medium having been pressurized and flowed out by the first pump 21*a* passes through the stop valve 24*a* and the stop valve 24*b* through the channel switching valve 22*a* and the channel switching valve 22*b* and flows into the use-side heat exchanger 26*a* and the use-side heat exchanger 26*b*. Then, in the use-side heat exchanger 26*a* and the use-side heat exchanger 26*b*, the heat medium gives heat to the indoor air and heats the region to be air-conditioned such as the inside of the room where the indoor unit 102 is installed. Also, the heat medium having been pressurized and flowed out by the second pump 21*b* passes through the stop valves 24*c* to 24*f* and flows into the use-side heat exchangers 26*c* to 26*f*. Then, in the use-side heat exchangers 26*c* to 26*f*, the heat medium absorbs heat from the indoor air and cools the region to be air-conditioned such as the inside of the room where the indoor unit 102 is installed.

The heat medium having performed the heating flows into the flow regulating valve 25*a* and the flow regulating valve 25*b*. At this time, by means of the action of the flow regulating valve 25*a* and the flow regulating valve 25*b*, the heat medium only in a flow rate required to cover an air-conditioning load required in the region to be air-conditioned flows into the use-side heat exchanger 26*a* and the use-side heat exchanger 26*b*, while the remaining heat medium flows so as to bypass the use-side heat exchanger 26*a* and the use-side heat exchanger 26*b* through the bypass 27*a* and the bypass 27*b*. The heat medium passing through the bypass 27*a* and the bypass 27*b* does not contribute to heat exchange but merges with the heat medium having passed through the use-side heat exchanger 26*a* and the use-side heat exchanger 26*b*, flows into the first intermediate heat exchanger 15*a* through the channel switching valve 23*a* and the channel switching valve 23*b* and is sucked into the first pump 21*a* again.

Similarly, the heat medium having performed the cooling flows into the flow regulating valves 25*c* to 25*f*. At this time, by means of the action of the flow regulating valves 25*c* to 25*f*, the heat medium only in a flow rate required to cover an air-conditioning load required in the region to be air-conditioned flows into the use-side heat exchangers 26*c* to 26*f*, while the remaining heat medium flows so as to bypass the use-side heat exchangers 26*c* to 26*f* through the bypasses 27*c* to 27*f*. The heat medium passing through the bypasses 27*c* to 27*f* does not contribute to heat exchange but merges with the heat medium having passed through the use-side heat exchangers 26*c* to 26*f*, flows into the second intermediate heat exchanger 15*b* through the channel switching valves 23*c* to 23*f* and is sucked into the second pump 21*b* again.

During that period, the heated heat medium (the heat medium used for the heating load) and the cooled heat medium (the heat medium used for the cooling load) flow into the use-side heat exchanger 26*a* and the use-side heat exchanger 26*b* having the heating load or the use-side heat exchangers 26*c* to 26*f* having the cooling load without mixing by means of the actions of the channel switching valves 22*a* to 22*f* and the channel switching valves 23*a* to 23*f*. The air-conditioning load required in the region to be air-conditioned such as the inside of the room can be covered by executing control such that a difference in temperatures between the third temperature sensor 33 and a fourth temperature sensor 34 is kept at a target value.

Figure 12:
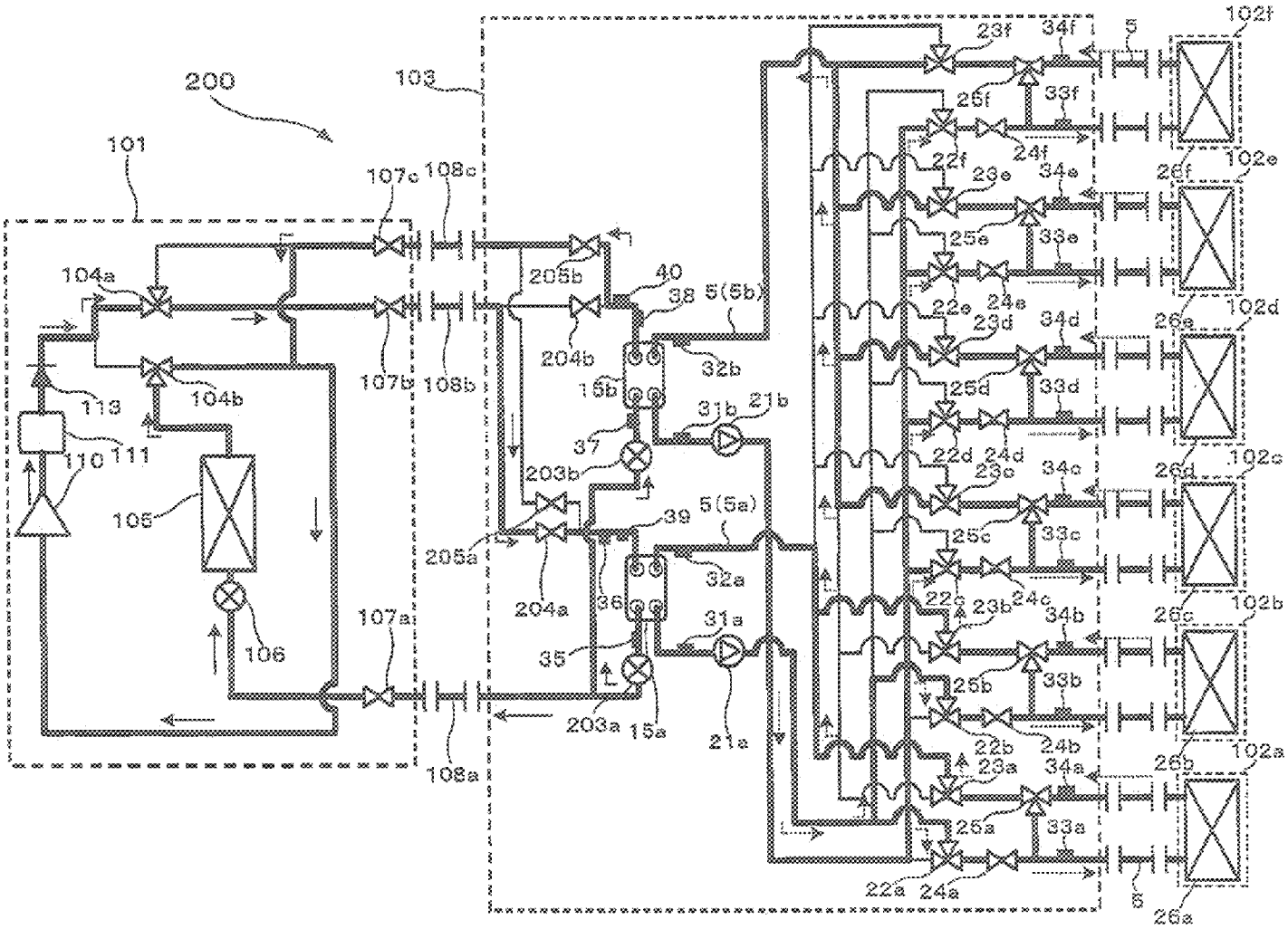
FIG. 12 is the refrigerant circuit diagram illustrating the flow of the refrigerant in a heating main operation mode of the air-conditioning apparatus.

FIG. 12 is a refrigerant circuit diagram illustrating the flow of the refrigerant during the heating-main operation mode of the air-conditioning apparatus 200. In FIG. 12, using a case in which a heating load is generated in the use-side heat exchangers 26*a* to 26*b*, and a cooling load is generated in the use-side heat exchangers 26*c* to 26*f* as an example, the heating-main operation mode will be described. In FIG. 12, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

In the heating-main operation mode shown in FIG. 12, in the heat source device 101, the three-way valve 104*a* is switched so that the heat-source side refrigerant discharged from the compressor 110 flows into the first intermediate heat exchanger 15*a*, the three-way valve 104*b* is switched so that the heat-source side refrigerant having passed through the heat-source side heat exchanger 105 is sucked into the compressor 110, and the two-way valves 107*a* to 107*c* are opened. In the relay unit 103, the first pump 21*a* and the second pump 21*b* are driven, the stop valves 24*a* to 24*f* are opened, and the heat medium is made to circulate between the first intermediate heat exchanger 15*a* and the use-side heat exchangers 26*a* to 2642126*b* as well as between the second intermediate heat exchanger 15*b* and the use-side heat exchangers 26*c* to 26*f*. In this state, the operation of the compressor 110 is started.

First, the flow of the heat-source side refrigerant in the refrigeration cycle will be described.

A low-temperature and low-pressure refrigerant is compressed by the compressor 110 and discharged as a high-temperature and high-pressure gas refrigerant. The high-temperature and high-pressure gas refrigerant having been discharged from the compressor 110 flows out of the heat source device 101 through the three-way valve 104*a* and the two-way valve 107*b* and flows into the relay unit 103 through the refrigerant pipeline 108*b*. The high-temperature and high-pressure gas refrigerant having flowed into the first intermediate heat exchanger 15*a* is condensed and liquefied while radiating heat to the heat medium circulating in the heat medium circulation circuit and becomes a high-pressure liquid refrigerant. The refrigerant having flowed out of the first intermediate heat exchanger 15*a* passes through the fully opened expansion valve 203*a* and then, is divided into the refrigerant returning to the heat source device 101 through the refrigerant pipeline 108*a* and the refrigerant flowing into the second intermediate heat exchanger 15*b*.

The refrigerant flowing into the second intermediate heat exchanger 15*b* is expanded by the expansion valve 203*b* and becomes a low-temperature and a low-pressure two-phase refrigerant and then, flows into the second intermediate heat exchanger 15*b* working as an evaporator and absorbs heat from the heat medium circulating in the heat medium circulation circuit while cooling the heat medium so as to become a low-temperature and low-pressure gas refrigerant. The gas refrigerant having flowed out of the second intermediate heat exchanger 15*b* flows out of the relay unit 103 through the two-way valve 205*b* and flows into the heat source device 101 through the refrigerant pipeline 108*c*.

On the other hand, the refrigerant returning to the heat source device 101 through the refrigerant pipeline 108*a* is decompressed in the expansion valve 106 and becomes a gas-liquid two-phase refrigerant and then, flows into the heat-source side heat exchanger 105 working as an evaporator. Then, the refrigerant having flowed into the heat-source side heat exchanger 105 absorbs heat from the outdoor air in the heat-source side heat exchanger 105 and becomes a low-temperature and low-pressure gas refrigerant. This gas refrigerant passes through the three-way valve 104*b*, merges with the low-pressure gas refrigerant having flowed into the heat source device 101 through the refrigerant pipeline 108*c* and is sucked into the compressor 10 again.

Subsequently, the flow of the heat medium in the heat medium circulation circuit will be described.

In the heating-main operation mode, since the first pump 21*a* and the second pump 21*b* are both driven, the heat medium is circulated through both the pipeline 5*a* and the pipeline 5*b*. The heat medium heated by the heat-source side refrigerant in the first intermediate heat exchanger 15*a* is fluidized in the pipeline 5*a* by the first pump 21*a*. Also, the heat medium cooled by the heat-source side refrigerant in the second intermediate heat exchanger 15*b* is fluidized in the pipeline 5*a* by the second pump 21*b*.

The heat medium having been pressurized and flowed out by the first pump 21*a* passes through the stop valves 24*a* to 24*b* through the channel switching valves 22*a* to 22*b* and flows into the use-side heat exchangers 26*a* to 26*b*. Then, in the use-side heat exchangers 26*a* to 26*b*, the heat medium gives heat to the indoor air and heats the region to be air-conditioned such as the inside of the room where the indoor unit 102 is installed. Also, the heat medium having been pressurized and flowed out by the second pump 21*b* passes through the stop valves 24*c* to 24*f* through the channel switching valves 22*c* to 22*f* and flows into the use-side heat exchangers 26*c* to 26*f*. Then, in the use-side heat exchangers 26*c* to 26*f*, the heat medium absorbs heat from the indoor air and cools the region to be air-conditioned such as the inside of the room where the indoor unit 102 is installed.

The heat medium having flowed out of the use-side heat exchangers 26*a* to 26*b* flows into the flow regulating valves 25*a* to 25*b*. At this time, by means of the action of the flow regulating valves 25*a* to 25*b*, the heat medium only in a flow rate required to cover an air-conditioning load required in the region to be air-conditioned such as the inside of the room flows into the use-side heat exchangers 26*a* to 26*b*, while the remaining heat medium flows so as to bypass the use-side heat exchangers 26*a* to 26*b* through the bypasses 27*a* to 27*b*. The heat medium passing through the bypasses 27*a* to 27*b* does not contribute to heat exchange but merges with the heat medium having passed through the use-side heat exchangers 26*a* to 26*b*, flows into the first intermediate heat exchanger 15*a* through the channel switching valves 23*a* to 23*b* and is sucked into the first pump 21*a* again.

Similarly, the heat medium having flowed out of the use-side heat exchangers 26*c* to 26*f* flows into the flow regulating valves 25*c* to 25*f*. At this time, by means of the action of the flow regulating valves 25*c* to 25*f*, the heat medium only in a flow rate required to cover an air-conditioning load required in the region to be air-conditioned flows into the use-side heat exchangers 26*c* to 26*f*, while the remaining heat medium flows so as to bypass the use-side heat exchangers 26*c* to 26*f* through the bypasses 27*c* to 27*f*. The heat medium passing through the bypasses 27*c* to 27*f* does not contribute to heat exchange but merges with the heat medium having passed through the use-side heat exchangers 26*c* to 26*f*, flows into the second intermediate heat exchanger 15*b* through the channel switching valves 23*c* to 23*f* and is sucked into the second pump 21*b* again.

During that period, the heated heat medium and the cooled heat medium flow into the use-side heat exchangers 26*a* to 26*b* having the heating load or the use-side heat exchangers 26*c* to 26*f* having the cooling load without mixing by means of the actions of the channel switching valve 22 (the channel switching valves 22*a* to 220 and the channel switching valves 23*a* to 23*f*. The air-conditioning load required in the region to be air-conditioned such as the inside of the room can be covered by executing control such that a difference in temperatures between the third temperature sensor 33 and the fourth temperature sensor 34 is kept at a target value.

As described above, since the relay unit 103 has a housing different from those of the heat source device 101 and the indoor unit 102, it can be installed at a different position, and by installing the relay unit 103 in the non-living space 50 as shown in FIG. 1, the heat-source side refrigerant and the heat medium can be shut off, and inflow of the heat-source side refrigerant into the living space 7 can be suppressed, whereby safety and reliability of the air-conditioning apparatus 200 are improved.

In the first intermediate heat exchanger 15*a* on the heating side, the heat medium temperature at the outlet of the first intermediate heat exchanger 15*a* detected by the first temperature sensor 31*a* does not become higher than the heat medium temperature at the inlet of the first intermediate heat exchanger 15*a* detected by the second temperature sensor 32*a*, and a heating amount in an superheat gas region of the heat-source side refrigerant is small. Thus, the heat medium temperature at the outlet of the first intermediate heat exchanger 15*a* is restricted by a condensing temperature substantially acquired from a saturation temperature of the first pressure sensor 36. Also, in the second intermediate heat exchanger 15*b* on the cooling side, the heat medium temperature at the outlet of the second intermediate heat exchanger 15*b* detected by the first temperature sensor 31*b* does not become lower than the heat medium temperature at the inlet of the second intermediate heat exchanger 15*b* detected by the second temperature sensor 32*b*.

Therefore, in the air-conditioning apparatus 200, it is effective to handle an increase or decrease of an air-conditioning load on the secondary side (use side) by changing a condensing temperature or an evaporating temperature on the refrigeration cycle side. Thus, it is preferable that a control target value of the condensing temperature and/or evaporating temperature of the refrigeration cycle stored in the controller (the controller 62*a* or the controller 62*c*, the same applies to this embodiment) is changed in accordance with the size of the air-conditioning load on the use side. As a result, the change in the size of the air-conditioning load on the use side can be easily followed.

Grasping of the change in the air-conditioning load on the use side is made by a controller 62*a* (or the controller 62*b*) connected to the relay unit 103 (or the second relay unit 3*b*). On the other hand, the control target values of the condensing temperature and the evaporating temperature are stored in the controller 62*c* connected to the heat source device 101 incorporating the compressor 110 and the heat-source side heat exchanger 105. Thus, a signal line is connected between the controller 62*a* connected to the relay unit 103 and the controller 62*c* connected to the heat source device 101, and the control target value of the condensing temperature and/or evaporating temperature is transmitted via communication so as to change the control target value of the condensing temperature and/or evaporating temperature stored in the controller 62*c* connected to the heat source device 101. Alternatively, the control target value may be changed by communicating a deviation value of the control target value.

By executing the above control, the change in the air-conditioning load on the use side can be handled appropriately. That is, if the controller grasps that the air-conditioning load on the use side is lowered, the controller can control the driving frequency of the compressor 110 so as to lower a work load of the compressor 110. Therefore, the air-conditioning apparatus 200 becomes capable of a more energy-saving operation. The controller 62*a* connected to the relay unit 103 and the controller 62*c* connected to the heat source device 101 may be handled by one controller. In Embodiment 2, the case using a three-way valve is described as an example, but not limited to that, the similar function can be exerted by combining a four-way valve, an solenoid valve and the like, for example. Moreover, usable heat-source side refrigerant and heat medium are the same as those described in Embodiment 1.

Figure 13:
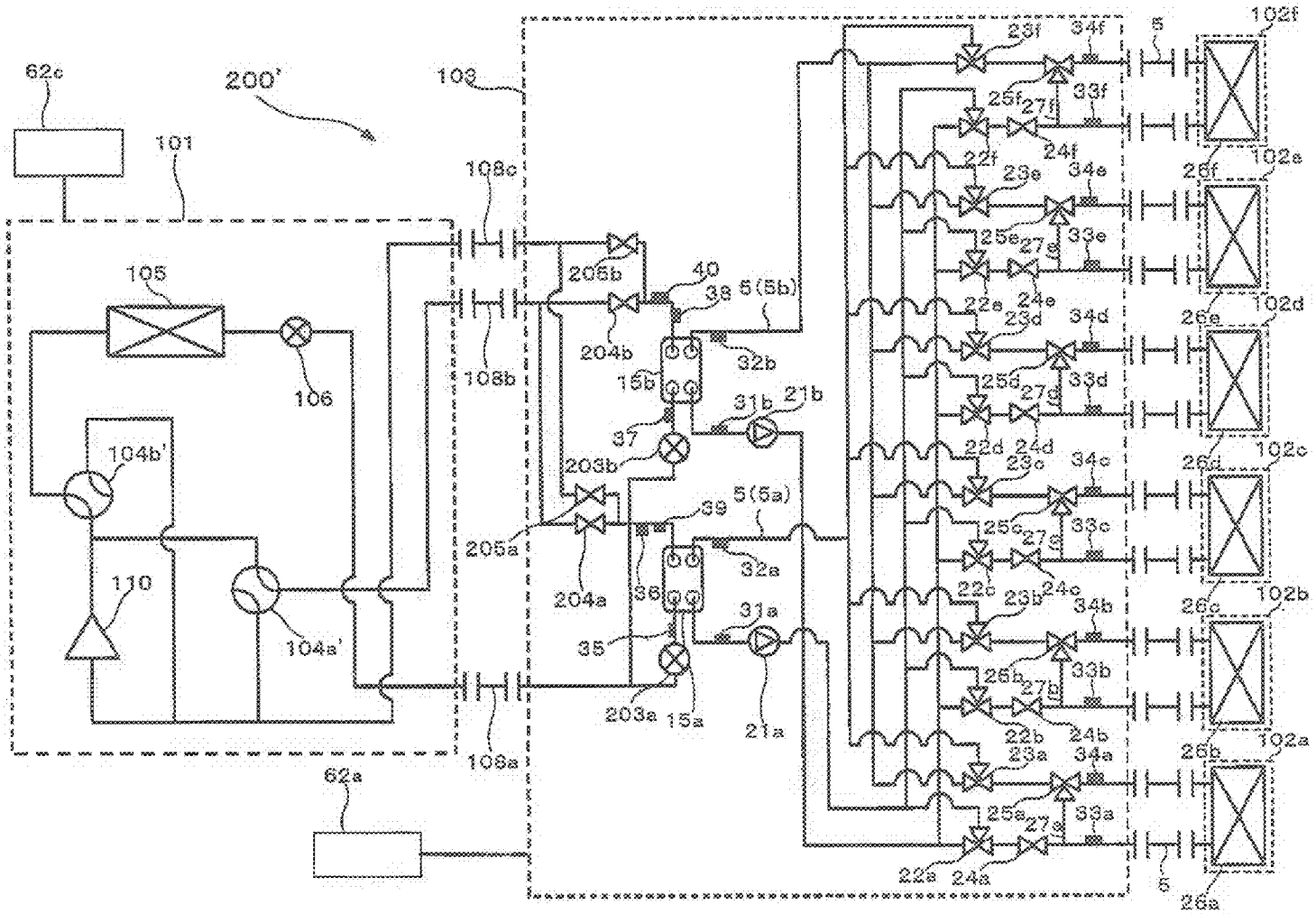
FIG. 13 is a circuit diagram illustrating a circuit configuration of a variation of the air-conditioning apparatus of Embodiments 2.

FIG. 13 is a circuit diagram illustrating a circuit configuration of a variation of the air-conditioning apparatus 200 according to Embodiment 2 of the present invention (hereinafter referred to as an air-conditioning apparatus 200'). The circuit configuration of the air-conditioning apparatus 200' will be described on the basis of FIG. 13. This air-conditioning apparatus 200' has four-way valves 104' (a four-way valve 104*a*' and a four-way valve 104*b*') instead of the three-way valve applied to the refrigerant channel switching device. The other configurations of the air-conditioning apparatus 200' are the same as those in the air-conditioning apparatus 200. Also, in the air-conditioning apparatus 200', the oil separator 111, the check valve 113, and the two-way valves 107*a* to 107*c* are not provided.

That is, in the heat source device 101, the flow direction of the heat-source side refrigerant is determined by controlling the four-way valve 104*a*' and the four-way valve 104*b*'. The four-way valves 104' switch the flow of the heat-source side refrigerant during the heating operation and the flow of the heat-source side refrigerant during the cooling operation. The four-way valve 104*a*' is disposed in the refrigerant pipeline 108*b* branched on the discharge side of the compressor 110. The four-way valve 104*b*' is disposed in the refrigerant pipeline 108*a* branched on the discharge side of the compressor 110.

Figure 14:
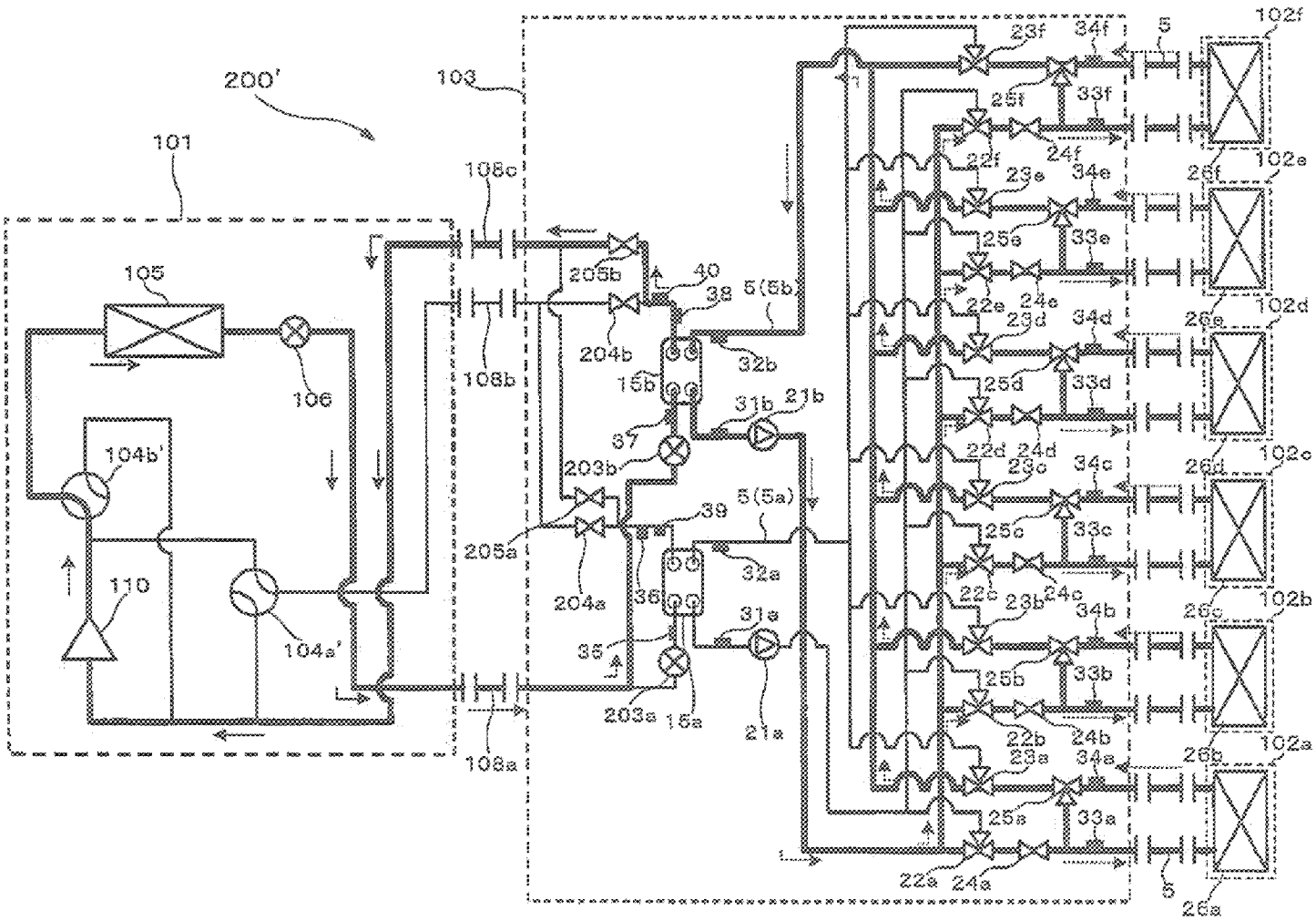
FIG. 14 is a refrigerant circuit diagram illustrating the flow of the refrigerant in cooling only operation mode of the air-conditioning apparatus.
Figure 15:
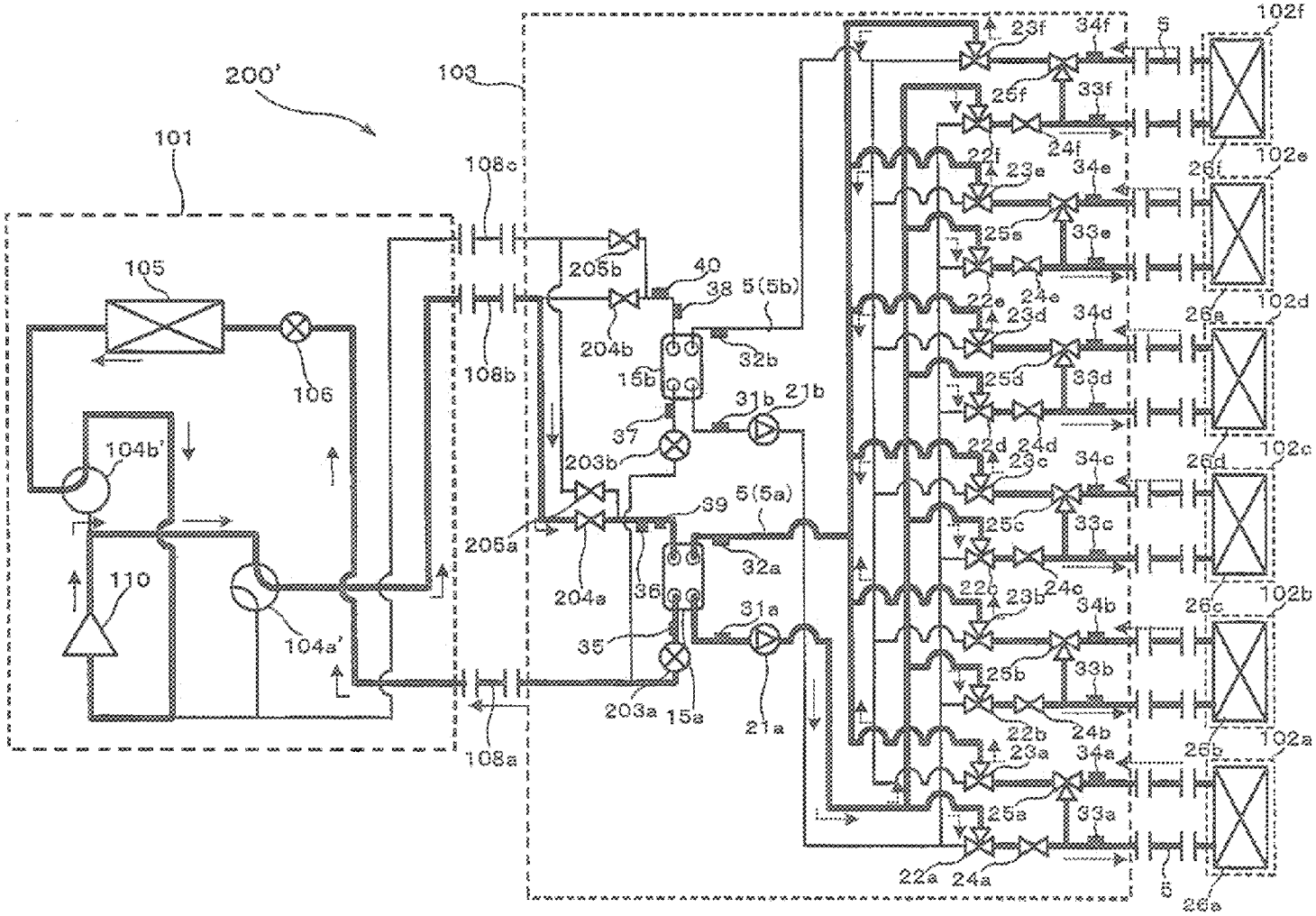
FIG. 15 is the refrigerant circuit diagram illustrating the flow of the refrigerant in heating only operation mode of the air-conditioning apparatus.
Figure 16:
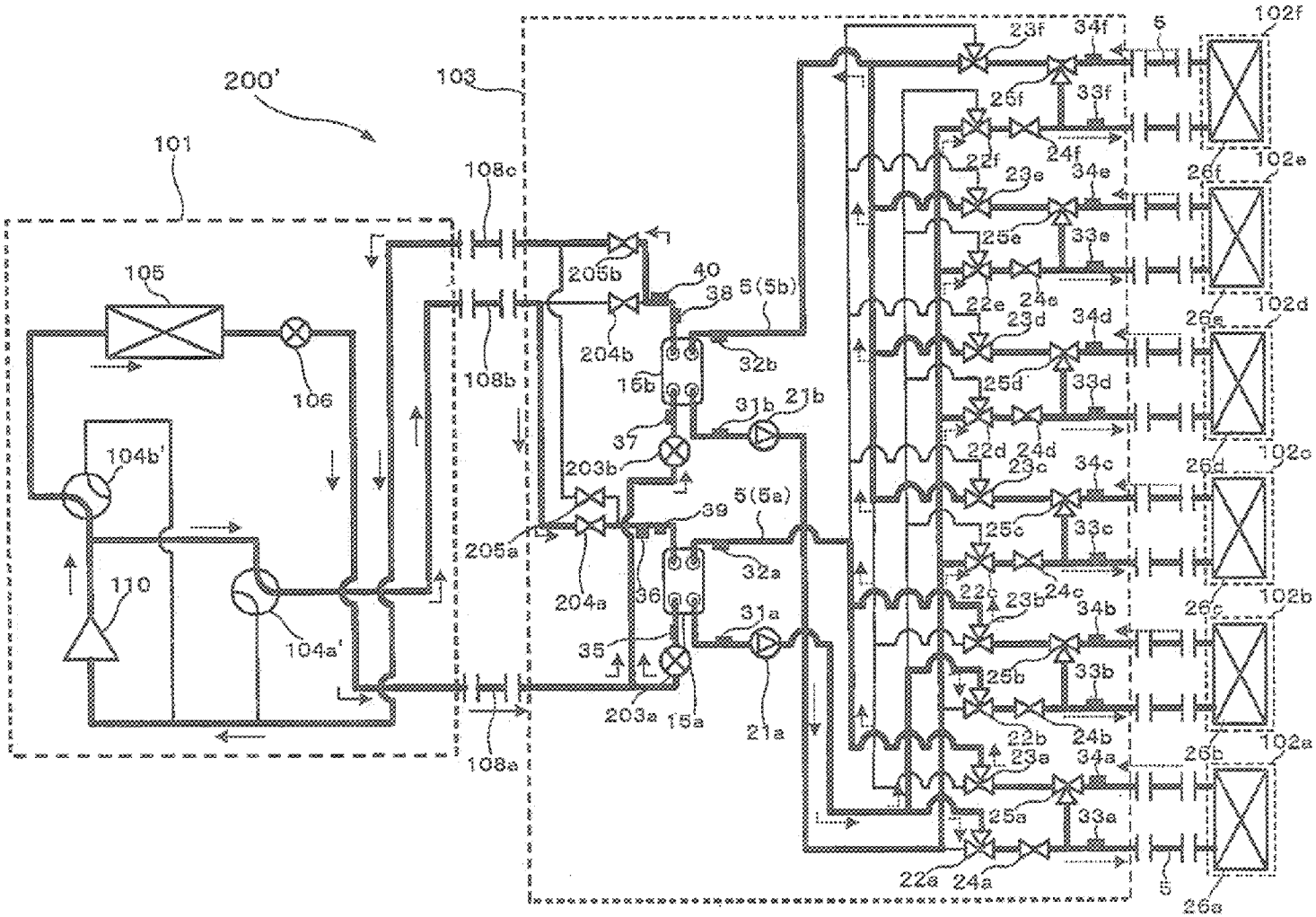
FIG. 16 is the refrigerant circuit diagram illustrating the flow of the refrigerant in a cooling main operation mode of the air-conditioning apparatus.
Figure 17:
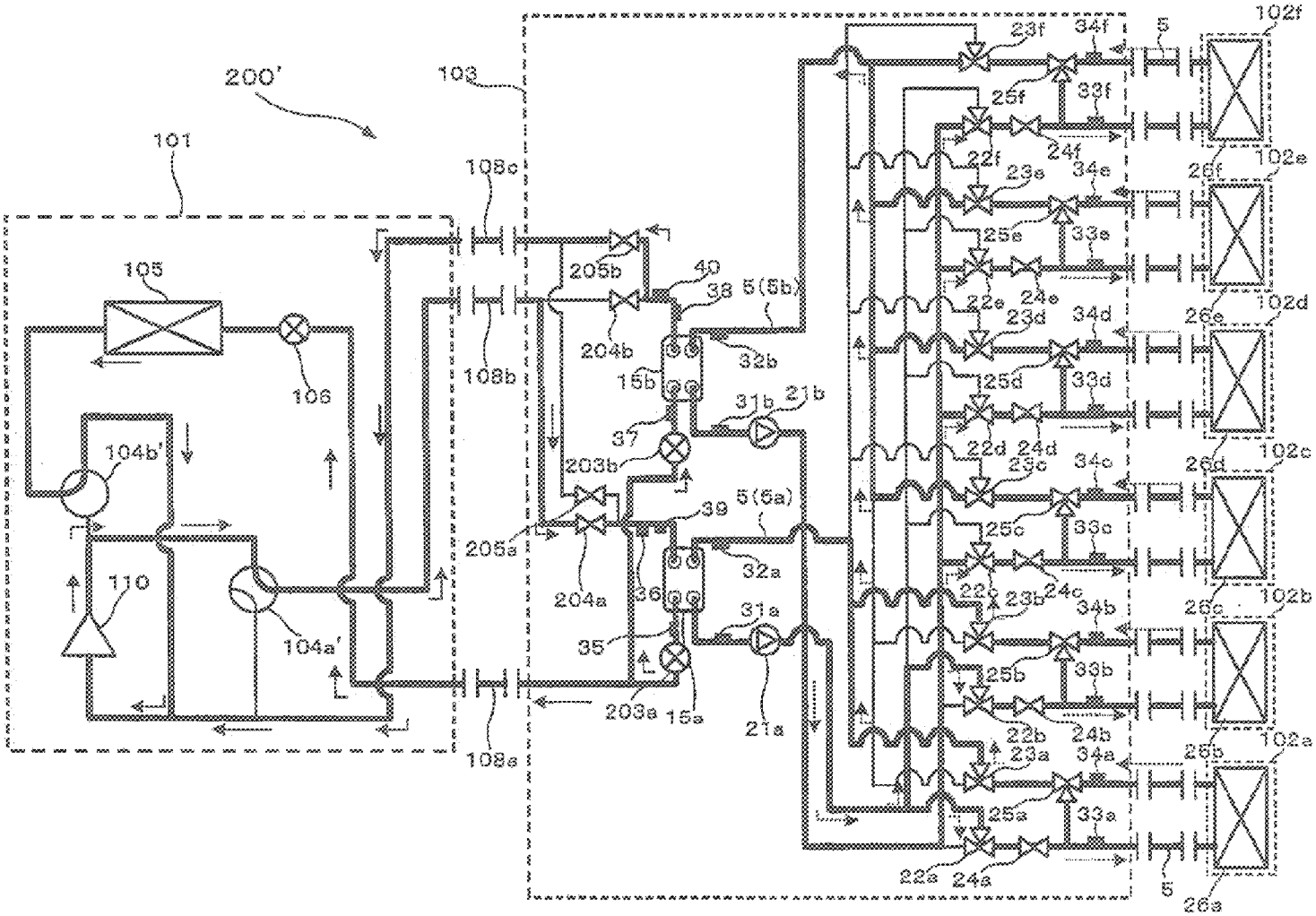
FIG. 17 is the refrigerant circuit diagram illustrating the flow of the refrigerant in a heating main operation mode of the air-conditioning apparatus.

Each operation mode executed by the air-conditioning apparatus 200' will be described below mainly on switching of the four-way valve 104'. FIG. 14 is a refrigerant circuit diagram illustrating the flow of the refrigerant during the cooling only operation mode of the air-conditioning apparatus 200'. FIG. 15 is a refrigerant circuit diagram illustrating the flow of the refrigerant during the heating only operation mode of the air-conditioning apparatus 200'. FIG. 16 is a refrigerant circuit diagram illustrating the flow of the refrigerant during the cooling-main operation mode of the air-conditioning apparatus 200'. FIG. 17 is a refrigerant circuit diagram illustrating the flow of the refrigerant during the heating-main operation mode of the air-conditioning apparatus 200'.

[Cooling Only Operation Mode]

FIG. 14 illustrates a case in which a cooling load is generated in all the use-side heat exchangers 26*a* to 26*f* as an example. In this cooling only operation mode, the four-way valve 104*b*' is switched so that the heat-source side refrigerant discharged from the compressor 110 flows into the heat-source side heat exchanger 105. The operations of those other than the four-way valves 104' are the same as those in FIG. 9. In FIG. 14, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

[Heating Only Operation Mode]

FIG. 15 illustrates a case in which a heating load is generated in all the use-side heat exchangers 26*a* to 26*f* as an example. In this heating only operation mode, the four-way valve 104*b*' is switched so that the heat-source side refrigerant discharged from the heat-source side heat exchanger 105 flows into the compressor 110, and the four-way valve 104*a*' is switched so that the heat-source side refrigerant discharged from the compressor 110 is conducted through the refrigerant pipeline 108*b*. The operations of those other than the four-way valve 104' are the same as in FIG. 10. In FIG. 15, the pipeline expressed by a bold line indicates a pipeline through which the refrigerant circulates. Also, the flow direction of the heat-source side refrigerant is indicated by a solid-line arrow, while the flow direction of the heat medium by a broken-line arrow.

[Cooling-Main Operation Mode]

FIG. 16 illustrates a case in which a heating load is generated in the use-side heat exchanger 26*a* and the use-side heat exchanger 26*b*, and a cooling load is generated in the use-side heat exchangers 26*c* to 26*f* as an example. In this cooling-main operation mode, the four-way valve 104*b*' is switched so that the heat-source side refrigerant discharged from the compressor 110 flows into the heat-source side heat exchanger 105, and the four-way valve 104*a*' is switched so that the heat-source side refrigerant discharged from the compressor 110 is conducted through the refrigerant pipeline 108*b*. The operations of those other than the four-way valve 104' are the same as those in FIG. 11. In FIG. 16, the pipeline expressed by a bold line indicates a pipeline through which the refrigerant circulates. Also, the flow direction of the heat-source side refrigerant is indicated by a solid-line arrow, while the flow direction of the heat medium by a broken-line arrow.

[Heating-Main Operation Mode]

FIG. 17 illustrates a case in which a heating load is generated in the use-side heat exchangers 26*a* to 26*b*, and a cooling load is generated in the use-side heat exchangers 26*c* to 26*f* as an example. In this heating-main operation mode, the four-way valve 104*b*' is switched so that the heat-source side refrigerant discharged from the heat-source side heat exchanger 105 flows into the compressor 110, and the four-way valve 104*a*' is switched so that the heat-source side refrigerant discharged from the compressor 110 is conducted through the refrigerant pipeline 108*b*. In FIG. 17, the pipeline expressed by a bold line indicates a pipeline through which the refrigerant (heat-source side refrigerant and the heat medium) circulates. Also, the flow direction of the heat-source side refrigerant is indicated by a solid-line arrow, while the flow direction of the heat medium by a broken-line arrow.

As described above, by configuring a flow-rate controller mounted on the heat source device 101 by the four-way valve, the operation similar to that of the air-conditioning apparatus 200 can be also realized. Therefore, the air-conditioning apparatus 200' has the same effects as the air-conditioning apparatus 200, the heat-source side refrigerant and the heat medium can be shut off, inflow of the heat-source side refrigerant into the living space 7 can be suppressed, and safety and reliability can be improved.

Figure 18:
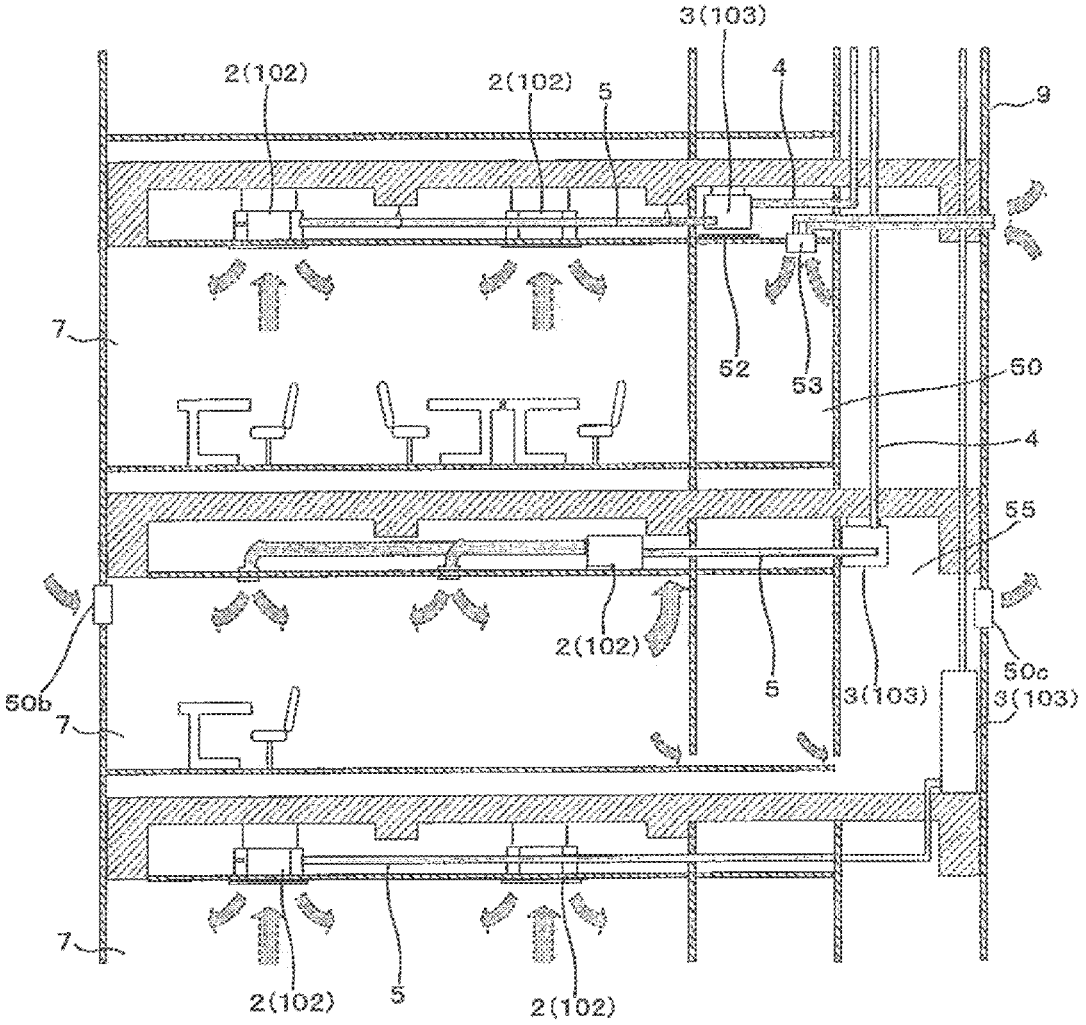
FIG. 18 is an outline diagram illustrating an example of an arranged state of each component in a building in which the air-conditioning apparatus is installed.
Figure 19:
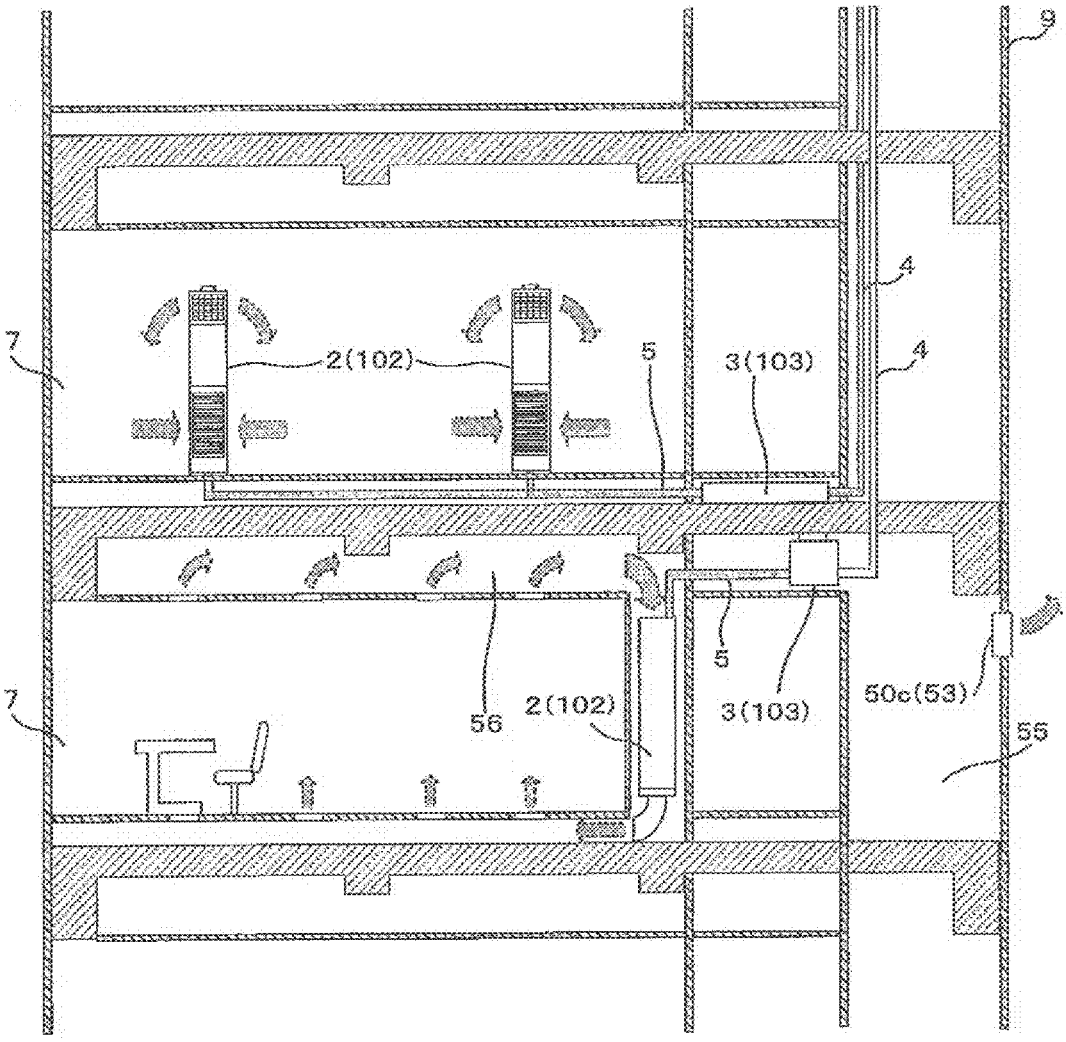
FIG. 19 is an outline diagram illustrating another example of the arranged state of each component in the building in which the air-conditioning apparatus is installed.
Figure 20:
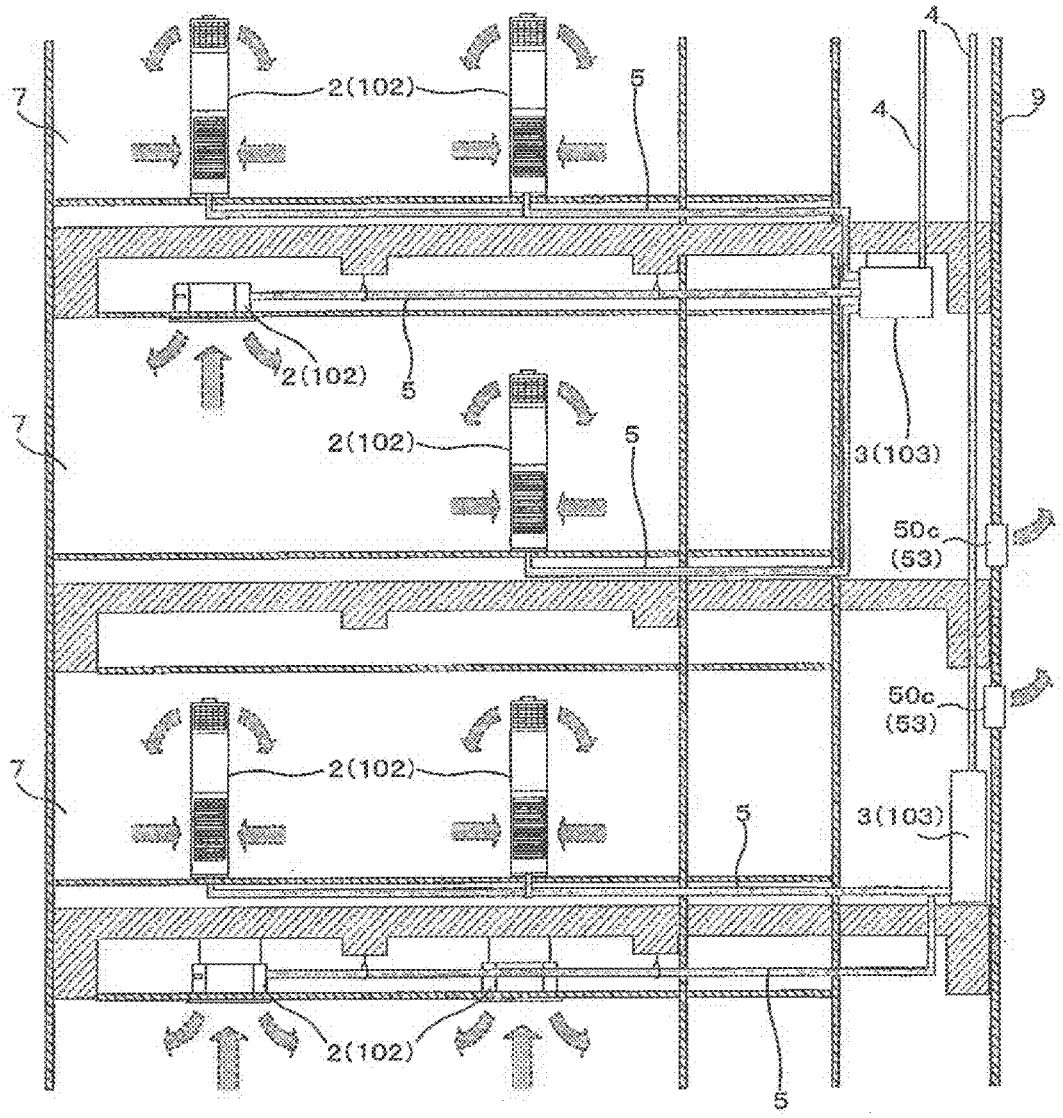
FIG. 20 is an outline diagram illustrating still another example of the arranged state of each component in the building in which the air-conditioning apparatus is installed.

An assumed installation example of the air-conditioning apparatus according to the above-described embodiments will be described below. FIG. 18 is an outline diagram illustrating an example of an arranged state of each component inside the building 9 in which the air-conditioning apparatus is installed. FIG. 19 is an outline diagram illustrating another example of an arranged state of each component inside the building 9 in which the air-conditioning apparatus is installed. FIG. 20 is an outline diagram further illustrating another example of an arranged state of each component inside the building 9 in which the air-conditioning apparatus is installed. In FIGS. 18 and 19, an assumed plurality of patterns of the arranged state of the relay unit 3 or the relay unit 103 (hereinafter collectively referred to as the relay unit 3) are collectively shown.

FIG. 18 shows three arrangement patterns. In the first pattern, the relay unit 3 is arranged under the roof other than the living space 7 or under the roof of a passage, which is one of the non-living space 50 where a ventilating device 53 independent of the living space 7 is disposed. By arranging the relay unit 3 in a space where the ventilating device 53 is disposed, if the refrigerant should leak from under the roof to the space below, the heat-source side refrigerant can be discharged from the ventilating device 53, concentration rise of the heat-source side refrigerant can be suppressed, and an evacuation path can be ensured. Also, in the first pattern, a vibration suppression plate 52 is disposed under the roof where the relay unit 3 is arranged. The vibration suppression plate 52 has a function to absorb vibration sound if the vibration sound is caused by the pump 21 in the relay unit 3 and can be any type as long as sound energy is consumed, but an elastic body such as rubber or a solid substance having a mass that can suppress sound can be used. The vibration suppression plate 52 is disposed between the pump 21 and the ceiling plate and installed in the housing of the relay unit 3 or on the back face of the ceiling plate.

Moreover, in the first pattern, the relay unit 3 is suspended in the air. By suspending the relay unit 3 in the air, vibration generated from the relay unit 3 is not directly propagated to the ceiling but excellent silence can be obtained and comfort is improved. The relay unit 3 is connected to a building structural body under the roof by a connecting tool such as reinforcing steel and wire, and in the relay unit 3, a connection port such as a bolt hole that can be detachably attached to the connecting tool is disposed. The suspension does not necessarily have to be made in the form in which the relay unit 3 is directly connected to the structural body of the building 9, but the connecting tool may be connected to the wall inside the room other than the space under the roof for suspension. In the first pattern, the relay unit 3 is arranged substantially at the same height as the indoor unit 2 or the indoor unit 102. As a result, a head pressure on the pump (pump 21) mounted on the relay unit 3 becomes small, the member of the pump can be thinned, and the weight of the pump can be reduced.

In the case of the prior-art chiller system, the water pipeline is connected to the indoor unit from the pump of the heat source device installed on the roof or on the ground with a height difference of ten and several meters or more. Thus, due to the height difference and the head pressure of the long extended water pipeline, the pressure at pump is high. Thus, a pump with an extremely large strength needs to be used, and due to the high water pressure, there is a problem that a failure or water leakage can occur more easily than the case of a low water pressure. In the case of the relay unit 3 of this embodiment, since the unit is installed substantially at the same height as the indoor unit 2, this problem can be effectively improved. The substantially the same height means that the housing of the indoor unit 2 and the housing of the relay unit 3 have portions overlapping each other in the horizontal direction. Particularly, since the relay unit 3 does not include a heat exchanger for outdoor air or a large capacity compressor that gives heat energy sufficient for cooling or heating using a pressure unlike the prior-art heat source device, the configuration can be made compact. Thus, a system in which a height difference between the indoor unit 2 and the pump 21 is small can be constructed.

In the second pattern, the relay unit 3 is arranged on the wall (including the wall back 50*a* described in FIG. 1*a*) on which the ventilating device 53 is disposed. By arranging the relay unit 3 at this position, in the case of refrigerant leakage, the heat-source side refrigerant can be emitted to the outdoor space 6, and safety can be further improved. The relay unit 3 can be installed away from the wall or can be placed on the floor. In addition, maintenance performance of the relay unit 3 is improved as described in FIG. 1*a*. In the second pattern, the relay unit 3 is arranged on the floor immediately above the indoor unit 2 or the indoor unit 102 operated by this relay unit 3. As a result, the path (particularly, the height difference) of the pipeline 5 can be reduced, and power of the pump can be decreased, which leads to pressure reduction of the pipeline 5. Since a head pressure in the relay unit 3 is made small, an expansion tank, not shown, can be made compact.

Moreover, the relay unit 3 is disposed in a space with an air pressure lower than that in the space to be air-conditioned where the indoor unit 2 or a discharge outlet of the indoor unit 2 is disposed, that is, in the space with a negative pressure. Thus, in the case of refrigerant leakage, intrusion of the refrigerant through a gap in the wall of the space to be air-conditioned and the like can be effectively suppressed. This negative pressure is realized by the ventilating device 53 that discharges the air to the outside of the building 9. By disposing a ventilation air inlet 50*b* that takes in the air front outside the building 9 in a living room, which is a space to be air-conditioned, the air flow from the space to be air-conditioned to the space where the relay unit 3 is installed can be reinforced, and moreover, a diffusion suppressing effect of the leaked refrigerant is high.

In the third pattern, the relay unit 3 is arranged in a machine room 55, which is one of the non-living space 50 where the air outlet 50*c* for may be the ventilating device 53) is disposed. By arranging the relay unit 3 at this position, in the case of refrigerant leakage, intrusion of the heat-source side refrigerant into the living space 7 can be suppressed. Also, by ventilating the air in the machine room 55, concentration rise of the heat-source side refrigerant can be suppressed. Particularly, if the relay unit 3 is placed on the floor, a height difference from the indoor unit 2 installed above the ceiling on the floor immediately below is small, and it is effective for reduction of the pump power. Moreover, if the HFC (Hydro Fluoro Carbon) refrigerant is used as a refrigerant, the refrigerant has a specific gravity heavier than the air and it flows down after occurrence of the leakage, but in this case, since the space is strictly divided from the floor below by the structural body of the building 9, safety on the floor below can be further improved. Also, on the installed floor, a state in which the refrigerant is poured down from the ceiling can be avoided, which is advantageous, as compared with the case of suspension from the ceiling.

In any of the patterns, a refrigerant leakage detection sensor (not shown) is preferably disposed. By disposing of the refrigerant leakage detection sensor, in the case of refrigerant leakage, the refrigerant leakage can be rapidly detected, occurrence of abnormality can be notified to a user, and safety can be further ensured. In addition, since the refrigerant leakage can be rapidly detected, a refrigerant leakage amount can be reduced. Also, in any of the patterns, the pressure in the installed space of the relay unit 3 is made negative than the living space 7 or the pressure in the living space 7 is made positive than the installed space of the relay unit 3. As a result, in the case of the refrigerant leakage, intrusion of the heat-source side refrigerant to the living space 7 can be suppressed.

FIG. 19 shows two arrangement patterns. In the first pattern, the relay unit 3 is installed under the floor of the non-living space 50 other than the living space 7. By arranging the relay unit 3 at this position, in the case of refrigerant leakage, since the heat-source side refrigerant is heavier than the air, the refrigerant is difficult to go up toward the living space 7 from under the floor. If the relay unit 3 is arranged under the floor, the indoor unit 2 or the indoor unit 102 is preferably a floor-set type. As a result, the path (particularly, the height difference) of the pipeline 5 can be reduced, and power of the pump can be decreased, which leads to pressure reduction of the pipeline 5. Since a head pressure in the relay unit 3 is made small, an expansion tank, not shown, can be made compact. Also, maintenance performance can be improved as compared with arrangement under the roof or the like.

In the second pattern, the relay unit 3 is arranged under the roof (or may be in the machine room 55) isolated from an air chamber 56 if a space under the roof (a part of the non-living space 50) is the air chamber (chamber) 56. By arranging the relay unit 3 at this position, in the case of refrigerant leakage, the refrigerant leakage to the living space 7 can be suppressed. In this case, the indoor unit 2 or the indoor unit 102 is generally arranged behind the wall of the living space 7, the indoor air is sucked through the ceiling, and air-conditioned air is supplied to the living space 7 from under the floor.

Considering the refrigerant leakage, if the space under the roof is a ventilation path, by installing the relay unit 3 under the roof of a room, the leaked refrigerant is forced to be blown out to the living space 7 through the ventilation path. Thus, the refrigerant concentration is raised more rapidly than usual, but in this second pattern, since the relay unit 3 is disposed at a place separated by a partition plate or a wall from an air handling unit, which is the indoor unit 2, the rise of refrigerant concentration in the refrigerant leakage can be effectively suppressed. The relay unit 3 is disposed under the roof of a passage or a kitchenette, and by installing it in a place adjacent to the indoor unit 2 with a wall or the like between them, conveyance power is reduced, and energy saving effect is high. Particularly, the relay unit 3 of this embodiment is a thin type with the height of the outline form of 300 mm or less, flexibility of installation is high, and even if the adjacent place is surrounded by other living rooms and corridors, the relay unit 3 can be installed in a place with high energy saving effect. Also, needless to say, the relay unit 3 can be installed not only under the roof but outside the space to be air-conditioned of the air-conditioning apparatus 100 such as a machine room, kitchenette and the like as shown in other examples.

Also, in the second pattern, the space under the roof of a corridor, which is one of the non-living space 50, and the machine room 55 where the air outlet 50*c* (or may be the ventilating device 53) is disposed communicate with each other, and the relay unit 3 is arranged under the roof of this corridor. By arranging the relay unit 3 at this position, a large space including the space under the roof of the corridor and the machine room 55 can be secured, and the concentration with the same refrigerant amount can be reduced. Also, the refrigerant concentration can be further reduced by the air outlet 50*c* or the ventilating device 53.

FIG. 20 shows a state in which the indoor units 2 or the indoor units 102 installed in adjacent floors (three floors here) are connected by one common relay unit 3. As a result, the length of the pipeline 5 can be reduced. That is, the length of the pipeline 5 can be reduced by that rather than arranging the relay unit 3 on the roof of the building 9 and connecting it to the indoor units 2 or the indoor units 102 on each floor from there. By reducing the length of the pipeline 5, a construction cost can be reduced. Also, an input of the pump can be reduced, and power consumption can be decreased.

Figure 21:
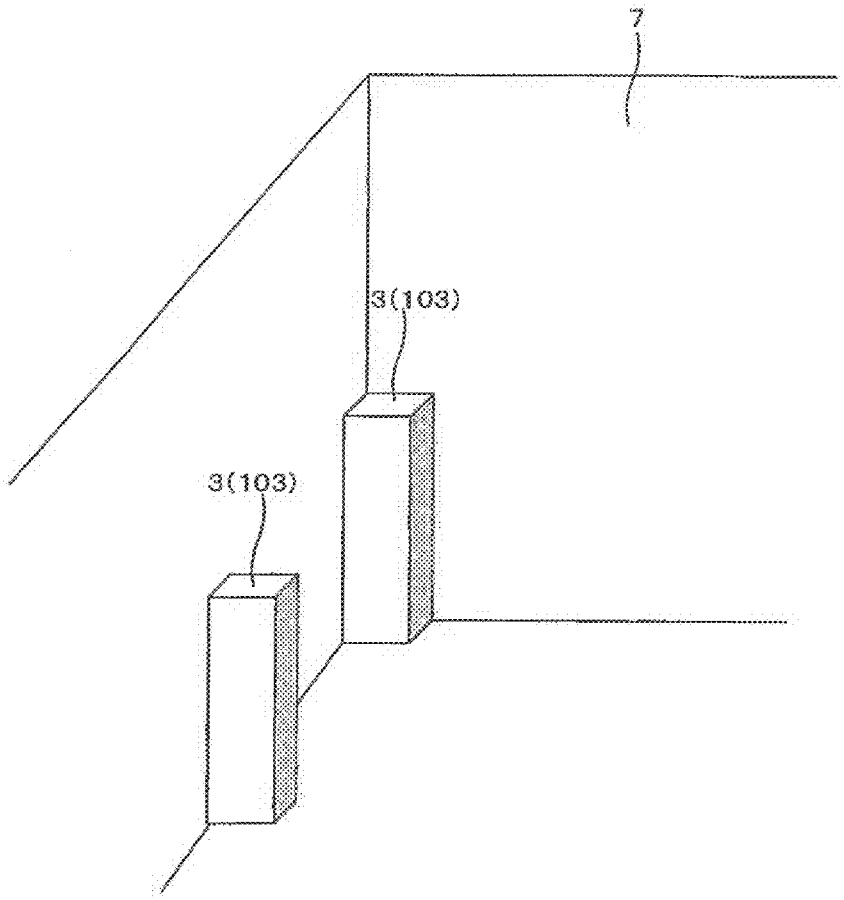
FIG. 21 is an outline diagram illustrating an example of an arranged state of the relay unit.

Moreover, since the relay unit 3 can be made common, the head pressure in the relay unit 3 can be made small, and the expansion tank, not shown, can be made compact. Further-more, since the relay unit 3 can be made common, the installed state of the indoor unit 2 or the indoor unit 102 that can be connected to the relay unit 3 can be diversified (such as a ceiling-mounting indoor unit or floor-standing type indoor unit). That is, the indoor units 2 or the indoor units 102 in the various installation forms can be connected to one relay unit 3. Therefore, a wide selection according to the air-conditioning application can be realized. The contents described in FIGS. 18 to 20 may be combined as appropriate, and selection and determination can be made in accordance with the size, application and the like of the building 9 in which the air-conditioning apparatus is to be installed. The relay unit 3 may be installed in the space in the ceiling or behind the wall of a toilet or a kitchenette. Also, as shown in FIG. 21, the relay unit 3 may be leaned against the wall or a corner. Particularly, the toilet is ventilated all the time, and if the refrigerant should leak, the leakage is discharged to the outside by ventilation, which does not result in a big problem.

The invention claimed is:

1. An air-conditioning apparatus comprising:

a heat source device having a compressor that pressurizes a primary refrigerant used by changing states between a gas phase and a liquid phase or between a supercritical state and a non-supercritical state, a switching device that switches the circulation direction of said primary refrigerant, and a first heat exchanger connected to said switching device and is installed outside of a building having a plurality of floors or a space leading to the outside;

a relay unit having a plurality of second heat exchangers, the relay unit disposed on an installed floor different from said heat source device and in a space not to be air-conditioned different from the space to be air-conditioned where the air for cooling or the air for heating is supplied and exchanges heat between said primary refrigerant and a secondary refrigerant mainly composed of water or brine, and a plurality of sets of two three-way valves configured to switch a flow path of said secondary refrigerant, a plurality of pipelines including branches connecting each inlet of the plurality of second heat exchangers to one three-way valve of each of the plurality of sets of two three-way valves and connecting each outlet of the plurality of second heat exchangers to another three-way valve of each of the plurality of sets of two three-way valves, and a plurality of pumps disposed in the pipelines including branches for conveying the secondary refrigerant from each of the plurality of second heat exchangers, the relay unit performing, at a same time, heating of the secondary refrigerant by at least one of the second heat exchangers and, cooling of the secondary refrigerant by at least one of the remainder of the second heat exchangers;

a plurality of indoor units each having a third heat exchanger that exchanges heat between said secondary refrigerant and the air in said space to be air-conditioned, the relay unit feeding the heated secondary refrigerant to the third heat exchanger of an indoor unit that performs heating, and feeding the cooled secondary refrigerant to the third heat exchanger of an indoor unit that performs cooling, for performing cooling and heating operations simultaneously;

a first pipeline that connects said heat source device and said relay unit and through which said primary refrigerant flows;

a plurality of second pipelines, each second pipeline consists of a set of two pipes wherein said relay unit and each said indoor unit are separately connected to each other by only one respective second pipeline, said secondary refrigerant flows in a liquid phase through each set of two pipes into and out of each indoor unit.

2. The air-conditioning apparatus of claim 1, wherein the space not to be air-conditioned where said relay unit is installed is any of a common place, a machine room, a computer room, or a warehouse.

3. The air-conditioning apparatus of claim 1, wherein the space not to be air-conditioned where said relay unit is installed is in the ceiling in said building.

4. The air-conditioning apparatus of claim 1, wherein the space not to be air-conditioned where said relay unit is installed is behind a wall in said building.

5. The air-conditioning apparatus of claim 1, wherein the space not to be air-conditioned where said relay unit is installed is under the floor in said building, and said indoor unit is a floor-standing type.

6. The air-conditioning apparatus of claim 1, comprising:

a ventilating device for discharging air outside the room disposed in said space not to be air-conditioned where said relay unit is arranged.

7. The air-conditioning apparatus of claim 1, wherein a refrigerant leakage detection sensor is disposed in said space not to be air-conditioned where said relay unit is arranged.

8. The air-conditioning apparatus of claim 1, wherein said indoor units arranged on adjacent floors are connected to one said relay unit.

9. The air-conditioning apparatus of claim 1, wherein a filled amount of a heat-source side refrigerant to be sealed in said refrigeration cycle is determined by (leakage limit concentration of said heat-source side refrigerant)× (capacity of a place with the smallest capacity in places where said indoor units are arranged).

10. The air-conditioning apparatus of claim 1, wherein said relay unit is divided into a first relay unit and a second relay unit;

a gas-liquid separator that separates the refrigerant into a gas and a liquid is contained in said first relay unit; and said second heat exchangers and said pump are contained in said second relay unit, respectively.

11. The air-conditioning apparatus of claim 1, wherein said heat source device and said relay unit are connected by three pipelines that become inward and outward paths of the refrigerant.

12. The air-conditioning apparatus of claim 1, further comprising:

refrigerant concentration detecting means that detects concentration of the heat source side refrigerant in said relay unit; and a controller that controls a driving frequency of said compressor and an opening degree of an expansion valve on the basis of detection information from said refrigerant concentration detecting means.

13. The air-conditioning apparatus of claim 12, wherein said controller stops driving of said compressor when the controller judges that the refrigerant concentration detected by said refrigerant concentration detecting means becomes a predetermined threshold value determined or more.

14. The air-conditioning apparatus of claim 12, wherein said controller closes said expansion valve when the controller judges that the refrigerant concentration detected by said refrigerant concentration detecting means becomes a predetermined threshold value determined or more.

15. The air-conditioning apparatus of claim 13, wherein said controller makes an alarm on occurrence of abnormality when the controller stops the driving of said compressor or closes said expansion valve.

16. The air-conditioning apparatus of claim 1, wherein a natural refrigerant or a HFO refrigerant having a smaller global warming coefficient is used as said primary refrigerant.

17. The air-conditioning apparatus of claim 6, wherein said ventilating device discharges air outside the room directly or via the duct.

18. The air-conditioning apparatus of claim 1, wherein the first pipeline consists of a set of two pipes.

19. The air-conditioning apparatus of claim 1, wherein the first pipeline consists of a set of three pipes.

20. The air-conditioning apparatus of claim 1, being configured to operate:

a heating-main operation in which the primary refrigerant discharged from the compressor flows into the relay unit without passing through the first heat exchanger; and a cooling-main operation in which the primary refrigerant discharged from the compressor flows into the relay unit with passing through the first heat exchanger, and wherein the switching device switches the circulation direction of the primary refrigerant to switch between the heating-main operation and the cooling-main operation.

21. The air-conditioning apparatus of claim 20, wherein the second heat exchanger cooling the secondary refrigerant during the heating-main operation is the same as the second heat exchanger cooling the secondary refrigerant during the cooling-main operation, and the second heat exchanger heating the secondary refrigerant during the heating-main operation is the same as the second heat exchanger heating the secondary refrigerant during the cooling-main operation.

22. The air-conditioning apparatus of claim 1, wherein the relay unit includes an expansion valve to decompress the primary refrigerant, and the expansion valve decompresses the primary refrigerant that flows from the second heat exchanger heating the secondary refrigerant and flows into the second heat exchanger cooling the secondary refrigerant, when performing the cooling and heating operations simultaneously.

23. The air-conditioning apparatus of claim 1, wherein the secondary refrigerant flows from any of the second heat exchangers to the indoor unit through the one of the two three-way valves of each respective set of the plurality of sets of two three-way valves and flows from the indoor unit to any of the second heat exchangers through the other of the two three-way valves of each respective set of the plurality of sets of two three-way valves.

* * * * *